US005521044A

United States Patent [19]

Muto et al.

[11] Patent Number: 5,521,044

[45] Date of Patent: May 28, 1996

[54] ELECTROPHOTOSENSITIVE MATERIAL

[75] Inventors: Nariaki Muto; Keisuke Sumida; Hiroaki Iwasaki; Tsuneo Oki; Eiichi Miyamoto; Yasuyuki Hanatani; Hiroaki Sakai, all of Osaka, Japan

[73] Assignee: Mita Industrial Co., Ltd., Osaka, Japan

[21] Appl. No.: 6,317

[22] Filed: Jan. 22, 1993

[30] Foreign Application Priority Data

| | | | |
|---|---|---|---|
| Jan. 22, 1992 | [JP] | Japan | 4-009326 |
| Apr. 30, 1992 | [JP] | Japan | 4-111911 |
| May 14, 1992 | [JP] | Japan | 4-122218 |
| Jul. 22, 1992 | [JP] | Japan | 4-195626 |
| Jul. 22, 1992 | [JP] | Japan | 4-195627 |

[51] Int. Cl.[6] ..... G03G 5/06; G03G 5/09

[52] U.S. Cl. ..... 430/83; 430/96

[58] Field of Search ..... 430/59, 76, 83, 430/96

[56] References Cited

U.S. PATENT DOCUMENTS

| | | | |
|---|---|---|---|
| 4,968,571 | 11/1990 | Gruenbaum et al. | 430/58 |
| 4,999,269 | 3/1991 | Emoto et al. . | |
| 5,041,349 | 8/1991 | Emoto et al. . | |
| 5,059,503 | 10/1991 | Muto et al. | 430/59 |
| 5,213,923 | 5/1993 | Yokoyama et al. | 430/58 |
| 5,324,610 | 6/1994 | Tanaka et al. | 430/59 |
| 5,378,568 | 1/1995 | Okaji et al. | 430/58 |

OTHER PUBLICATIONS

Diamond, Arthur S., Handbook of Imaging Materials. New York: Marcel–Dekker, Inc. pp. 401–402, 424–425, 427–434.

Patent Abstract of Japan, vol. 12, No. 74, (P–674) (2921), Mar. 9, 1988 to Nakajima.

Patent Abstract of Japan, vol. 14, No. 8, (P–987)(3951), Jan. 10, 1990 to Akasaki.

Database WPIL, Section Ch, Week 8928, Derwent Publications, Ltd., Class A69, An 89–203384 to Mita Industrial.

*Primary Examiner*—Christopher D. Rodee

*Attorney, Agent, or Firm*—Beveridge, DeGrandi, Weilacher & Young

[57] ABSTRACT

An electrophotosensitive material of the present invention is formed by providing a photosensitive layer containing a bis-azo pigment expressed in formula (1):

(1)

wherein $A^1$, $A^2$, $R^1$ and n are as defined, as a charge generating material, and a diamine compound expressed in formula (2):

(2)

wherein $R^2$, $R^3$, $R^4$, $R^5$, $R^6$ and $R^7$ p and q k, l, m and o are as defined, as a charge-trasferring material, on a conductive substrate. As a charge generating material, a perylene pigment, anthanthrone pigment, X-type metal-free phthalocyanine pigment, imidazoleperylene pigment or perylene bis-azo pigment are preferable used together with the bis-azo pigment. Thus, photosensitive material is excellent in sensitivity and durability.

5 Claims, No Drawings

ELECTROPHOTOSENSITIVE MATERIAL

BACKGROUND OF THE INVENTION

The present invention relates to an electrophotosensitive material for use in an image forming apparatus making use of an electrophotographic method, such as an electrostatic copying machine and laser beam printer.

An electrophotographic method such as the Carlson process comprises a step of uniformly charging the surface of an electrophotosensitive material by corona discharge, a light exposure step of exposing the charged surface of the electrophotosensitive material to form an electrostatic latent image on the surface, a developing step of contacting a developing agent with the formed electrostatic latent image to make the electrostatic latent image sensible as a toner image by the toner contained in the developing agent, a transfer step of transferring the toner image onto paper or the like, a fixing step of fixing the transferred toner image, and a cleaning step of cleaning the toner remaining of the electrophotosensitive material after the transfer step.

Recently, in the electrophotosensitive material used in the electrophotographic method as mentioned above, instead of those mainly composed of inorganic photoconductive materials such as selenium and cadmium sulfide which are toxic and are hard to handle, various so-called organic photosensitive materials using less toxic organic photoconductive compounds are proposed. Such organic photosensitive materials are excellent in processability and are easy to manufacture, and are large in the degree of freedom of function design.

Such organic photosensitive materials are often composed of photosensitive layers of function separation type generally comprising a charge generating material for generating an electric charge by irradiation with light, and a charge transferring material for conveying the generated charge.

As the charge generating material used in such electrophotosensitive material, a specific bis-azo pigment is disclosed in the U. S. Pat. Nos. 5,041,349 and 4,999,269. This bis-azo compound is expressed in the following Formula (1):

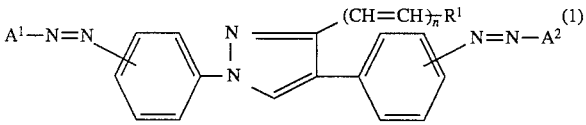

(1)

where $A^1$ and $A^2$ are same or different, coupler residues, $R^1$ denotes a hydrogen atom, an alkyl group, an aryl group or a heterocyclic group, and the alkyl group, the aryl group and the heterocyclic group may have a substituent, and n is 0 or 1.

This bis-azo pigment (1) is stable in heat and light, possesses a high charge generation efficiency, and is high in sensitivity and excellent in repeatability.

To prepare, incidentally, an organic photosensitive material of function separation type using charge generating material and charge transferring material, it is necessary to select materials superior in matching, satisfying all electrophotographic properties including the sensitivity, potential retaining performance, potential stability, and residual potential. For example, however, even if the charge generating material may sufficiently generate an electric charge, satisfactory electrophotograhic properties are not obtained unless combined with a charge transferring material capable of injecting and conveying the charge efficiently.

According to the preceding U.S. patents, by combining the bis-azo pigment expressed in Formula (1) with various charge transferring materials (carrier moving substances), it is disclosed that photosensitive materials stable in heat and light are obtained. However, the charge generating materials disclosed in the U.S. patents are, as compared with the ordinary charge generating materials such as phthalocyanine or perylene pigment, fluorene type bis-azo pigment (Japanese Unexamined Patent Publication 57-96345), or oxadiazole type azo pigment possessing a coupler having perinone skeleton (Japanese Unexamined Patent Publication 59-229562), easier to oxidize and deteriorate in ozone, nitrogen oxide NOx and light in the copying machine, and the photosensitive material characteristics are easily lowered. The oxidation and deterioration of such bis-azo pigment (1) may be estimated to be due to decomposition of the azo group by adsorption of ozone on the azo group.

Such oxidation and deterioration will be promoted when the bis-azo compound (1) is used in combination with the charge transferring material which is an electron donor compound. It is considered because the electron donor compound is oriented on the azo group when the basicity of the electron donor compound is strong, and the electron density in the azo group is intensified so as to be vulnerable to the attacks of ozone or nitrogen oxides.

Therefore, it was hitherto impossible to obtain a photosensitive material possessing a high sensitivity and an excellent repeatability without sacrificing the superior characteristics of the bis-azo pigment (1).

Yet, although matching of charge generating material and charge transferring material is satisfactory, if there is a problem in the properties of the binding resin for composing the photosensitive layer by coupling these materials, a photosensitive material comprehensively excellent in electrophotographic properties cannot be obtained. For example, if the strength of the photosensitive layer is not enough or if the adhesion of the photosensitive layer to the base is not sufficient, the surface may be flawed or the photosensitive material may be peeled off due to physical impact received from the cleaning blade pressed to the photosensitive material surface in the image forming apparatus, a felt preventive the toner splash, a charging roller, a transfer roller and other members, or paper contacting with the surface of the photosensitive material at the time of image formation. Therefore, however excellent the sensitivity may be, a spotless excellent image is not obtained, or however excellent the repeatability may be, sufficient durability is not obtained.

As the binding resin, various high polymers disclosed in the foregoing U.S. patents, such as polystyrene, (meth)-acrylic ester, polycarbonate, polyester, butyral resin, and epoxy resin, are generally used.

In the Japanese Unexamined Patent Publication 57 -4051, the polycarbonate, among the above polymers, is disclosed as the material excellent in film forming capability and capable of forming a tough photosensitive layer superior in resistance to abrasion. However, the polycarbonate is not enough in adhesion with the conductive substrate or base layer, and hence a certain pretreatment is needed prior to layer forming in order to improve the adhesion, which leads to problems in productivity and cost. In the Japanese Unexamined Patent Publications 61-132954 and 2-236555, derivatives of polycarbonate having silicon introduced in the main chain are used as the binding resin, but these derivatives, same as the ordinary polycarbonate, are not sufficient in the adhesion.

In order to eliminate the defects of the polycarbonate and improve the adhesion of the photosensitive layer, the Japanese Unexamined Patent Publication 59-71057 discloses blending of polycarbonate, and the Japanese Unexamined Patent Publication 62-212660 discloses blending of polyester or polyallylate.

In these polymers, however, the main chain is stiff, and the ester bond responsible for adhesion does not act sufficiently on the base such as the conductive substrate. Hence, it is necessary to add a large content to enhance the adhesion, which may lead to lowering of sensitivity of the photosensitive material as the polar group (the electron aspirating group) in the molecule works as a carrier trap, or promotion of photo-oxidation deterioration of the charge generating material and charge transferring material in the high electric field.

In particular, the bis-azo pigment (1) is a molecule not having planeness like the conventional phthalocyanine or perylene pigment, and is high in dissolution in solvent, and the rate of dispersion of one molecule each in the photosensitive layer is relatively high, and hence it is more vulnerable to photo-oxidation deterioration as compared with conventional pigments dispersed in the photosensitive layer as fine particles composed of multiple molecules. Accordingly, the polyestercarbonate or the like cannot be blended in a large quantity, and the adhesion of the photosensitive layer cannot be enhanced sufficiently.

It was therefore impossible to obtain a photosensitive material possessing high sensitivity and repeatability without sacrificing the excellent characteristics of the bis-azo pigment (1).

SUMMARY OF THE INVENTION

It is a main object of the invention to present a high performance electrophotosensitive material high in sensitivity and excellent in durability, by using the bisazo pigment expressed in Formula (1) as the charge generating material.

It is other object of the invention to present an electrophotosensitive material using the bis-azo pigment expressed in Formula (1) as charge generating material, not limited in the selective range of the charge transferring material, and not adversely affecting the sensitivity and durability of the photosensitive material.

It is further object of the invention to present a high performance electrophotosensitive material having a photosensitive layer containing the bis-azo pigment expressed in Formula (1) and possessing a high strength and adhesion.

The present inventors intensively accumulated studies on the charge transferring material to be used in combination with the bis-azo pigment, and discovered a new fact that the electrophotosensitive material formed by disposing a photosensitive layer containing the bis-azo pigment expressed in Formula (1) as the charge generating material and a diamine compound expressed in Formula (2):

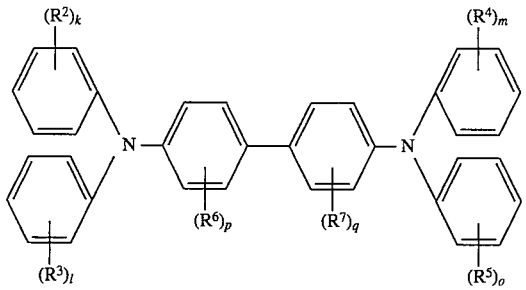

(2)

(where $R^2$, $R^3$, $R^4$, $R^5$, $R^6$, $R^7$ are same or different, an alkyl groups, an alkoxy groups, a halogen atoms, an aryl groups, a nitro groups, a cyano groups, or an alkylamino groups, p and q are integers of 0 to 3, and k, l, m, and o are integers of 0 to 2) as the charge transferring material, on a conductive substrate exhibits high sensitivity and high repeatability, without sacrificing the excellent characteristics of the bis-azo pigment (1).

That is, in the invention, by combining the above specific charge generating material with the charge transferring material, it becomes stable against oxidation and deterioration by ozone, nitrogen oxides and light, so that the sensitivity and repeatability (durability) may be outstandingly improved as compared with the conventional electrophotosensitive material.

The action by the combination of the charge generating material and charge transferring material in the invention is not fully clarified, but the suppressing action on the oxidation and deterioration induced by ozone, nitrogen oxides or the like may be estimated as follows.

The diamine compound (2) used as the charge transferring material is advanced in the non-localization of electrons, and the coordination into the azo group of the bis-azo pigment (1) is impeded by the stereo obstacle by enclosure of nitrogen atoms with phenyl groups, and hence the electron density of the azo group is not increased, so that it is estimated to be less vulnerable to attacks of ozone or the like.

In addition, the bis-azo pigment (1) possesses a high charge generating efficiency and a high sensitivity. The diamine compound (2) is closely related with the bis-azo pigment (1) in ionization potential, and also being excellent in light fastness and durability and the mobility less dependent on the electric field intensity. According to the invention, these characteristics are not decreased, and an optimum combination is realized, so that the high performance of the electrophotosensitive material may be expressed. Concerning the ionization potential, the bis-azo pigment (1) has 5.7 to 5.9 eV, and the diamine compound (2), has 5.2 to 5.7 eV (as measured by model AC-1 of Riken Kiki Co.), and therefore by using in the combination so that their difference may be within about 0.3 eV, the barrier on the hole injection from the bis-azo pigment (1) is easy, and the repeatability is improved. By contrast, if the difference of ionization potential of the two is too large, the hole injection from the pigment to the diamine compound (2) in the charging state (dark state) is very easy, so that the charging capability may be lowered.

In the invention, moreover, in addition to the bis-azo pigment (1) and diamine compound (2), it is preferred to contain a hydrazone compound expressed in Formula (3):

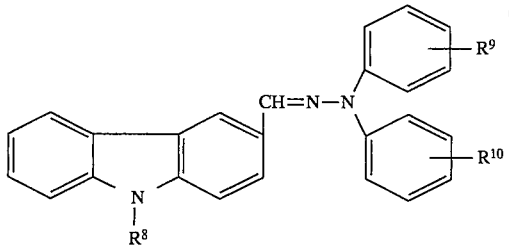

(3)

(where $R^8$ is an alkyl group or an aryl group which may possess a substituent, $R^9$ and $R^{10}$ are the same or different, alkyl groups, alkoxy groups, halogen atoms, aryl groups, nitro groups, cyano groups, or alkylamino groups), a fluorene compound expressed in Formula (4):

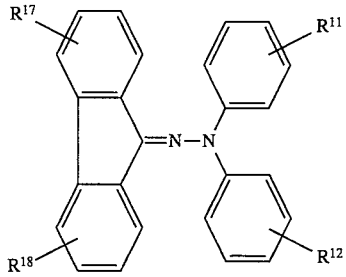

(4)

(where $R^{11}$ and $R^{12}$ are the same or different, hydrogen atoms, halogen atoms, alkoxy groups or alkyl groups, $R^{17}$ and $R^{18}$ are the same or different, hydrogen atoms, alkyl groups or halogen atoms), and a diphenoquinone derivative expressed in Formula (5):

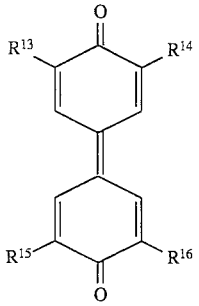

(5)

(where $R^{13}$, $R^{14}$, $R^{15}$ and $R^{16}$ are the same or different, alkyl groups, alkoxyl groups, aryl groups or aralkyl groups).

That is, the diamine compound (2) is dependent on temperature, and it tends to lower in sensitivity when the temperature rises, but the hydrazone compound expressed in Formula (3) is effective for improving the temperature dependence of the diamine compound (2). This is because the hydrazone compound (3) is low in mobility but small in temperature dependence, and, what is more, does not act as a trap in charge transferring as the ionization potential is close to the value of the diamine compound (2).

On the other hand, the hydrazone compound (3) is likely to isomerize optically to deteriorate, and as the optical excitation quenching agent of the hydrazone compound (3), the fluorene compound expressed by Formula (4) is added. The fluorene compound (4) also acts as charge transferring material.

The diphenoquinone derivative expressed in Formula (5) acts to decrease the electrons accumulated in the photosensitive layer and improve the repeatability. However, if the diphenoquinone derivative (5) is added more than specific content, it hardly contributes to the charge transferring, but, to the contrary, forms a trap of charge transfer by interaction with the fluorene compound (4) having the ionization potential of 6 eV or more, thereby lowering the sensitivity.

In other embodiment of the invention, in addition to the bis-azo pigment (1) and diamine compound (2), it is preferred to contain the same diphenoquinone derivative as in Formula (5). That is, in this embodiment, different from the foregoing embodiment, the diphenoquinone derivative expressed in Formula (5) is used alone. However, the diphenoquinone derivative (5) must be added more than in the foregoing embodiment.

This diphenoquinone derivative (5) possesses the ultraviolet ray shielding effect having the absorption near 450 nm. On the other hand, the bis-azo pigment (1) can be used for PPC (using the light source with visible rays such as halogen fluorescent lamp), but when compared with other pigments such as phthalocyanine and perylene carboxylic diimide, the light fastness (photo-oxidation ozone property, toughness) is weak, and decomposition is promoted by ultraviolet light, and accordingly by adding the diphenoquinone derivative (5), it is more effective for stabilization of the photosensitive material, that is, resistance to photo-oxidation deterioration and improvement of repeatability by decrease of trap.

Even by the combination of such charge generating material (1) and charge transferring material (2), when used in a high speed copying machine with the printing speed of 40 to 50 sheets/min, the photosensitive material is exposed to severer environments of use, such that ozone and nitrogen oxides are produced in the machine, and that a greater quantity of light is required, and therefore a further improvement of durability against ozone and nitrogen oxides is demanded.

In the invention, therefore, in addition to the combination of the above specific charge generating material (1) and charge transferring material (2), it is preferred to add at least one type selected from stabilizing agents I to IX in the following combinations.

Stabilizing agent I

A combination of an amine antioxidant which is a polyester oligomer, expressed in Formula (6):

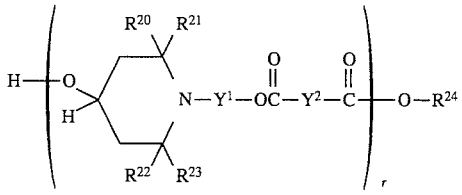

(6)

(where $Y^1$ and $Y^2$ are the same or different, alkylene groups, $R^{20}$, $R^{21}$, $R^{22}$, $R^{23}$ are the same or different, hydrogen atoms or alkyl groups, $R^{24}$ is a hydrogen atom, an aralkyl group or an aryl group, and r is an integer of 3 to 40), and a phenolic antioxidant expressed in Formula (7-a) or (7-b):

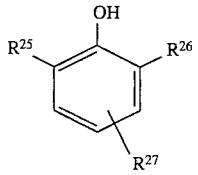

(7-a)

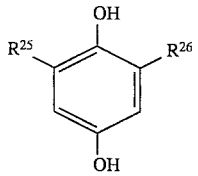

(7-b)

(where either one or both of $R^{25}$ and $R^{26}$ are tert-butyl groups, tert-amyl groups, or α,α-dimethylbenzylphenyl groups, and then one is tert-butyl group, tert-amyl group or α,α-dimethylbenzylphenyl group, the other is a hydrogen atom or an alkyl group, and $R^{27}$ is a hydrogen atom, an alkyl group or a halogen atom).

Stabilizing agent II

A combination of the amine antioxidant which is the polyester oligomer expressed in Formula (6), and a benzotriazole ultraviolet ray absorber of Formula (9):

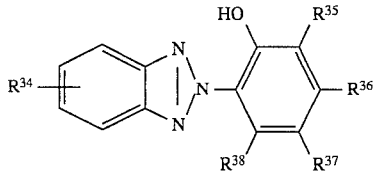

(9)

(where $R^{34}$, $R^{35}$, $R^{36}$, $R^{37}$ and $R^{38}$ are the same or different, hydrogen atoms, halogen atoms, hydroxyl groups, alkyl groups, aralkyl groups or alkoxy groups, and the alkyl groups, aralkyl groups and alkoxy groups may possess substituents).

Stabilizing agent III

A combination of the amine antioxidant which is the polyester oligomer expressed in Formula (6), and an amine antioxidant expressed in Formula (8-b):

(8-b)

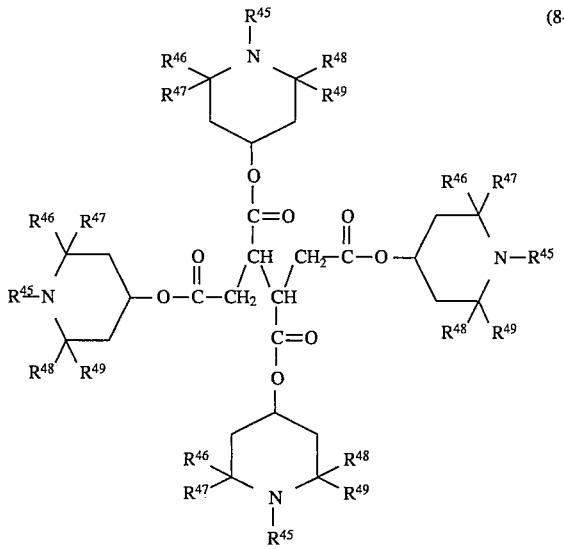

(where $R^{45}$, $R^{46}$, $R^{47}$, $R^{48}$ and $R^{49}$ are the same or different, hydrogen atoms or alkyl groups).

Stabilizing agent IV

A combination of the amine antioxidant which is the polyester oligomer expressed in Formula (6), a spiro type amine antioxidant expressed in Formula (8-a):

(8-a)

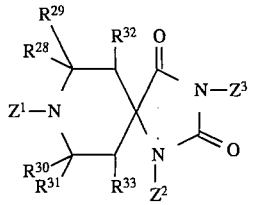

(where $Z^1$, $Z^2$ and $Z^3$ are hydrogen atoms or monovalent organic groups, $R^{28}$, $R^{29}$, $R^{30}$ and $R^{31}$ are the same or different, hydrogen atoms or alkyl groups, $R^{32}$ and $R^{33}$ are the same or different, hydrogen atoms, alkyl groups, halogen atoms or hydroxyl groups), and the benzotriazole ultraviolet ray absorbent expressed in Formula (9).

Stabilizing agent V

A combination of the amine antioxidant which is the polyester oligomer expressed in Formula (6), the spiro type amine antioxidant expressed in Formula (8-a), and a phenol antioxidant expressed in Formula (7-e):

(7-e)

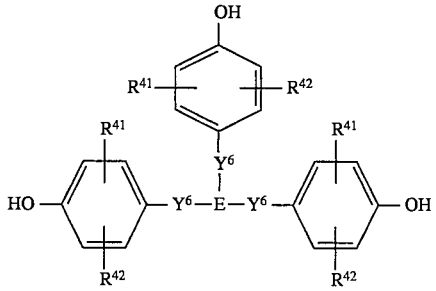

(where $R^{41}$ and $R^{42}$ are the same or different, hydrogen atoms, alkyl groups, cyclohexyl groups or dimethylbenzylphenol groups, E is a group:

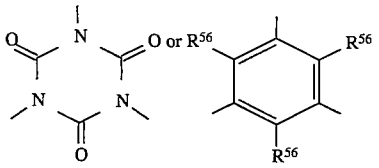

(where $R^{56}$ is a hydrogen atom or alkyl group), and $Y^6$ is an alkylene group, an alkylenecarbonyloxyalkyl group, or an alkyleneoxycarboxyalkyl group).

Stabilizing agent VI

A combination of the amine antioxidant which is the polyester oligomer expressed in Formula (6), the spiro type amine antioxidant expressed in Formula (8-a), and a phenol antioxidant expressed in Formula (7-d):

(7-d)

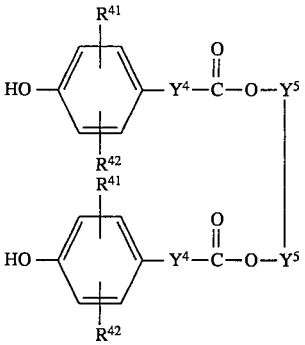

(where $R^{41}$ and $R^{42}$ are the same as above, $Y^4$ is an alkylene group, and $Y^5$ is an alkylene group or an alkylene glycol residue).

Stabilizing agent VII

A combination of the amine antioxidant which is the polyester oligomer expressed in Formula (6), the spiro type amine antioxidant expressed in Formula (8-a), and a phenol antioxidant expressed in Formula (7-c):

(7-c)

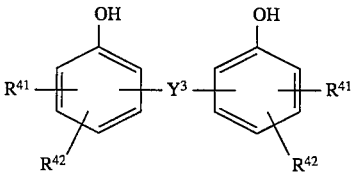

(where $R^{41}$ and $R^{42}$ are the same as above, and $Y^3$ is an alkylene group).

Stabilizing agent VIII

A combination of the amine antioxidant which is the polyester oligomer expressed in Formula (6), the spiro type amine antioxidant expressed in Formula (8-a), and a piperidine antioxidant expressed in Formula (10):

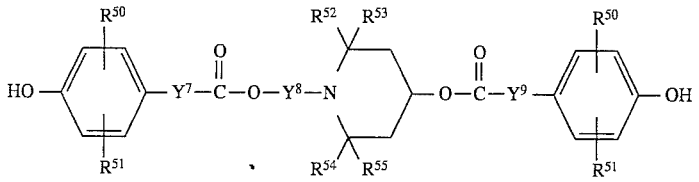

(10)

(where $R^{50}$ and $R^{51}$ are the same or different, hydrogen atoms, alkyl groups, cyclohexyl groups or dimethyl benzyl phenyl groups, $R^{52}$, $R^{53}$, $R^{54}$ and $R^{55}$ are the same or different, hydrogen atoms or alkyl groups, and $Y^7$, $Y^8$ and $Y^9$ are the same or different, alkylene groups).

Stabilizing agent IX

A combination of the amine antioxidant which is the polyester oligomer expressed in Formula (6), the spiro type amine antioxidant expressed in Formula (8-a), and the phenol antioxidant expressed in either Formula (7-a) or (7-b).

In the combination of stabilizing agent IV, meanwhile, the phenol antioxidant expressed in Formula (7-e) or the phenol antioxidant expressed in Formula (7-d) may be further combined.

These stabilizing agents are intended to endow with resistance to oxidation deterioration against ozone, nitrogen oxides and light. At this time, since the amine antioxidant (3) is of oligomer type and has a relatively high molecular weight, and therefore bleeding (oozing) on the surface of the photosensitive material is suppressed, while the other compounds such as phenol antioxidants (7-a), (7-b), spiro type amine antioxidant (8-a), and benzotriazole ultraviolet absorber (9) are low in molecular weight, and are characterized by smooth bleeding on the surface. Therefore, by combining these antioxidants, the antioxidants such as the phenol antioxidants (7-a), (7-b) and the ultraviolet absorber are much dispersed on the surface of the photosensitive layer, while the amine antioxidant (3) is much dispersed inside. Therefore if the surface of the photosensitive layer is worn out and peeled off by long use, the antioxidation effect is not spoiled. At the same time, since the amine antioxidant (3) is an oligomer having an ester bond, it is excellent in adhesion for forming the photosensitive layer.

Another electrophotosensitive material of the invention is characterized by disposing, on a conductive substrate, a photosensitive layer containing a bis-azo pigment expressed in Formula (1) as charge generating material, a diamine compound expressed in Formula (2) as charge transferring material, polycarbonate as binding resin, and polyester possessing repetitive units expressed in Formula (50):

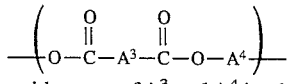

(50)

(where either one of $A^3$ and $A^4$ is a bivalent group containing at least an aromatic ring in the main chain, and the other is a bivalent group not containing aromatic ring in the main chain).

By combining the above specific charge generating material, charge transferring material and binding resin, it is possible to form a photosensitive layer that is stable against oxidation and deterioration by ozone, nitrogen oxides and light, excellent in adhesion to the base such as conductive substrate, and is tough, so that the sensitivity and repeatability (durability) may be outstandingly improved as compared with the conventional electrophotosensitive material. The action by the combination of the charge generating material, charge transferring material and binding resin in the invention is not fully clarified, but the suppressing action on the oxidation and deterioration induced by ozone, nitrogen oxides or the like may be estimated as follows.

The diamine compound (2) used as the charge transferring material is advanced in the non-localization of electrons, and the coordination of the bis-azo pigment (1) into the azo group is impeded by the stereo hindrance by enclosure of nitrogen atoms with phenyl groups, and hence the electron density of the azo group is not increased, so that it is estimated to be less vulnerable to attacks of the acid (acceptor) group of the polyester (50), ozone or the like. Besides, as described above, it is estimated in suppressing action on the oxidation and deterioration induced by ozone, nitrogen oxide or the like to be able to lower the amount of the polyester (50) as compared with the conventional material.

In addition, the bis-azo pigment (1) possesses a high charge generating efficiency and a high sensitivity, and the diamine compound (2) is closely related with the bis-azo pigment (1) in ionization potential, and also being excellent in light fastness and durability and the mobility less dependent on the electric field intensity. These characteristics are not decreased, and an optimum combination is realized, so that the high performance of the electrophotosensitive material may be expressed.

Besides, the polyester (50) is flexible in the main chain as compared with the conventional material, and the ester bond portion contributing to the adhesion acts sufficiently on the base, so that the adhesion of the photosensitive layer may be enhanced by adding at a small amount. Hence, without lowering the sensitivity of the photosensitive material or promoting the photo-oxidation deterioration of the azo group of the bis-azo pigment (1), the adhesion of the photosensitive layer made of polycarbonate having a tough property may be enhanced.

Another modification of the electrophotosensitive material of the invention is characterized by disposing, on a conductive substrate, a photosensitive layer containing the bis-azo pigment expressed in Formula (1) and a perylene pigment expressed in Formula (51):

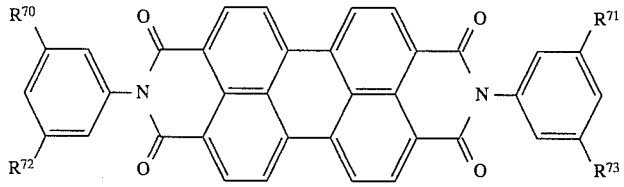

(51)

(where $R^{70}$, $R^{71}$, $R^{72}$ and $R^{73}$ are the same or different, hydrogen atoms, alkyl groups, alkoxyl groups or aryl groups), as charge generating materials.

By using the perylene pigment expressed in Formula (51) in the mixture of the bis-azo pigment expressed in Formula (1), a gelation (coagulation) phenomenon which is generated during preservation of the coating liquid for the photosensitive layer which is in a single dispersion state is effectively prevented, and therefore the stability of the coating liquid is improved.

It is assumed that the gelation phenomenon mentioned above is generated by, for example, associating the bis-azo pigments to each other by hydrogen bonds. On the contrary, when mixing the bis-azo pigment (1) with the perylene pigment (51), the association mentioned above is prevented in view of the molecular structures, thereby improving the stability of coating liquid. Also, the combination of the bis-azo pigment (1) and the perylene pigment (51) results in remarkably lowering the residual potential and remarkable improvements of the repeatability, and therefore an electrophotosensitive material excellent in sensitive property and durability is obtained.

Besides, instead of the perylene pigment or together with perylene pigment, at least one type selected from the group consisting of anthanthrone pigment, X-type metal-free phthalocyanine pigment, imidazole perylene pigment, and perylene bis-azo pigment may be used.

When using such specific pigment as perylene pigment as the charge generating material together with the bis-azo pigment (1), the type of the charge transferring material is not limited, and any desired charge transferring material may be used.

DETAILED DESCRIPTION OF THE INVENTION

The alkyl group used in the invention includes, for example, methyl group, ethyl group, propyl group, isopropyl group, butyl group, t-butyl group, pentyl group, hexyl group, and other alkyl group having 1 to 6 carbon atoms. Examples of aryl group include, among others, phenyl group, o-terphenyl group, naphthyl group, anthryl group, and phenanthryl group. Examples of heterocyclic groups include thienyl group, pyrrolyl group, pyrrolinidyl group, oxazolyl group, iso-oxazolyl group, thiazolyl group, isothiazolyl group, imidazolyl group, 2H-imidazolyl group, pyrazolyl group, triazolyl group, tetrazolyl group, pyranyl group, pyridyl group, piperidyl group, piperidino group, 3 -morphorinyl group, morphorino group, and thiazolyl group. Also, a heterocyclic group condensed with an aromatic ring may be used.

The substituents that may substitute for the above groups include, for example, halogen atom, amino group, hydroxyl group, carboxyl group that may be esterified, cyano group, alkyl group with 1 to 6 carbon atoms, alkoxy group with 1 to 6 carbon atoms, and alkenyl group with 2 to 6 carbon atoms that may possess an aryl group.

The coupler residues expressed in $A^1$ and $A^2$ may include, for example, the groups expressed in Formulae (a) to (g).

(a)

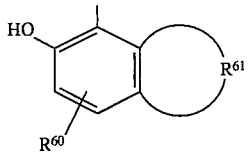

-continued (b)

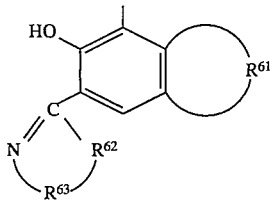

(c)

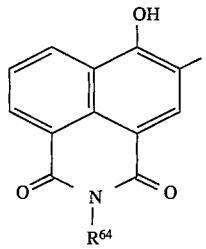

(d)

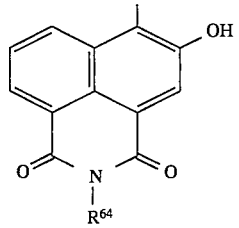

(e)

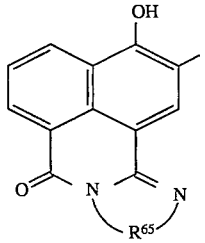

(f)

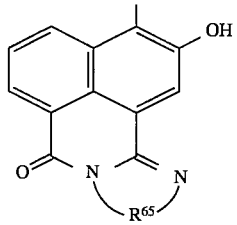

(g)

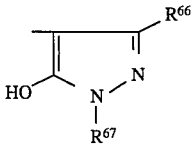

In these formulae, $R^{60}$ denotes carbamoyl group, sulfamoyl group, allophanoyl group, oxamoyl group, anthraniloyl group, carbazoyl group, glycyl group, hidantoyl group, phthalamoyl group, and succinamoyl group. These groups may possess halogen atom, phenyl group that may possess substituent, naphthyl group that may possess substituent,and other substituents such as nitro group, cyano group, alkyl group, alkenyl group, carbonyl group, and carboxyl group.

$R^{61}$ represents an atomic group necessary for forming an aromatic ring, polycyclic hydrocarbon or heterocyclic ring by condensing with a benzene ring possessing $R^{60}$ and hydroxyl group, and these rings may possess the same substituents as mentioned above.

$R^{62}$ denotes an oxygen atom, a sulfur atom, or an imino group.

$R^{63}$ denotes a divalent cyclic hydrocarbon group or a divalent aromatic hydrocarbon group, and these groups may possess the same substituents as mentioned above.

$R^{64}$ denotes an alkyl group, an aralkyl group, an aryl group or a heterocyclic group, and these groups may possess the same substituents as mentioned above.

$R^{65}$ denotes a divalent cyclic hydrocarbon group, a divalent aromatic hydrocarbon group or an atomic group necessary for forming a heterocyclic ring together with the portion expressed in formula (h):

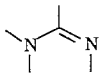

(h)

in the above formula (e), and the formed ring may possess the same substituents as mentioned above.

$R^{66}$ represents hydrogen atom, alkyl group, amino group, carbamoyl group, sulfamoyl group, allophanoyl group, carboxyl group, ester of carboxyl group, aryl group, or cyano group, and the groups except for the hydrogen atom may possess the same substituents as mentioned above.

$R^{67}$ denotes an alkyl group or an aryl group, and these groups may possess the same substituents as mentioned above.

In $R^{61}$, meanwhile, as the atomic group necessary for forming an aromatic ring by condensing with the benzene ring possessing $R^{60}$ and hydroxyl group, for example, methylene group, ethylene group, propylene group, butylene group, and other alkylene groups may be listed.

Examples of the aromatic ring formed by condensation of $R^{61}$ with the benzene ring possessing $R^{60}$ and hydroxyl group include naphthalene ring, anthracene ring, phenanthrene ring, pyrene ring, chrysene ring, and naphthasene ring.

In $R^{61}$, examples of the atomic group necessary for forming the polycyclic hydrocarbon by condensing with the benzene ring possessing $R^{60}$ and hydroxyl group include methylene group, ethylene group, propylene group, butylene group,and other alkylene group with 1 to 4 carbon atoms.

In $R^{61}$, the polycyclic hydrocarbon formed by condensing with the benzene ring possessing $R^{60}$ and hydroxyl group may be, for example, carbazole ring, benzocarbazole ring and dibenzofurane ring.

In $R^{61}$, the atomic group necessary for forming the heterocyclic ring by condensing with the benzene ring possessing $R^{60}$ and hydroxyl group may be, for example, benzofuranyl group, benzothiophenyl group, indolyl group, 1H-indolyl group, benzoxazolyl group, benzothiazolyl group, 1H-indadolyl group, benzoimidazolyl group, chromenyl group, chromanyl group, isochromanyl group, quinolinyl group, isoquinolinyl group, cinnolinyl group, phthalazinyl group, quinazolinyl group, quinoxalinyl group, dibenzofuranyl group, carbazolyl group, xanthenyl group, acridinyl group, phenantridinyl group, phenadinyl group, phenoxadinyl group, and thiantrenyl group.

Examples of the aromatic heterocyclic group formed by condensation of $R^{61}$ with the benzene ring possessing $R^{60}$ and hydroxyl group include thienyl group, furyl group, pyrrolyl group, oxazolyl group, iso-oxazolyl group, thiazolyl group, isothiazolyl group, imidazolyl group, pyrazolyl group, trazolyl group, tetrazolyl group, pyridyl group, and thiazolyl group. Moreover, heterocyclic groups condensed with other aromatic rings (for example, benzofuranyl group, benzoimidazolyl group, benzoxazolyl group, benzothiazolyl group, and quinolinyl group) may be also used.

In $R^{63}$ and $R^{65}$, as examples of the divalent cyclic hydrocarbon gorup, ethylene group, propylene group, and butylene group may be listed, and examples of divalent aromatic hydrocarbon group include phenylene group, naphthylene group, and phenantrilene group.

In $R^{64}$, as the heterocyclic group, for example, pyridyl group, pyradyl group, thienyl group, pyranyl group, indolyl group and others may be used.

In $R^{65}$, the atomic group necessary for forming the heterocyclic ring together with the portion expressed in Formula (h) is, for example, phenylene group, naphthylene group, phenantrilene group, ethylene group, propylene group, and butylene group.

Examples of the aromatic heterocyclic ring formed by $R^{65}$ and the portion expressed in Formula (h) include benzimidazole, benzo[f]benzimdazole, dibenzo [e,g]benzimidazole, and benzopyrimidine. These rings may possess the same substituents as mentioned above.

In $R^{66}$, as the ester of carboxyl group, methylester, ethylester, propylester, and burylester are known among others.

Practical examples of the coupler residues $A^1$, $A^2$ expressed in Formulae (a) to (g) include the following groups.

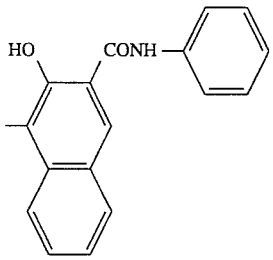

(11)

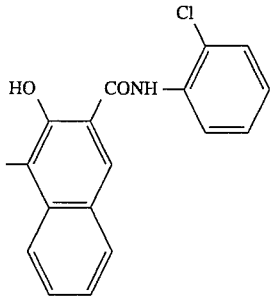

(12)

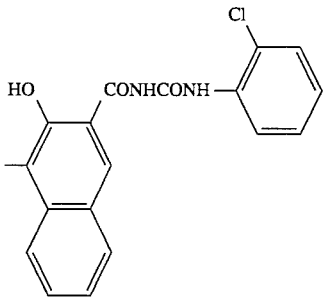

(13)

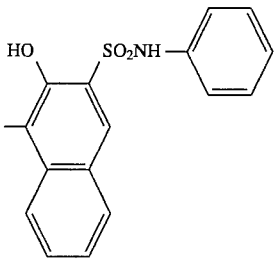

(14)

-continued
(15)
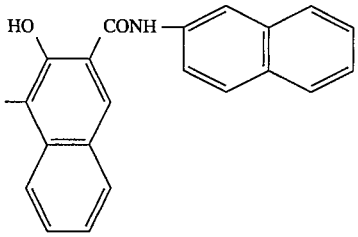
(16)
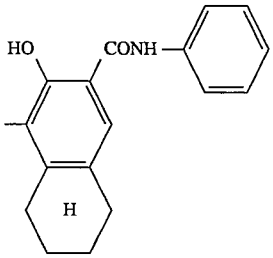
(17)
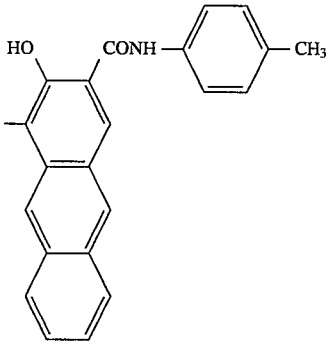
(18)
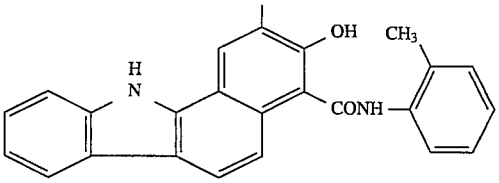
(19)
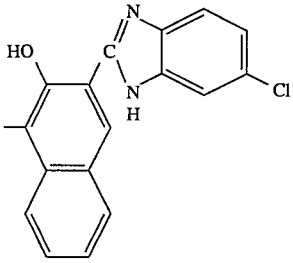
(20)
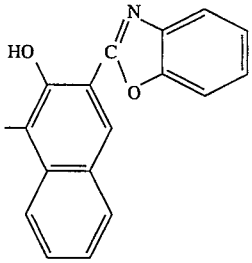
-continued
(21)
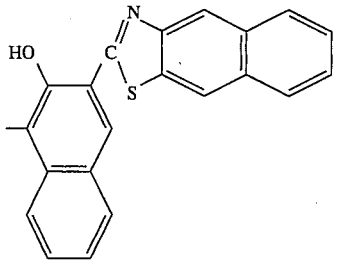
(22)
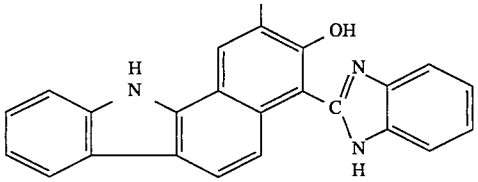
(23)
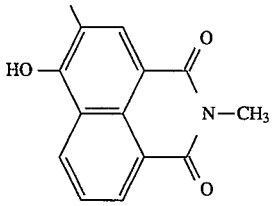
(24)
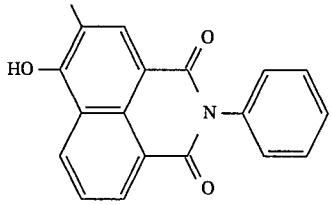
(25)
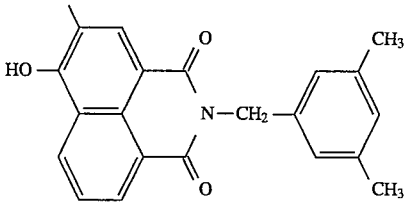
(26)
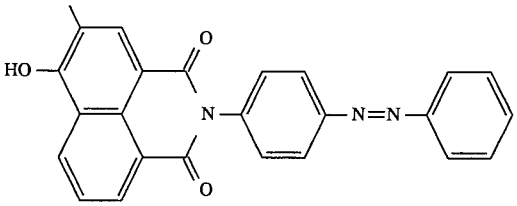
(27)
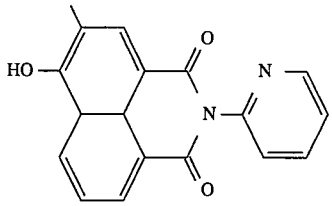

-continued
(28)
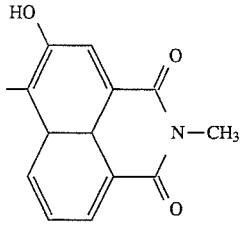
(29)
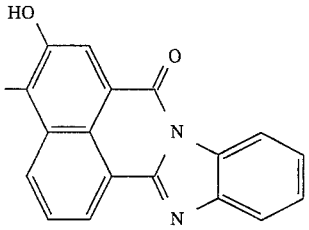
(30)
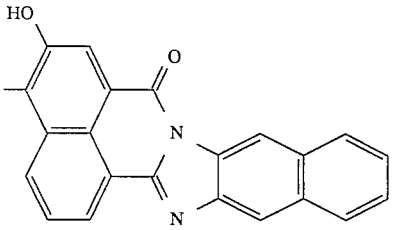
(31)
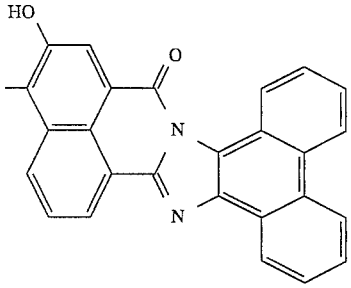
(32)
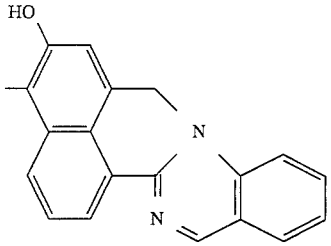
-continued
(33)
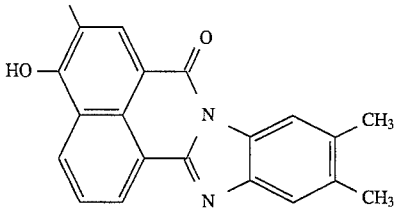
(34)
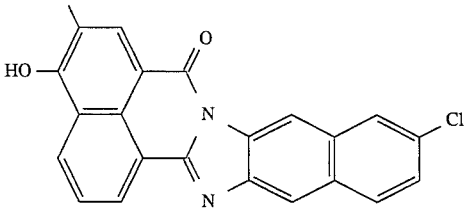
(35)
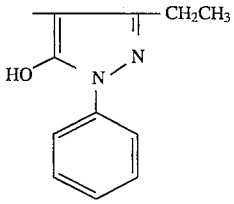
(36)
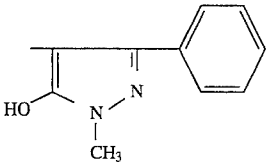
(37)
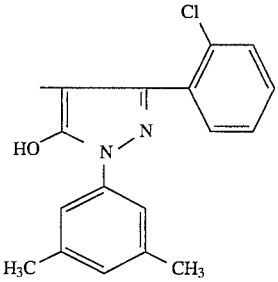
Practical examples of the bis-azo compound (1) include the compounds expressed in Formulae (B1) to (B10) below.
(B1)
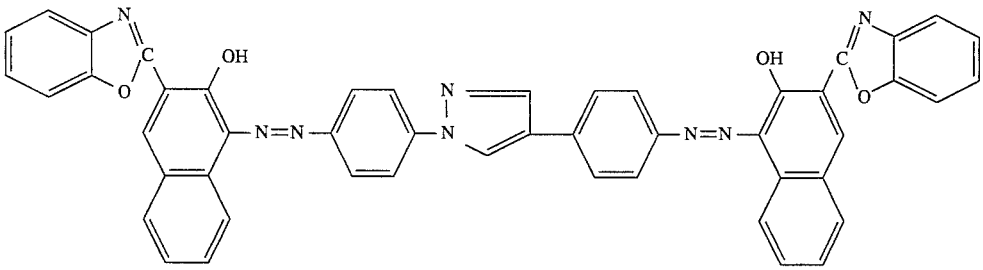

-continued
(B2)
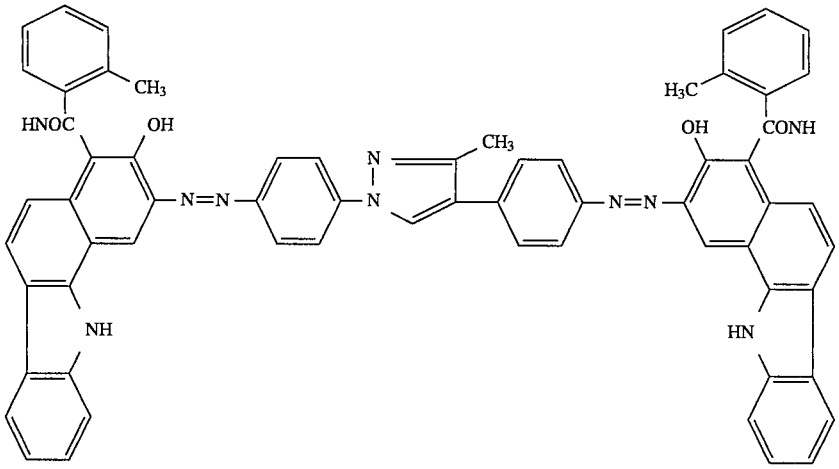
(B3)
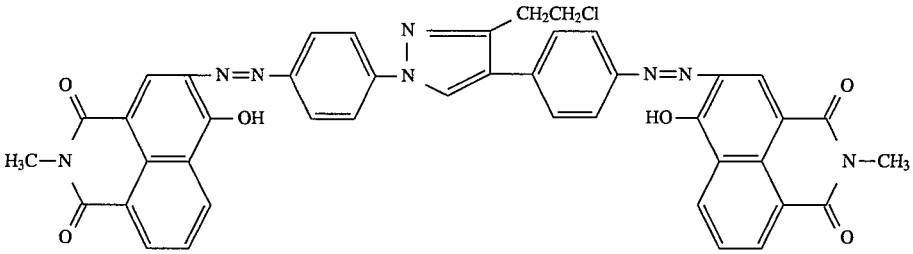
(B4)
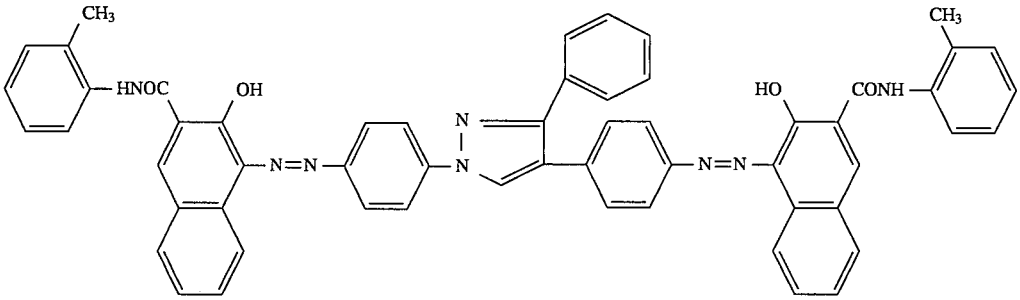
(B5)
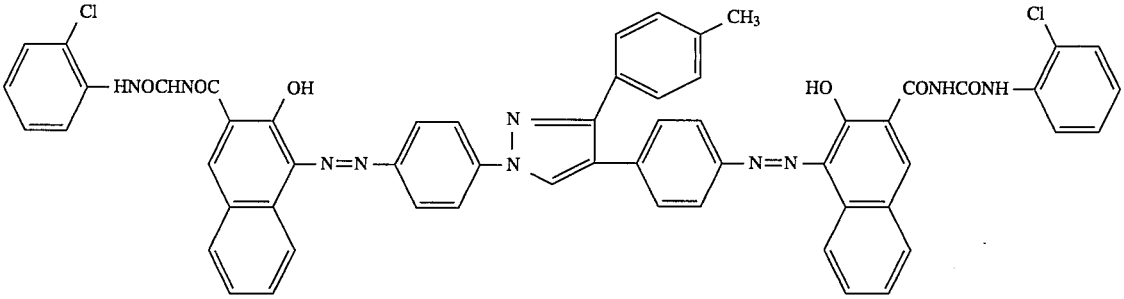
(B6)
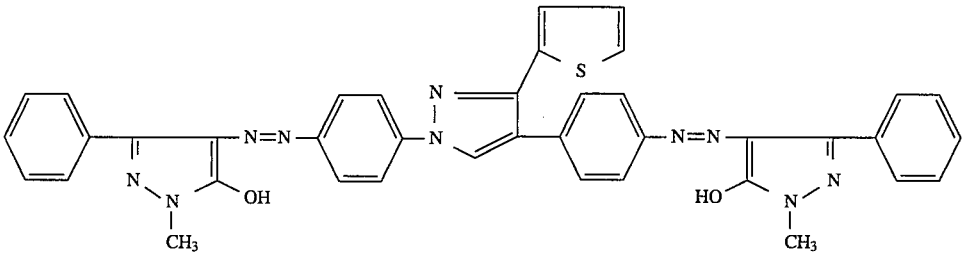

-continued (B7)

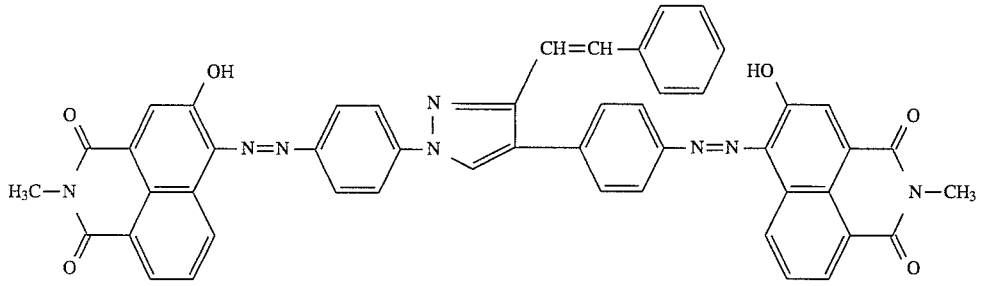

(B8)

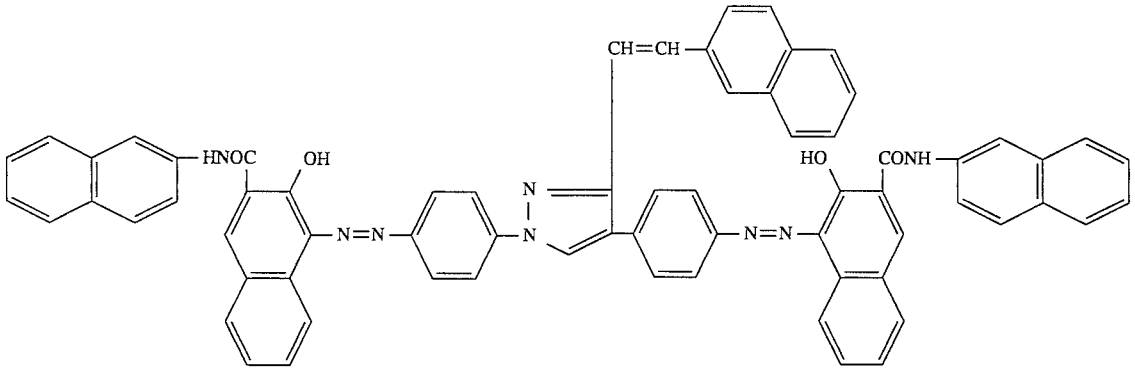

(B9)

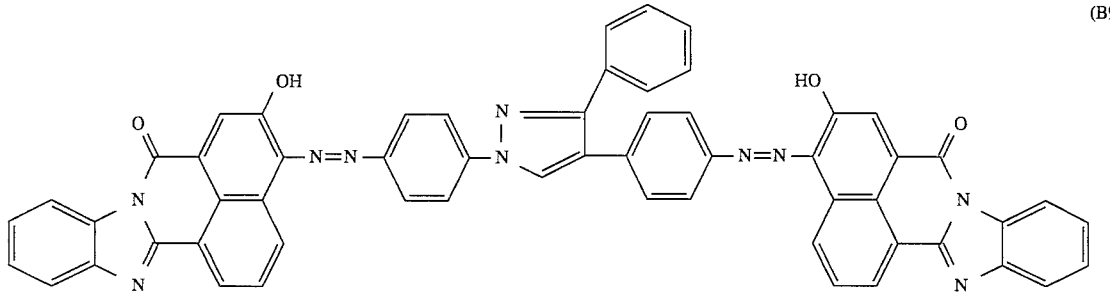

(B10)

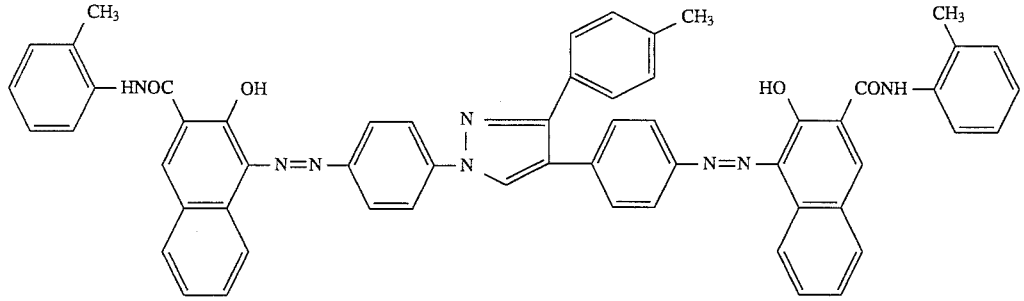

In the electrophotosensitive material of the present invention providing, on the conductive substrate, the photosensitive layer containing the bis-azo pigment of Formula (1) and the diamine compound of Formula (2), it is preferred that the bis-azo pigment (1) is used in the form of fine particles having a particle diameter of 0.5 μm or less.

Specifically, the bis-azo pigment (1) is added to a coating liquid for the photosensitive layer, after finely pulverizing to the particle diameter of 0.5 μm or less. The bis-azo pigment acts as a n-type pigment to have a electron-transfer capacity. Therefore, by containing the finely pulverized bis-azo pigment, the distance of the pigments from each other is shortened, thereby to increase the photoconductivity. As a result, the initial sensitivity, repeatability and image quality are improved, and image defects such as fogs are decreased.

Besides, it is preferred that the bis-azo pigment of Formula (1) used in the combination with the diamine compound of Formula (2) being the charage transferring material is preferably used in the mixture of 2 types thereof or more. As a result, a gelation (coagulation) phenomenon which is generated during preservation of the coating liquid for the photosensitive layer which is in a single dispersion state is effectively prevented, and therefore the stability of the coating liquid is improved.

It is assumed that the gelation phenomenon mentioned above is generated by, for example, associating the bis-azo pigments to each other with hydrogen bonds. On the contrary, when mixing 2 types or more of the bis-azo pigment which are similar structures to each other, the association mentioned above is prevented in view of the molecular structures, thereby improving the stability of coating liquid. Also, the combination of 2 types or more of the bis-azo pigments similar to each other in electron state results in improvements of the charge stability and the sensitive stability in the time of printing, without lowering the initial sensitivity.

In the diamine compound expressed in Formula (2), as the alkyl group and the aryl group corresponding to $R^2$ through $R^7$ in the formula, for example, the same group as shown in Formula (1) may be used.

Examples of the halogen atom include chlorine, iodine, bromine and fluorine.

Examples of the alkoxyl group include methoxy group, ethoxy group, isopropoxy group, butoxy group, t-butoxy group, and hexyloxy group.

Examples of the alkylamino group include methylamino group, dimethylamino group, ethylamino group, diethylamino group, propylamino group, isopropylamino group, butylamino group, isobutylamino group, t-butylamino group, pentylamino group, and hexylamino group.

Practical compounds of the diamine compound expressed in Formula (2) include, for example, those shown in Nos. A1 to A15 in Table 1. In the table, for example, "3-$CH_3$" means that the methyl group is bonded at the 3-position of the phenyl group, and "3,5-$CH_3$" means that the methyl group is bonded at the 3- and 5-positions of the phenyl group.

TABLE 1

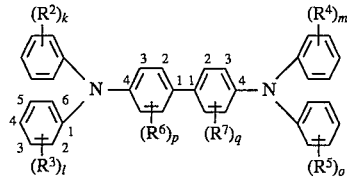

| No. | $R^2$ | $R^3$ | $R^4$ | $R^5$ | $R^6$ | $R^7$ |
|---|---|---|---|---|---|---|
| A1 | 3-$CH_3$ | H | H | 3-$CH_3$ | H | H |
| A2 | 3,5-$CH_3$ | H | H | 3,5-$CH_3$ | H | H |
| A3 | 2,4-$CH_3$ | H | H | 2,4-$CH_3$ | H | H |
| A4 | 4-$CH_3$ | 4-$CH_3$ | 4-$CH_3$ | 4-$CH_3$ | H | H |
| A5 | 4-$CH_3$ | 4-$CH_3$ | 4-$CH_3$ | 4-$CH_3$ | 2-$CH_3$ | 2-$CH_3$ |
| A6 | H | H | H | H | 3-$CH_3$ | 3-$CH_3$ |
| A7 | 3-$OCH_3$ | H | H | 3-$OCH_3$ | H | H |
| A8 | 2-Cl | H | H | 2-Cl | H | H |
| A9 | 4-$CH_3$ | 4-$CH_3$ | 4-$CH_3$ | 4-$CH_3$ | 3-$CH_3$ | 3-$CH_3$ |
| A10 | 2-CN | H | H | 2-CN | H | H |
| A11 | H | H | H | H | 3-$C_2H_5$ | 3-$C_2H_5$ |
| A12 | 3-$NO_2$ | H | H | 3-$NO_2$ | H | H |
| A13 | 4-$CH_3$ | 4-$CH_3$ | 4-$CH_3$ | 4-$CH_3$ | 3-$C_2H_5$ | 3-$C_2H_5$ |
| A14 | H | 4- 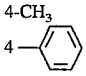 | H | 4- 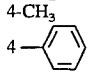 | H | H |
| A15 | H | 4-$NC_2H_5$ | H | 4-$NC_2H_5$ | H | H |

The diamine compound (2) can be synthesized in various methods, and, for example, it may be manufactured by simultaneously or sequentially reacting the compound expressed in Formula (20) with the compounds expressed in Formulae (41) to (44).

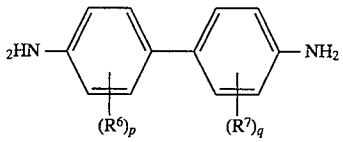

(40)

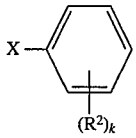

(41)

-continued

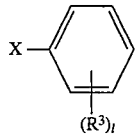

(42)

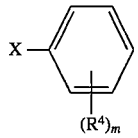

(43)

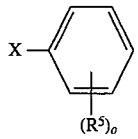

(44)

where $R^2$, $R^3$, $R^4$, $R^5$, $R^6$, $R^7$, k, l, m, n, o, p and q are the same as defined above, and X denotes a halogen atom.

The reaction between the compound expressed in Formula (40) and the compounds expressed in Formulae (41) through (44) is performed usually in an organic solvent. As the organic solvent, any solvent may be used herein so far as not to affect the reaction adversely, and examples of such organic solvent include nitrobenzene, dichlorobenzene, quinoline, N,N-dimethylformamide, N-methylpyrrolidone, and dimethylsulfoxide. The reaction proceeds usually at a temperature of 150° to 250° C. in the presence of copper powder, copper oxide, copper halide, or other catalysts, or sodium hydroxide, potassium hydroxide, sodium carbonate, potassium carbonate, sodium hydrogen carbonate, potassium hydrogen carbonate, or other basic substance.

The compound expressed in Formula (2) possessing a symmetrical structure can be prepared by controlling the substitution positions of the substituents $R^2$, $R^3$, $R^4$, and $R^5$. For example, the compound expressed in Formula (46) is obtained by the reaction of the compound expressed in Formula (45) with the compounds expressed in Formulae (41) and (43), and by hydrolyzing the compound expressed in Formula (46) to conduct deacylation, the compound expressed in Formula (47) is obtained, and it is reacted with the compounds expressed in Formulae (42) and (44), thereby manufacturing the object compound.

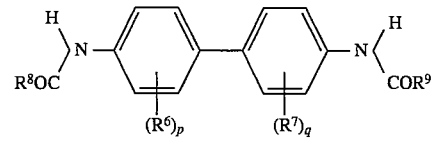

(45)

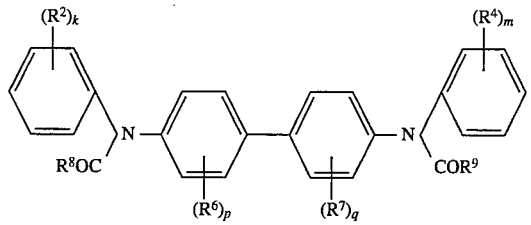

(46)

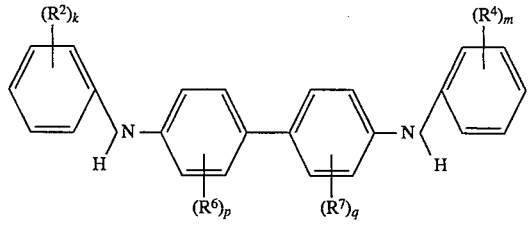

(47)

where $R^8$ and $R^9$ denote alkyl groups, and $R^2$, $R^3$, $R^4$, $R^5$, $R^6$, $R^7$, k, l, m, n, o, p and q are the same as defined above The reaction between the compound expressed in Formula (45) and the compounds expressed in Formulae (41), (43) is performed the same as the reaction between the compound expressed in Formula (40) and the compounds expressed in Formulae (41), (42), (43) and (44). The deacylation hydrolysis of the compound expressed in Formula (46) is carried out in the conventional manner in the presence of a basic catalyst. The reaction between the compound expressed in Formula (47) and the compounds expressed in Formulae (42) and (44)is performed the same as the reaction between the compound expressed in Formula (40) and the compounds expressed in Formulae (41), (42), (43), (44).

After termination of the reaction, the reaction mixture is concentrated, and may be easily separated and refined by the conventional means, such as recrystallization, solvent extraction and column chromatography.

Practical compounds of the hydrazone compounds expressed in Formula (3) include N-propyl-3-carbazolyl aldehyde N,N-diphenyl hydrazone, N-butyl-3-carbazolyl aldehyde N,N-diphenyl hydrazone, N-isobutyl-3-carbazolyl aldehyde N,N-diphenyl hydrazone, N-tert-butyl-3-carbazolyl aldehyde N,N-diphenyl hydrazone, N-pentyl-3-carbazolyl aldehyde N,N-diphenyl hydrazone, and N-hexyl-3-carbazolyl aldehyde N,N-diphenyl hydrazone, among others, and more specifically those shown in Formulae (C1) to (C12) may be used.

(C1)

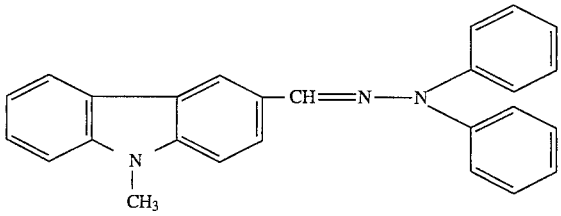

(C2)

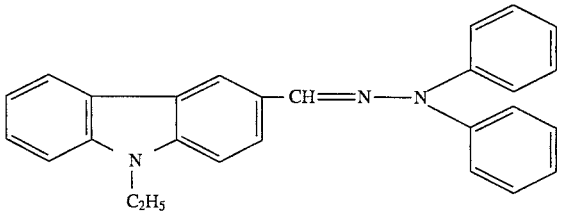

(C3)

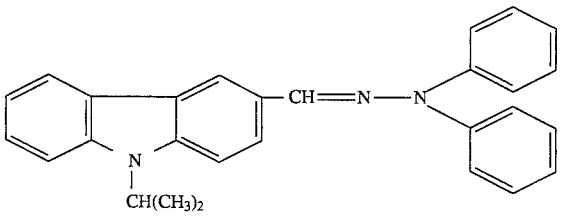

(C4)

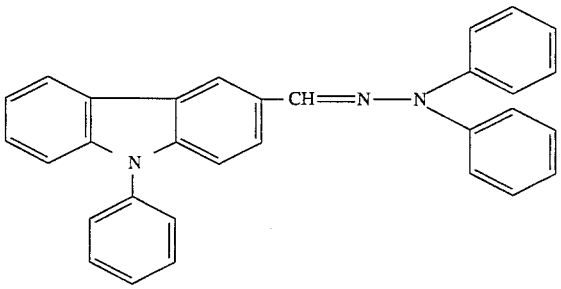

(C5)

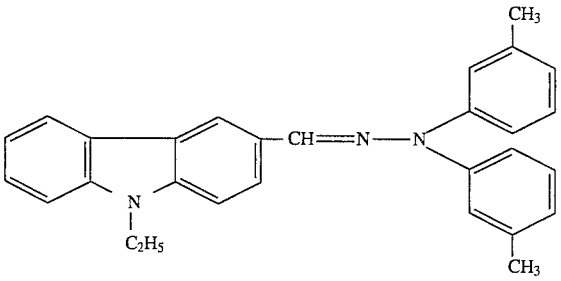

-continued
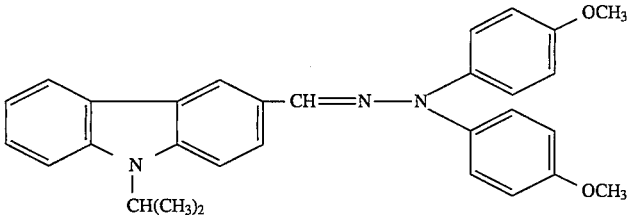
(C6)
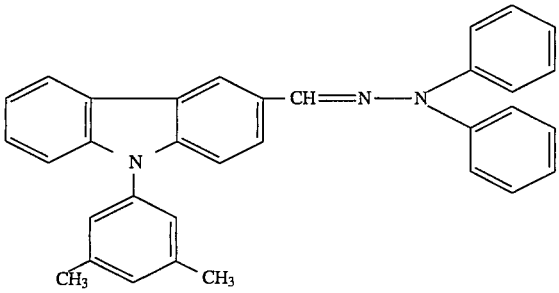
(C7)
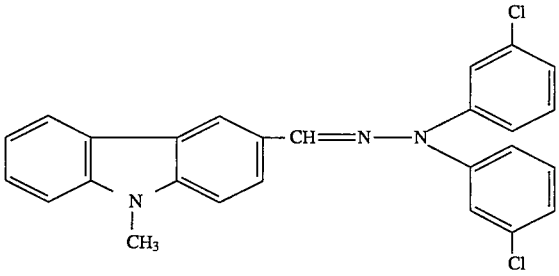
(C8)
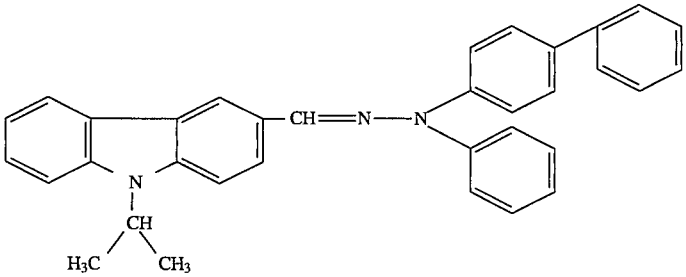
(C9)
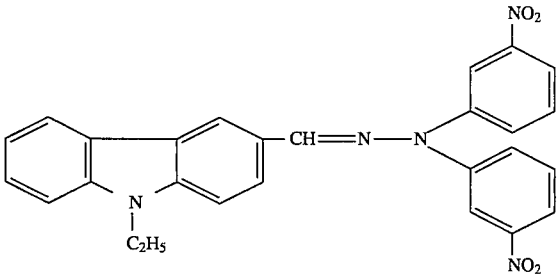
(C10)
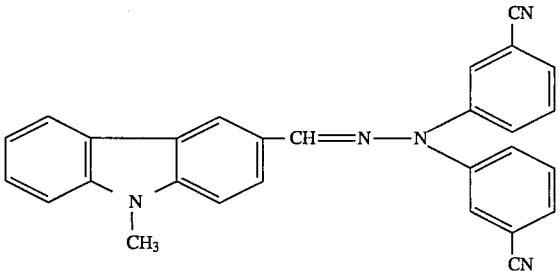
(C11)

-continued

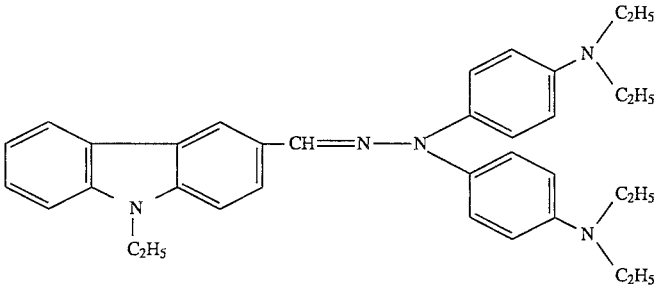

(C12)

This hydrazone compound (3) may be added approximately at a rate of 10 to 200 parts by weight to 100 parts by weight of the diamine compound (2).

Practical compounds of the fluorene compound expressed in Formula (2) include, for example, the compounds expressed in Nos. (D1) to (D11) in Table 2 below.

TABLE 2

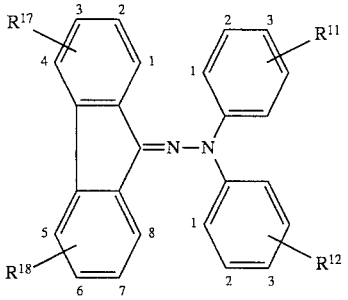

| No. | $R^{11}$ | $R^{12}$ | $R^{17}$ | $R^{18}$ |
|---|---|---|---|---|
| D1 | H | H | H | H |
| D2 | 3-$CH_3$ | 3-$CH_3$ | H | H |
| D3 | 3-$C_2H_5$ | 3-$C_2H_5$ | H | H |
| D4 | 3-$CH_3$ | 3-$C_2H_5$ | H | H |
| D5 | 3-$CH(CH_3)_2$ | 3-$CH(CH_3)_2$ | H | H |
| D6 | 2-$CH_3$ | 2-$CH_3$ | H | H |
| D7 | 3-$OCH_3$ | 3-$OCH_3$ | H | H |
| D8 | 3-Cl | 3-Cl | H | H |
| D9 | H | H | 2-Cl | 7-Cl |
| D10 | H | H | 3-$CH_3$ | 6-$CH_3$ |
| D11 | 4-$N(CH_3)_2$ | 4-$N(CH_3)_2$ | H | H |

This fluorene compound (4) may be added at a rate of about 5 to 100 parts by weight to 100 parts by weight of the hydrazone compound (3).

Practical compounds of diphenoquinone derivative expressed in Formula (5) may include, for example, those expressed in Formulae (E1) to (E7) below.

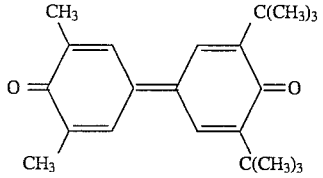

(E1)

-continued

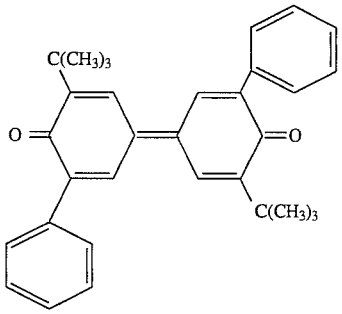

(E2)

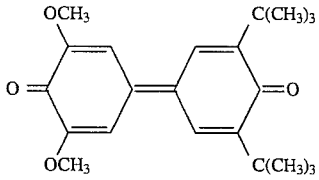

(E3)

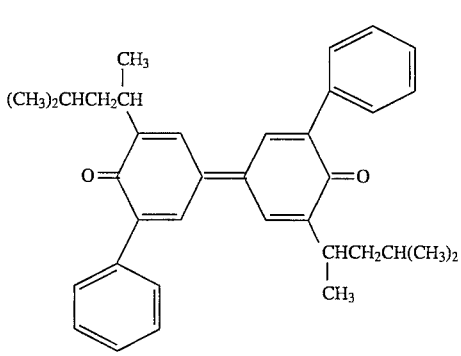

(E4)

-continued (E5)

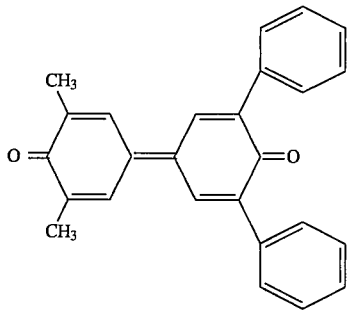

(E6)

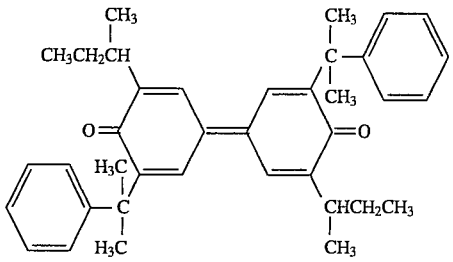

(E7)

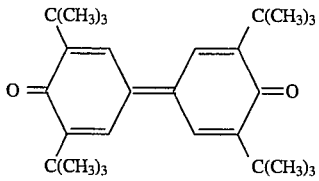

The diphenoquinone derivative (5) is, when combined with the hydrazone compound (3) and fluorene compound (4) added at a rate of 2 to 50 parts by weight to 100 parts by weight of the fluorene compound (4), and if exceeding this range, traps are formed by interaction with the fluorene compound (4) having the ionization potential of 6 eV or more, which may lead to lowering of sensitivity. On the other hand, when the diphenoquinone derivative (5) is used alone, it must be added more than in the case of combined use, and usually it is added at a rate of 10 parts by weight or more, preferably 15 to 100 parts by weight to 100 parts of the diamine compound (2).

The reducing potential of the diphenoquinone derivative contained in the photosensitive layer is desired to be in a range of −0.5 to −1.2 V. As a result, the stability to light is improved, and the lowering tendency of surface potential in repetitive exposure may be notably suppressed, and it may be preferably applied particularly to the single layer-type organic photosensitive material.

The reducing potential refers to the value determined in the following measuring method.

Reducing potential measuring method

As the measuring solvent, 0.1 mole of electrolyte (tert-butyl ammonium perchlorate), 0.1 mole of measuring objective material (each acceptor), and 1 liter of solvent (dichloromethane) were blended, and measured by the cyclic voltammetry of three-electrode type [glassy carbon electrode as working electrode, platinum electrode as counter electrode, and silver-silver nitrate electrode (0.1 mole/liter $AgNO_3$-acetonitrile solution) as reference electrode].

The diphenoquinone derivative possessing such reducing potential acts to effectively suppress lowering of the surface potential in exposure repetition only by adding at a small amount in the photosensitive layer, but generally it is preferred to add the diphenoquinone derivative at a rate of 0.1 to 10 parts by weight, more preferably 0.25 to 1 part by weight to 1 part by weight of the charge generating material.

The action of the diphenoquinone derivative possessing a specific reducing potential is as follows.

First, using the bis-azo pigment (1) as the charge generating material, it is combined with the charge transferring material, so that an excellent sensitivity (charge generating capability) is exhibited, while the residual potential is at a low level. When the diphenoquinone derivative is contained in the photosensitive layer containing this bis-azo pigment (1), lowering of surface potential in exposure repetition may be notably suppressed without spoiling the excellent sensitivity of the bis-azo pigment (1).

That is, the photosensitive layer containing the bis-azo pigment (1) is, characteristically, high in sensitivity with the half-life light exposure ($E_{1/2}$) of 1.23 lux-sec., and relatively low in the residual potential at 68 V, but after repeating 1,000 times of exposure, as compared with the surface potential after the first exposure, the surface potential may be lowered by as much as −315 V.

By contrast, when the diphenoquinone derivative is blended in the photosensitive layer, it is possible to suppress the lowering of the surface potential after 1,000 times of exposure to −120 V or less, while maintaining the excellent sensitivity and low residual potential by the bis-azo pigment (1).

It is important that the reducing potential of the diphenoquinone derivative is in a range of −0.5 to −1.2 V, and when the reducing potential is lower than −1.2 V or higher than −0.5 V, it is difficult to suppress the lowering of the surface potential after 1,000 exposures.

Generally, the tendency of lowering of the surface potential of the photosensitive layer by repetitions of exposure is recognized, for example in the positively charged photosensitive layer, to be due to residue of the electrons of the opposite charging polarity in the photosensitive layer, especially by trapping in the pigment, and deterioration of the photosensitive material constituent material by attack of active gas due to activation by repetitive exposure or further by corona discharge.

On the other hand, the specific diphenoquinone derivative used in the invention acts effective as the an electron acceptor to eliminate the trapped electrons in the photosensitive layer and also as a quencher for the photosensitive layer illuminated with light, thereby suppressing the lowering of the surface potential in repetitive exposures.

The diphenoquinone derivative to be used possesses a quinone-type oxygen atom excellent in electron acceptability at both ends of the molecular chain, and is structurally characterized by possessing a double bond in the conjugate relation over the entire molecular chain. As a result, it is easy to move electrons within the structure and easy to exchange electrons, which is regarded to be related with the excellent results above. In addition, the fact that the reducing potential is within a specific range seems to contribute to ease of exchange of electrons.

The diphenoquinone derivative possessing such reducing potential is, specifically, ones that $R^{13}$, $R^{14}$, $R^{15}$ and $R^{16}$ in Formula (5) are the same and different, an alkyl group, alkoxyl group or aryl group, two of the groups out of $R^{13}$, $R^{14}$, $R^{15}$ and $R^{16}$ possess a greater number of carbon atoms than the other two groups, and the reducing potential is within the specified range mentioned above. When the group having the greater number of carbon atoms is an alkyl group having 4 or more carbon atoms, the other group is desired to be an methyl group. When the group with the greater number of carbon atoms is an aryl group, the other group is desired to be an alkyl group with 4 or less carbon atoms.

Such diphenoquinone derivative is excellent in solubility to the solvent as compared with the unreplaced material, and it is easy to blend into the photosensitive layer.

On the photosensitive layer, it is desired to add, as a stabilizer, the amine antioxidant which is a polyester oligomer expressed in Formula (6), and at least one phenol antioxidant selected from those expressed in Formulae (7-a), (7-b), (7-c), (7-d) and (7-e).

In Formulae (7-c), (7-d), and (7-e), as the alkylene group, for example, methylene group, ethylene group, propylene group, tetramethylene group, pentamethylene group, and hexamethylene group may be used.

As the alkylene glycol residue in Formula (7-d), for example in the form of $—Y^5—Y^5—$, triethylene glycol residue, tripropylene glycol residue, tetraethylene glycol residue, and pentaethylene glycol residue may be used, among others.

As the alkylene carbonyl oxyalkyl group of Formula (7-e), for example, methylene carbonyl oxymethyl group, ethylene carbonyl oxypropyl group, butylene carbonyl oxymethyl group, hexamethylene carbonyl oxymethyl group, methylene carbonyl oxypropyl group, and pentamethylene carbonyl oxyhexyl group may be used.

As the alkylene oxycarbonyl alkyl group of Formula (7-e), examples include methylene oxycarbonyl methyl group, ethylene oxycarbonyl propyl group, butylene oxycarbonyl methyl group, hexamethylene oxycarbonyl methyl group, methylene oxycarbonyl propyl group, and pentamethylene oxycarbonyl hexyl group.

These stabilizers are commonly intended to provide with oxidation deterioration resistance to ozone, nitrogen oxide and light. At this time, since the amine antioxidant (6) is of oligomer type and is relatively high in molecular weight, and hence bleeding on the surface of the photosensitive layer is suppressed, while the phenol antioxidants (7-a) to (7-e) are relatively low in molecular weight, and are hence easy to bleed on the surface. Therefore, by combining the both antioxidants, the phenol antioxidants (7-a) to (7-e) are much dispersed on the surface of the photosensitive layer, while the amine antioxidant (6) is much dispersed inside, and therefore if the photosensitive layer surface is worn out after long use, the antioxidation effect is not sacrificed. Moreover, since the amine antioxidant (6) is an oligomer, it is excellent in adhesion for forming the photosensitive layer.

The combination of such oligomer type amine antioxidant (6) and the phenol antioxidants (7-a) to (7-e) is desired to be used in the composition of photosensitive layer relating to the combination of, in particular, bis-azo pigment (1), diamine compound (2), hydrazone compound (3), fluorene compound (4),and diphenoquinone derivative (5).

Practical compounds of the oligomer type amine antioxidant (6) include, for example, the compounds expressed in Formulae (F1) to (F6) below.

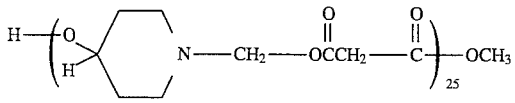
(F1)

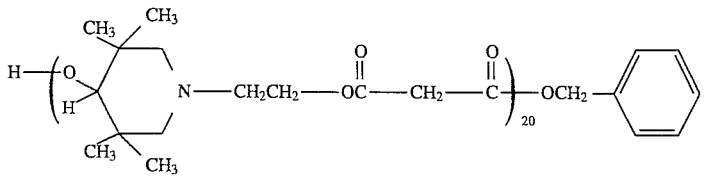
(F2)

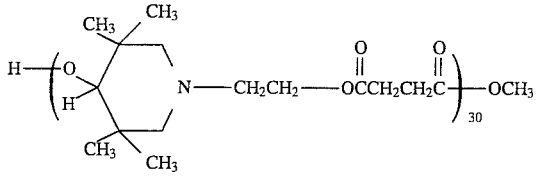
(F3)

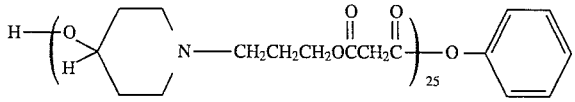
(F4)

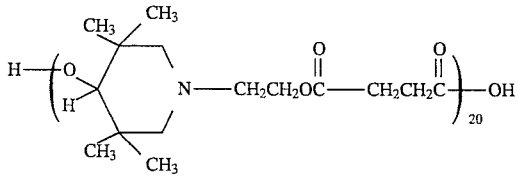
(F5)

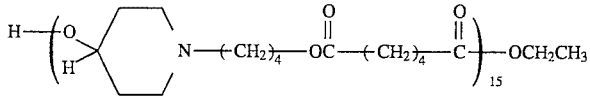
(F6)

The content of the oligomer type amine antioxidant (6) may be usually about 0.5 to 20 parts by weight of 100 parts by weight of the binding resin.

Practical compounds of the phenol antioxidants (7-a), (7-b) include the compounds shown in Formulae (G1) to (G6).

(G1)

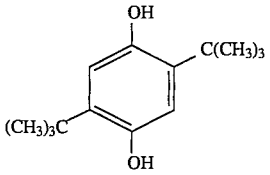

(G2)

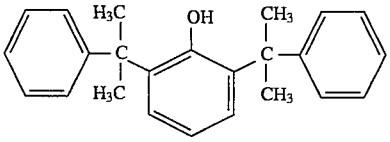

(G3)

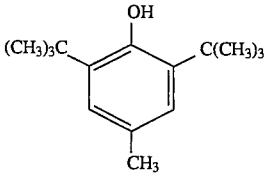

(G4)

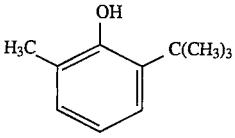

(G5)

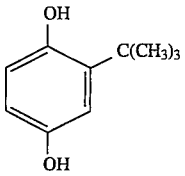

-continued (G6)

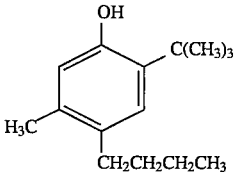

Practical compounds of the other phenol antioxidants (7-c) to (7-e) include the compounds expressed in Formulae (G7) to (G30) below.

TABLE 3

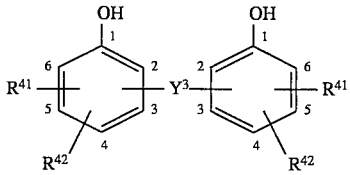

| Compound No. | $Y^3$ | $R^{41}$ | $R^{42}$ |
|---|---|---|---|
| G7 | 2-$CH_2$-2 | 6-t-butyl | 4-t-butyl |
| G8 | 2-$CH_2$-2 | 6-cyclohexyl | 4-methyl |
| G9 | 2-$CH_2$-2 | 6 dimethylbenzyl-phenyl | 6-dimethyl-benzylphenyl |
| G10 | 2-CH($CH_3$)-2 | 6-t-butyl | 4-t-butyl |
| G11 | 2-CH($CH_3$)-2 | 6-cyclohexyl | 6-cyclohexyl |
| G12 | 2-CH($C_3H_7$)-2 | 6-t-butyl | 4-methyl |
| G13 | 2-CH($C_3H_7$)-2 | 6-isopropyl | 4-methyl |
| G14 | 3-$CH_2$-3 | 6-isopropyl | H |
| G15 | 4-$CH_2$-4 | 2-t-butyl | 6-t-butyl |
| G16 | 4-CH($C_3H_7$)-4 | 2-t-butyl | 5-methyl |

TABLE 4

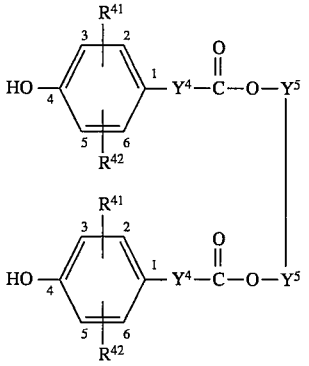

| Compound No. | $Y^4$ | $Y^5$ | $R^{41}$ | $R^{42}$ |
|---|---|---|---|---|
| G 17 | $-CH_2-$ | $-CH_2CH_2-$ | 3-t-butyl | 6-methyl |
| G 18 | $-CH_2-$ | $-CH_2CH_2-$ | 3-cyclohexyl | 5-methyl |
| G 19 | $-CH_2CH_2-$ | $-CH_2-$ | 3-t-butyl | H |
| G 20 | $-CH_2CH_2-$ | $-(CH_2)_3-$ | 3-t-butyl | 5-t-butyl |
| G 21 | $-CH_2CH_2-$ | $-CH_2CH_2-OCH_2-$ | 3-t-butyl | 5-methyl |
| G 22 | $-CH_2CH_2-$ | $-(CH_2CH_2O)_4-CH_2-$ | 3-t-butyl | 5-t-butyl |
| G 23 | $-(CH_2)_4-$ | $-CH_2-$ | 3-isopropyl | 3-isopropyl |
| G 24 | $-(CH_2)_6-$ | $-CH_2-$ | dimethylbenzyl-phenyl | dimethylbenzyl-phenyl |

TABLE 5

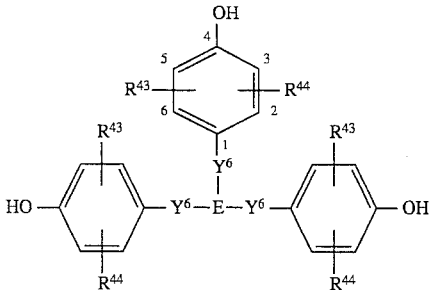

| Compound No. | E | $Y^6$ | $R^{43}$ | $R^{44}$ |
|---|---|---|---|---|
| G 25 | I | $-(CH_2)_2-COO-(CH_2)_2-$* | 3-t-butyl | 5-t-butyl |
| G 26 | I | $-CH_2-$ | 3-t-butyl | 5-t-butyl |
| G 27 | II | $-CH_2-$ | 3-t-butyl | 5-t-butyl |
| G 28 | II | $-(CH_2)_2-COO-(CH_2)_4-$* | 3-t-butyl | 6-$CH_3$ |
| G 29 | III | $-CH_2-$ | 3-t-butyl | 5-t-butyl |
| G 30 | III | $-CH_2-$ | 3-H | 3-H |

Note 1. In $Y^6$ of G 25, G 28, the group at the asterisked position is bonded with E.
Note 2.

I:

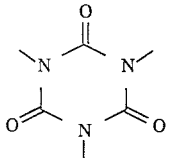

II:

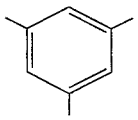

III: $CH_3$

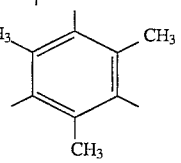

The amounts of the phenol antioxidants (7-a) to (7 -e) to be added may be usually about 1 to 30 parts by weight of 100 parts by weight of the binding resin.

As other stabilizers, an amine antioxidant expressed in Formula (6), an amine antioxidant expressed in Formula (8-a) or (8-b), and a benzotriazole ultraviolet absorber expressed in Formula (9) may be added to the photosensitive layer.

Examples of the aralkyl group include benzyl group, benzhydril group, trityl group and phenetyl group, among others.

The action of the oligomer type amine antioxidant (6) and the amine antioxidant (8-a) or (8-b) is same as above. Specifically, the amine antioxidant (8-a) or (8-b) of relatively low molecular weight bleeds and exists much on the surface of the photosensitive layer, while the oligomer type amine antioxidant (6) of relatively high molecular weight is widely present inside of the photosensitive layer, and exhibits the antioxidation effect for a longer period. On the other hand, by the benzotriazole ultraviolet absorber expressed in Formula (9), the photo-oxidation deterioration of the bis-azo pigment (1) is prevented.

This combination is effective particularly for the combination of the bis-azo pigment (1), diamine compound (2) and diphenoquinone derivative (5) mentioned above. That is, in the photosensitive layer composition comprising the combination of the bis-azo pigment (1), diamine compound (2), hydrazone compound (3), fluorene compound (4), and diphenoquinone derivative (5), the fluorene compound (4) absorbs the light of up to 550 nm, and works to prevent photo-oxidation deterioration of the bis-azo pigment (1), and it is not required to add ultraviolet absorbent, but in the photosensitive layer composition without fluorene compound (4) it is necessary to add an ultraviolet absorber. Of course, the additive of this compound may be also added to the above photosensitive layer composition with fluorene compound (4).

The amount of the oligomer type amine antioxidant (6) in this combination is enough at about 0.5 to 20 parts by weight to 100 parts by weight of the binding resin.

As practical compounds of the amine antioxidant (8 -a), for example, the following compounds expressed in Formulae (H1) to (H6) are employed.

(H1)

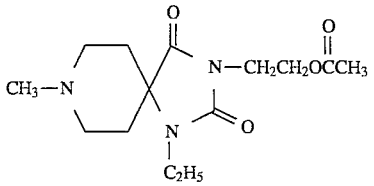

(H2)

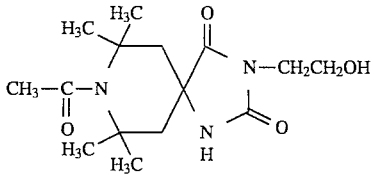

(H3)

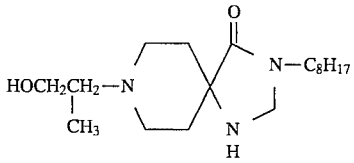

(H4)

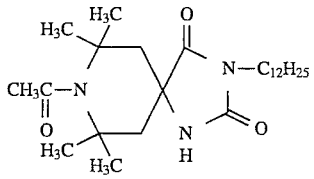

(H5)

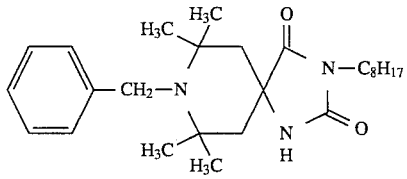

(H6)

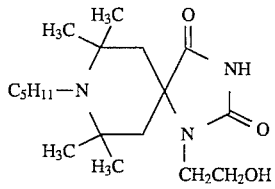

As practical compounds of amine antioxidant (8-b) for example, the following compounds expressed in Formulae (H7) to (H13) are employed.

TABLE 6

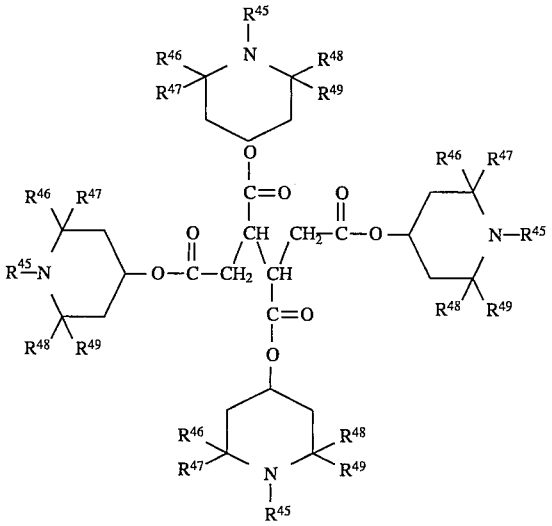

| Compound No. | $R^{45}$ | $R^{46}$~$R^{49}$ |
|---|---|---|
| H 7 | H | H |
| H 8 | H | $-CH_3$ |
| H 9 | $-CH_3-$ | H |
| H 10 | $-CH_3-$ | $-CH_3$ |
| H 11 | $-C_2H_5$ | $-CH_3$ |
| H 12 | $-CH(CH_3)_2$ | H |
| H 13 | $-CH(CH_3)_2$ | $-C_2H_5$ |

The amount of the amine antioxidant (8-a) or (8-b) to be added may be about 0.5 to 20 parts by weight to 100 parts by weight of the binding resin.

Practical compounds of benzotriazole ultraviolet absorber (9) include the following examples expressed in Formulae (I1) to (I7).

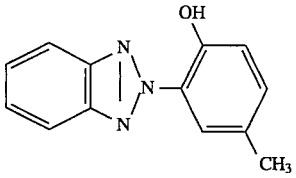

(I1)

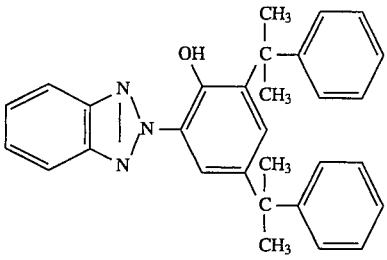

(I2)

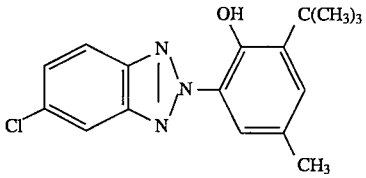

(I3)

-continued

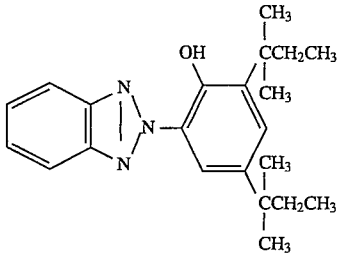

(I4)

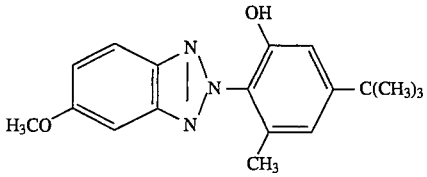

(I5)

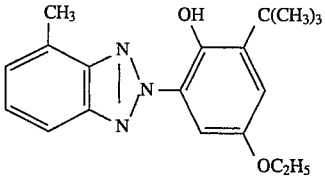

(I6)

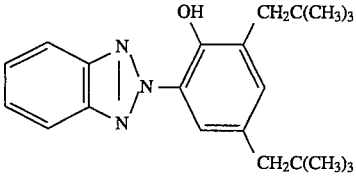

(I7)

The ultraviolet absorber (9) may be added by about 1 to 4 parts by weight, to 100 parts by weight of the binding resin.

Besides, as substitutes for the phenol antioxidants (7-c) to (7-e) and amine antioxidants (8-a), (8-b), the piperidine antioxidant expressed in Formulae (10) may be used. That is the piperidine antioxidant (10) possesses the functions of both amine and phenol, and also has a proper molecular weight, whereby it can be used as a substitute for the phenol antioxidants (7-c) to (7-e) and amine antioxidants (8-a), (8-b).

Practical compounds of the piperidine antioxidant of Formula (10) may include the examples of compounds expressed in Formulae (J1) to (J8) below.

TABLE 7

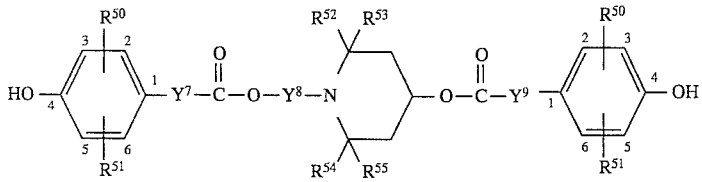

| Compound No. | $Y^7$ | $Y^8$ | $Y^9$ | $R^{50}$, $R^{51}$ | $R^{52}$~$R^{55}$ |
|---|---|---|---|---|---|
| J 1 | $-CH_2-$ | $-CH_2CH_2-$ | $-CH_2CH_2-$ | 3,5-di-t-butyl | H |
| J 2 | $-CH_2-$ | $-(CH_2)_4-$ | $-CH_2CH_2-$ | 3-t-butyl-5-methyl | $-CH_3$ |
| J 3 | $-CH_2CH_2-$ | $-CH_2-$ | $-CH_2CH_2-$ | 3,5-di-t-butyl | H |
| J 4 | $-CH_2CH_2-$ | $-CH_2CH_2-$ | $-CH_2CH_2-$ | 3,5-di-t-butyl | $-CH_3$ |
| J 5 | $-CH_2CH_2-$ | $-CH_2CH_2-$ | $-CH_2CH_2-$ | 3,5-di-t-butyl | H |
| J 6 | $-(CH_2)_4-$ | $-CH_2CH_2-$ | $-CH_2CH_2-$ | 3,5-dicyclohexyl | $-CH_3$ |
| J 7 | $-(CH_2)_4-$ | $-CH_2CH_2-$ | $-CH_2-$ | 3,5-di(dimethyl benzylphenyl) | H |
| J 8 | $-(CH_2)_4-$ | $-(CH_2)_4-$ | $-(CH_2)_4-$ | 3,5-di-t-butyl | $-CH_3$ |

Below are explained the stabilizing agents I to IX which are preferred combinations of the stabilizer in the invention.

The stabilizing agent I is composed of polyester type amine antioxidant (6) and phenol antioxidant (7-a) or (7-b). The content of each component may be the same as defined above.

The stabilizing agent II is composed of polyester type amine antioxidant (6) and benzotriazole ultraviolet absorbent (9)- The content of each component may be the same as defined above. To enhance the stabilizing effect furthermore, at least one of the following stabilizers may be also added.

(1) Phenol antioxidant of Formula (4-a) or (4-b)

(2) Phenol antioxidant of Formula (7-c)

(3) Phenol antioxidant of Formula (7-d)

(4) Phenol antioxidant of Formula (7-e)

(5) Piperidine antioxidant of Formula (10)

The stabilizing agent III is composed of polyester type amine antioxidant (6) and amine antioxidant (8-b). The content of each component may be the same as defined above.

The stabilizing agent IV is composed of polyester type amine antioxidant (6), spiro type amine antioxidant (8 -a), and benzotriazole ultraviolet absorber (9). The content of each component may be the same as defined above.

The stabilizing agent V is composed of polyester type amine antioxidant (6), spiro type amine antioxidant (8-a), and phenol antioxidant (7-e). The content of each component may be the same as defined above.

The stabilizing agent VI is composed of polyester type amine antioxidant (6), spiro type amine antioxidant (8 -a), and phenol antioxidant (7-d). The content of each component may be the same as defined above.

The stabilizing agent VII is composed of polyester type amine antioxidant (6), spiro type amine antioxidant (8-a), and phenol antioxidant (7-c). The content of each component may be the same as defined above.

The stabilizing agent VIII is composed of polyester type amine antioxidant (6), spiro type amine antioxidant (8 -a), and piperidine antioxidant (10). The content of each component may be the same as defined above.

The stabilizing agent IX is composed of polyester type amine antioxidant (6), spiro type amine antioxidant (8 -a), and phenol antioxidants (7-a) and (7-b). The content of each component may be the same as defined above.

Other stabilizing agents usable in the invention include the following compounds. These stabilizing agents may be used either alone or in combination with the above stabilizing agents.

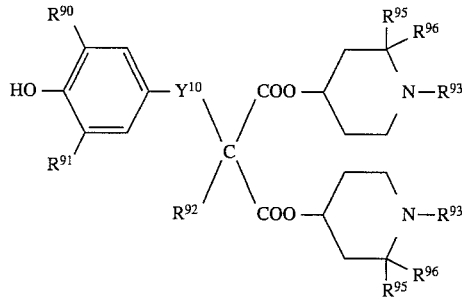

(where $R^{90}$, $R^{91}$, $R^{92}$, $R^{93}$, $R^{95}$, and $R^{94}$ denote the same or different, hydrogen atoms, alkyl groups, alkoxy groups, or aryl groups, and $Y^{10}$ is an alkylene group.)

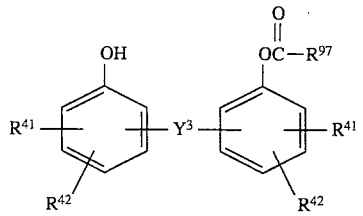

(where $R^{41}$, $R^{42}$ and $Y^3$ are the same as defined above, and $R^{97}$ denotes alkyl group, alkenyl group or aryl group.)

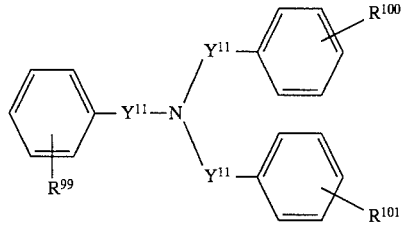

(where $R^{99}$, $R^{100}$ and $R^{101}$ are the same or different, hydrogen atoms, alkyl groups, alkoxy groups or aryl groups, and $Y^{11}$ denotes an alkylene group.)

Examples of the alkenyl group include vinyl group, allyl group, 2-butenyl group, 1-methylallyl group, 2 -pentenyl group,and 2-hexenyl group. Examples of the alkyl group, alkoxy group, aryl group and alkylene group are the same as mentioned above.

The photosensitive material of the invention may be applied to the photosensitive layer of either single layer-type or multilayer-type. However, the effect by the combination of the charge generating material and charge transferring material is expressed more manifestly in the single layer-type photosensitive layer having the both materials contained in the same layer, in particular. Hence, the invention should be preferably applied to the electrophotosensitive material having a single layer-type photosensitive layer.

To obtain the photosensitive material of single layer type, the photosensitive layer containing the bis-azo pigment (1) as charge generating material, diamine compound (2) as charge transferring material, and binding resin and the like is formed on the conductive substrate by coating or other application means.

To obtain the photosensitive material of multilayer-type, the bis-azo pigment (1) alone is evaporated on the conductive substrate to form a charge generating layer, or a charge generating layer containing the bis-azo pigment (1) and binding resin is formed on by coating or other application means, and a charge transferring layer containing the diamine compound (2) and binding resin is formed on this charge generating layer. To the contrary, first the charge transferring layer may be formed on the conductive substrate, then the charge generation layer may be formed.

As the charge generating material, aside from the bis-azo pigment (1), other known charge generating materials may be used together. In particular, it is effective for extending the sensitivity range of the electrophotosensitive material so as to possess the absorption wavelength region in a desired region.

Other charge generating materials include selenium, selenium-telluriums selenium-arsenic, amorphous silicon, pyririum salt, other azo pigment than defined in Formula (1), perylene pigment, ansanthrone pigment, phthalocyanine pigment, naphthalocyanine pigment, indigo pigment, triphenylmethane pigment, threne pigment, toluidine pigment, pyrazoline pigment, quinacridone pigment, and dithioketopyrolopyrol pigment.

In particular, when the perylene pigment expressed in Formula (51) is combined with the bis-azo pigment the residual potential may be notably lowered, while the repeatability is markedly improved, and therefore an electrophotosensitive material excellent in sensitivity characteristic and durability may be obtained. As the alkyl group, alkoxyl group and aryl group in such perylene pigment (51), the same compounds as specified above may be used. As the perylene pigment (51), for example, the following compounds may be used.

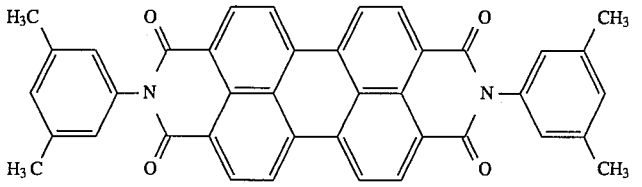

(P1)

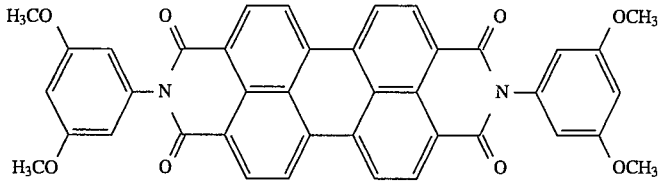

(P2)

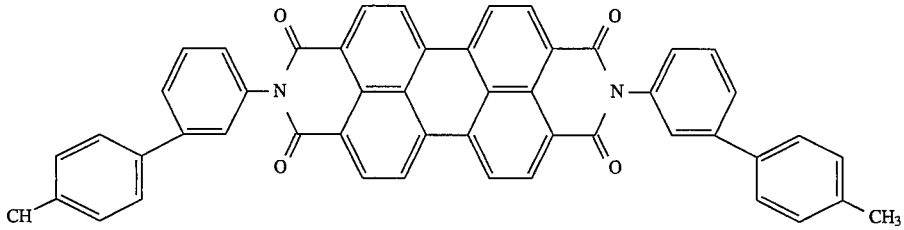

(P3)

Besides, together with perylene pigment or instead of perylene pigment, at least one type selected from the group consisting of ansanthrone pigment, X type metal-free phthalocyanine pigment, imidazole perylene pigment, and perylene bis-azo pigment may be used. As the ansanthrone pigment, for example, the compound expressed in Formula (52):

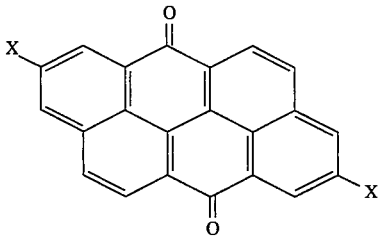

(52)

(where X denotes a halogen atom) is preferably used, and a practical example of the ansanthrone pigment may be a dibromoansanthrone where X is a bromine atom.

When the ansanthrone pigment is used together with the bis-azo pigment (1), in particular, the repeatability is improved, and an electrophotosensitive material excellent in durability is obtained.

The X-type metal-free phthalocyanine pigment is, when combined with the bis-azo pigment (1), particularly improved in the repeatability, and an electrophotosensitive material excellent in durability is obtained.

As the imidazole perylene pigment, for example, the compound expressed in Formula (53):

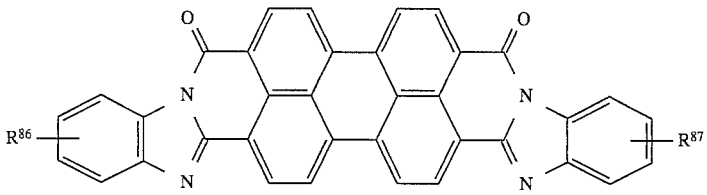

(53)

(where $R^{86}$ and $R^{87}$ are the same or different, hydrogen atoms, alkyl groups, alkoxy groups, or aryl groups) may be used preferably. Practical examples of the ansanthrone pigment include the compounds where $R^{86}$ and $R^{87}$ are both hydrogen atoms. When the imidazole perylene pigment is used together with the bis-azo pigment (1), the repeatability is particularly improved, and an electrophotosensitive material excellent in durability may be obtained.

An example of perylene bis-azo pigment is a compound expressed in Formula (54):

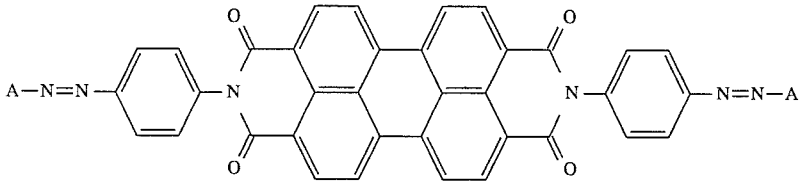

(54)

(where A denotes a coupler residue exhibited above). When this perylene bis-azo pigment is combined with the bis-azo pigment expressed in Formula (1), the repeatability is particularly improved, and an electrophotosensitive material excellent in durability may be obtained.

The photosensitive material of the invention is composed of a photosensitive layer containing, as the charge generating material, one or two or more types of bis-azo pigment expressed in Formula (1), and at least one pigment selected from the group consisting of perylene pigment, ansanthrone pigment, X-type metal-free phthalocyanine pigment, imidazole perylene pigment, and perylene bis-azo pigment. Other pigments to be used in combination with the bis-azo pigment expressed in Formula (1) may be used either alone or in combination of two or more types.

The blending rate of the bis-azo pigment expressed in Formula (1) and other pigments is not specifically defined in the invention, but it is preferred to blend the bis-azo pigment and other pigments so that the rate of the bis-azo pigment in the total quantity of the charge generating material may be in a range of 10 to 80% by weight. If the rate of the bis-azo pigment in the total quantity of the charge generating material is less than 10% by weight, the desired sensitivity is not obtained. If exceeding 80% by weight, to the contrary, the effect of using the other pigments is insufficient, the residual potential is high, and the change of the surface potential by repeated charging and exposure increases.

The diamine compound (2) which is a charge transferring material may be used either alone or in combination with other known charge transferring materials. Examples of known charge transferring materials include various electron-attracting compounds and electron-donating compounds.

Electron-attracting compounds include, for example, diphenoquinone derivatives such as 2,6-dimethyl-2,6-di-tert-dibutyldiphenoquinone, malonitrile, thiopyrane compound, tetracyanoethylene, 2,4,8-trinitrothioxanthone, fluorene compounds such as 3,4,5-tetranitro-9-fluorene, dinitrobenzene, dinitroanthracene, dinitroacridine, nitroanthraquinone, dinitroanthraquinone, succinic anhydride, maleic anhydride, and dibromo maleic anhydride.

Electron-donating compounds include, for example, oxadiazole compounds such as 2,5-di(4-methylaminophenyl)-1,3,4-oxadiazole styryl compounds such as 9-(4-diethylaminostyryl) anthracene, carbazole compounds such as polyvinyl carbazole, pyrazoline compounds such as 1-phenyl-3-(p-dimethylaminophenol) pyrazoline, hydrazone compounds other than specified in Formula (3), triphenylamine compound, indole compound, oxazole compound, iso-oxazole compound, thiazole compound, thiadiazole compound, imidazole compound, pyrazole compound, triazole compound, other nitrogen-containing cyclic compounds, and condensation polycyclic compounds.

These charge transferring materials are used either alone or in a mixture of two or more types. Incidentally, when the charge transferring material having a film forming property such as polyvinyl carbazole is used, the binding resin is not always required.

As the binding resin, various resins may be used, for example, a thermoplastic resin such as styrene polymer, styrene-butadiene copolymers tyrene-acrylonitrile copolymers tyrene-maleic acid copolymer, acrylic copolymers tyrene-acrylic acid copolymer, polyethylene, ethylene-vinyl acetate copolymer, chlorinated polyethylene, polyvinyl chloride, polypropylene, vinyl chloride-vinyl acetate copolymer, polyester alkyd resin, polyamide, polyurethane, polycarbonate, polyallylate, polysulfone, diallyl phthalate resin, ketone resin, polyvinyl butyral resin, polyether resin, polyester resin; a crosslinking thermosetting resin such as silicone resin, epoxy resin, phenol resin, urea resin, melamine resin; and a photosetting resin such as epoxy acrylate, urethaneacrylate. These binding resins may be used alone or in a mixture of two or more types.

In the invention, as described above, the combination of the polycarbonate and polyester possessing repetitive unit shown in Formula (50) is preferably used as the binding resin, in particular.

In the polyester possessing repetitive units expressed in Formula (50), it is necessary that either group $A^3$ or $A^4$ contains an aromatic ring in the main chain in the formula, and the other should not contain an aromatic ring in the main chain. If both groups $A^3$ and $A^4$ contain aromatic rings, the main chain becomes stiff, and therefore the effect of improvement of adhesion by the carbonyl group is sacrificed. On the other hand, when both groups $A^3$ and $A^4$ are free from aromatic ring, compatibility with the polycarbonate is spoiled, and a homogeneous photosensitive layer is not obtained.

When the divalent group not containing aromatic ring in the main chain contains an aliphatic group, this aliphatic group is preferred to be a saturated aliphatic group not containing double bond or triple bond in its main chain. If the aliphatic group contains double bond or triple bond in the main chain, the stiffness of the main chain is somewhat increased, and the effect of improvement of adhesion by the carbonyl group may be decreased.

At the end of the main chain of Formula (50), an —H group or a —COOH group is attached, and the acid value indicating the quantity of the —COOH group is desired to be 2 (KOH mg/g) or less. If the acid value is far more than 2, although the adhesion of the photosensitive layer to the conductive substrate is improved, a complex is formed with the diamine compound (2) which is an electron-donating compound, and the resistance of the photosensitive layer is lowered, which may lead to lowering of the charging capability. The —COOH group may work as an ion trap for the cation radical to block the charge transferring, which may cause a drop in sensitivity.

The molecular weight of the polyester possessing the repetitive unit expressed in Formula (50) is not particularly specified, but the number-average molecular weight is preferred to be 10000 to 50000, or the glass transition temperature Tg to be 15° C. or more. If the number-average molecular weight is less than 10000, the glass transition temperature Tg is lowered, and if the glass transition temperature Tg becomes less than 15° C., the film strength of the photosensitive layer may be lowered. On the other hand, if the number-average molecular weight is far greater than 50000, the —OH groups and —COOH groups at the molecular ends decrease, and the adhesion is lowered.

Such polyester is obtained by reaction between the acid component expressed in Formula (50a) and the diol component expressed in Formula (50b).

$$HOOC—A^3—COOH \quad (50a)$$

$$HO—A^4—OH \quad (50b)$$

Examples of the acid component include the compounds expressed in Formulae (55) to (59).

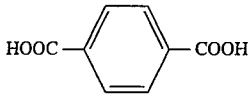
(55)

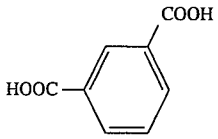
(56)

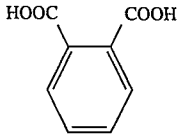
(57)

$$HOOC\text{-}(CH_2)_u\text{-}COOH \quad (58)$$

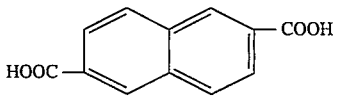
(59)

Examples of the diol component include the compounds expressed in Formulae (60) to (66).

$$HO\text{-}(CH_2)_v\text{-}OH \quad (60)$$

$$HO—\underset{\underset{CH_3}{|}}{CH}—CH_2—OH \quad (61)$$

-continued

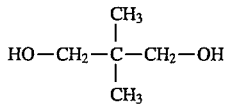
(62)

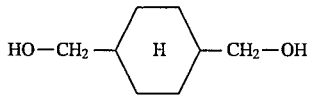
(63)

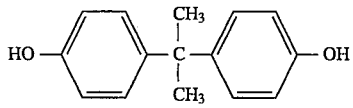
(64)

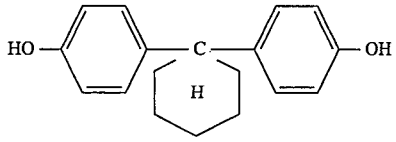
(65)

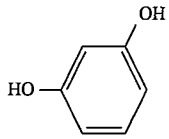
(66)

These acid components and diol components are used in proper combinations so that either one of the groups $A^3$ and $A^4$ in Formula (50) may contain an aromatic ring in the main chain, and the other may not. Two or more types of acid components and diol components expressed above may be mixed. Of the acid components and diol components which are raw materials of polyester, the rate of those containing aromatic ring in the main chain is not particularly defined, but is preferred to be somewhere between 40 and 80 mole %.

Practical compounds of the polyester possessing the repetitive unit expressed in Formula (50) include, for example, the compounds (M1) to (M5) shown in Table 8 below.

TABLE 8

| Polyester | Acid component | Diol component | Number-average molecular weight Mn | Acid value (KOH mg/g) |
|---|---|---|---|---|
| M 1 | (55) | (60) v = 2 | 20000 | 1 |
| | (56) | (62) | | |
| M 2 | (57) | (62) | 43000 | 2 |
| M 3 | (57) | (60) v = 2 | 16000 | 1 |
| | (59) | (61) | | |
| M 4 | (58) u = 4 | (64) | 18000 | 2 |
| M 5 | (58) u = 2 | (65) | 32000 | 1 |
| | (58) u = 7 | (66) | | |

In the table, "(58)u=2" in the column of acid component means a succinic acid in which u in Formula (58) is 2, "(58)u=4" is an adipic acid in which u is 4, and "(58)u=7" represents an azelaic acid in which u is 7. In the column of diol component, "(60)v=2" represents an ethylene glycol in which v in Formula (60) is 2.

Of the polycarbonate and specific polyester used as the binding resins in the invention, the content of polyester is desired to be 0.5 to 50% by weight. If the content of polyester is less than 0.5% by weight, the adhesion of the photosensitive layer may not be improved sufficiently. On the other hand, if the content exceeds 50% by weight by far, as mentioned above, the polar group in the polyester molecule acts as a carrier trap to lower the sensitivity of the photosensitive material, or promote photo-oxidation deterioration of the charge generating material and charge transferring material in a high electric field. Besides, as the content of the polycarbonate is decreased, the strength is lowered, and, as a result, a tough photosensitive layer excellent in resistance to abrasion may not be obtained.

As the polycarbonate used together with the specific polyester as the binding resin, various known compounds may be used, and at least one of the compounds possessing repetitive units expressed in Formulae (67) and (69) is preferably used:

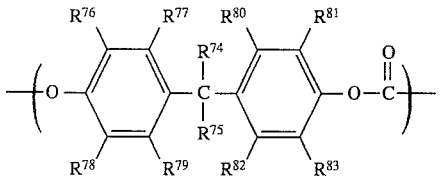
(67)

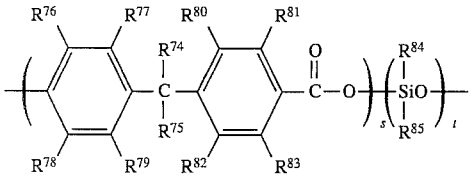
(68)

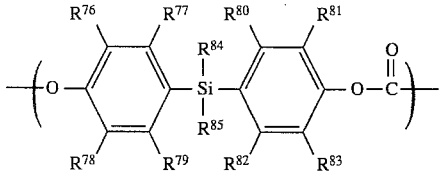
(69)

(where $R^{74}$ and $R^{75}$ are the same or different, hydrogen atoms, aliphatic groups, or aromatic groups, and the aliphatic groups and aromatic groups may possess substituents, and $R^{74}$ and $R^{75}$ may be mutually bonded to form a ring; $R^{76}$, $R^{77}$, $R^{78}$, $R^{79}$, $R^{80}$, $R^{81}$, $R^{82}$ and $R^{83}$ may be the same or different, hydrogen atoms, halogen atoms, aliphatic groups or aromatic groups, and the aliphatic groups and aromatic groups may possess substituents; $R^{84}$ and $R^{85}$ denote hydrogen atoms, halogen atoms, alkyl groups or aryl groups, and the alkyl groups and aryl groups may possess substituents.

In the above formulae, aliphatic groups include alkyl group and alkoxy group as stated above, and aromatic groups include aryl group, benzyl group and other aralkyl group as stated above. These groups may possess substituents as stated above.

Practical compounds of polycarbonate expressed in Formula (67) include, for example, the following compounds possessing repetitive units in (L1) to (L3).

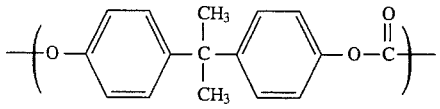
(L1)

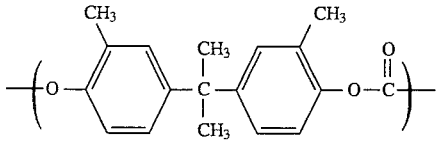
(L2)

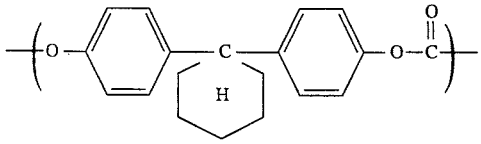
(L3)

-continued

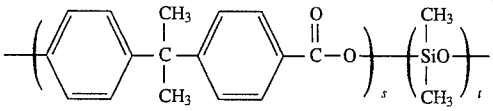
(L4)

Practical compounds of polycarbonate expressed in Formula (69) include, for example, the following compounds possessing repetitive units in (L5) to (L7).

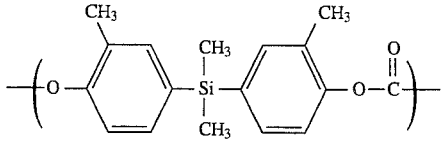
(L5)

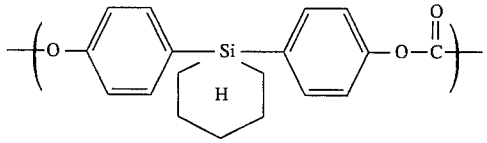
(L6)

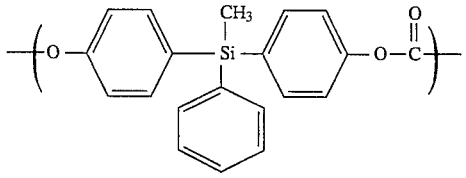
(L7)

Each photosensitive layer of single layer-type and multilayer-type of the invention may contain additives, such as sensitizer, other fluorene compound than expressed in Formula (4), antioxidant, ultraviolet absorber, other deterioration preventive agent, and plasticizer.

To enhance the sensitivity of the charge generating layer, the charge generating material may be combined with known sensitizers, for example, terphenyl, halonaphthoquinone and acenaphthylene.

In the multilayer-type photosensitive material, the charge generating material and binding resin for composing the charge generating layer may be blended at various rates, but it is preferred to add 5 to 1000 parts by weight of the charge generating material, more preferably 30 to 500 parts by weight to 100 parts by weight of the binding resin.

The charge transferring material and binding resin for composing the charge transferring layer may be blended at various rates so far as not to impede the transfer of charge or not to crystallize, but in order that the charge generated in the charge generating layer may be easily transferred by irradiation with light, it is desired to add the charge transferring material by 10 to 500 parts by weight, or more preferably 25 to 200 parts by weight to 100 parts by weight of the binding resin.

The thickness of the photosensitive layer of the multilayer-type is preferably about 0.01 to 5 μm in the charge generating layer, more preferably 0.1 to 3 μm, and 2 to 100 μm in the charge transferring layer, preferably 5 to 50 μm approximately.

In the photosensitive layer of single layer type, the charge generating material should be properly added at 0.1 to 50 parts by weight, more preferably 0.5 to 30 parts by weight to 100 parts by weight of the binding resin, and the charge transferring material is added at 20 to 500 parts by weight, preferably 30 to 200 parts by weight. The thickness of the photosensitive layer of single layer type should be 5 to 100 μm, or more preferably 10 to 50 μm.

In the single layer-type photosensitive material, between the conductive substrate and the photosensitive layer, and in the multilayer-type photosensitive material, between the conductive substrate and charge generating layer, between the conductive substrate and charge transferring layer, or between the charge generating layer and charge transferring layer, a barrier layer may be formed in a range so as not to impede the characteristic of the photosensitive material. On the surface of the photosensitive material, a protective layer may be formed.

As the conductive substrate on which the layers are formed, various materials possessing electric conductivity may be used, for example, aluminum, copper, tin, platinum, silver, vanadium, molybdenum, chromium, cadmium, titanium, nickel, palladium, indium, stainless steel, brass, other metals alone, or metal evaporated or laminated plastics, and glass coated with aluminum iodide, tin oxide, indium oxide, and the like.

The conductive substrate may be either sheet or drum, and the substrate itself may be conductive, or the surface of the substrate may be conductive. The conductive substrate is desired to have a sufficient mechanical strength in use.

When forming each layer by a coating method, the charge generating material, the charge transferring material, the binding resin, and others exemplified above are dispersed and mixed, together with proper solvents, by known methods, such as roll mill, ball mill, attriter, paint shaker and ultrasonic dispersing device, and a coating solution is prepared, which is applied and dried by known methods.

Solvents for preparing a coating liquid include various organic solvents, for example, other alcohols such as methanol, ethanol, isopropanol, butanol; aliphatic hydrocarbons such as n-hexane, octane, cyclohexane; aromatic hydrocarbons such as benzene, toluene, xylene; halogenated hydrocarbons such as dichloromethane, dichloroethane, carbon tetrachloride, chlorobenzene; other ethers such as dimethyl ether, diethylether, tetrahydrofurane, ethyleneglycol dimethylether, diethyleneglycol dimethylether; ketones such as acetone, methylethylketone, cyclohexanone; esters such as ethyl acetate, methyl acetate, dimethyl formaldehyde, dimethyl formamide and dimethyl sulfoxide, and others. These solvents may be used either alone or in a mixture of two or more types.

To enhance the dispersion of the charge transferring material and charge generating material, and smoothness of the surface of the photosensitive layers surfactants, leveling agents and others may be also used.

Thus, according to the invention, the diamine compound expressed in Formula (2) is selected as the charge transferring material, and it is combined with the bis-azo pigment expressed in Formula (1) as the charge generating material, so that an organic photosensitive material possessing extremely excellent electrophotographic characteristics not known before may be obtained.

In addition to the bis-azo pigment (1) and diamine compound (2), moreover, by adding the hydrazone compound (3), fluorene compound (4) and diphenoquinone derivative (5), or by the combination of bis-azo pigment (1), diamine compound (2) and diphenoquinone derivative (5), an organic photosensitive material further enhanced in sensitivity and repeatability may be obtained.

EXAMPLES

The following description will discuss in more detail the present invention with reference to Examples thereof and Comparative Examples, but the present invention does not restrict in only the following Examples.

Examples 1 to 3 (Multilayer-Type Photosensitive Materials)

With a paint-shaker, 10 parts by weight of bis-azo pigment as the charge generating material and 190 parts by weight of cyclohexanone were dispersed for 1 hour. Solutions obtained by dissolving 10 parts by weight of a vinyl chloride-vinyl acetate copolymer into 40 parts by weight of cyclohexanone were added, and further the dispersing procedures were continued for 1 hour. The dispersion liquids thus obtained were applied onto aluminum cylinders, respectively, and dried to obtain charge generating layers, each having a thickness of 0.7 μm.

To the charge generating layers, the solutions of compositions for preparing charge transferring layers, which consist of ingredients mentioned below, were applied with a dipping method, and allowed to dry at 100° C. for 1 hour, thereby to prepare charge transferring layers. Thus, multilayer-type electrophotosensitive materials being negative charge type and having a thickness of 25 μm were obtained. The bis-azo pigment, the diamine compound, the hydrazone compound, the fluorene compound, the diphenoquinone derivative, the bisphenol A type polycarbonate resin, the oligomer-type amine antioxidant and the phenol antioxidant used in each Example are shown in Table 9 by the compound-numbers given to the practical compound exemplified above.

| (Ingredients) | (parts by weight) |
|---|---|
| Diamine compound (charge transferring material) | 70 |
| Hydrazone compound | 30 |
| Fluorene compound | 30 |
| Diphenoquinone derivative | 10 |
| bisphenol A type polycarbonate (binding resin) | 150 |
| Oligomer-type amine antioxidant | 10 |
| Phenol antioxidant | 20 |
| Dichloromethane | 800 |

Examples 4 to 6(Multilayer-Type Photosensitive Materials)

Multilayer-type electrophotosensitive materials being negative charge type and having a thickness of 25 μm were obtained in the same manner as for Examples 1 to 3, except that the solutions of compositions for preparing charge transferring layers, which consist of ingredients mentioned below, were applied to the charge generating layers to prepare a charge transferring layers. The practical compounds of each ingredient used are shown in Table 9 with the corresponding compound-numbers in the same manner as for Examples 1 to 3.

| (Ingredients) | (parts by weight) |
|---|---|
| Diamine compound (charge transferring material) | 100 |
| Diphenoquinone derivative | 50 |
| Bisphenol Z type polycarbonate (binding resin) | 150 |
| Oligomer-type amine antioxidant | 10 |
| Spiro-type amine antioxidant | 20 |
| UV absorber | 20 |
| Dichloromethane | 800 |

Comparative Examples 1 to 3 (Multilayer-Type Photosensitive Materials)

Multilayer-type electrophotosensitive materials being negative charge type and having a thickness of 25 μm were obtained in the same manner as for Examples 1 to 3, except that the compounds expressed by the formulas (K1) to (K3) were used respectively instead of the diamine compounds at the same amounts, and that the hydrazone compound, the fluorene compound, the diphenoquinone derivative, the antioxidant and the UV absorber mentioned above were not added.

(K1)

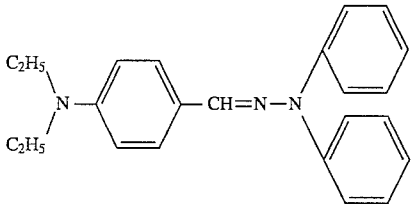

(K2)

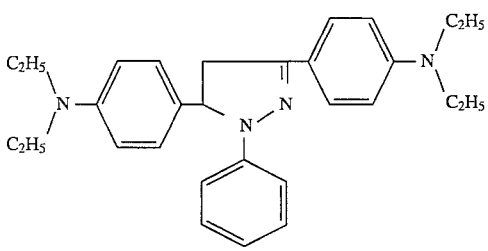

(K3)

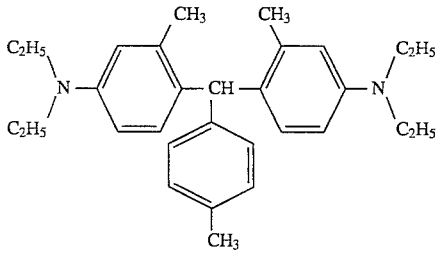

Comparative Examples 4 to 6 (Multilayer-Type Photosensitive Materials)

Multilayer-type electrophotosensitive materials being negative charge type and having a thickness of 25 μm were obtained in the same manner as for Comparative Examples 1 to 3, except that the compounds expressed by the formulas (K4), (K5) and (K11) were used respectively as the charge transferring material instead of the diamine compounds used in Examples 4 to 6 at the same amounts as for Examples 4 to 6.

(K4)

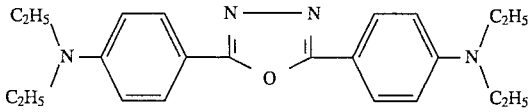

(K5)

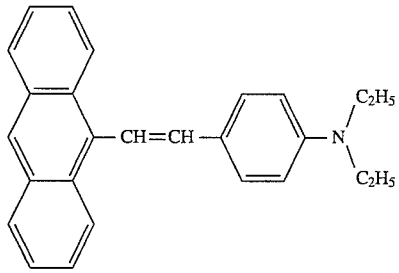

(K11)

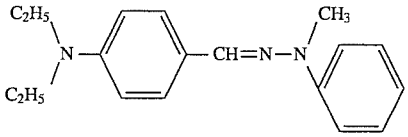

TABLE 9

| Example No. | Bis-azo pigment | Diamine compound | Hydrazone compound | Fluorene compound | Diphenoquinone derivative | Oligomer-type amine antioxidant | Amine antioxidant | UV absorber | Phenol antioxidant |
|---|---|---|---|---|---|---|---|---|---|
| | | | Multilayer-type photosensitive Materials | | | | | | |
| Ex. | | | | | | | | | |
| 1 | B4 | A9 | C2 | D1 | E1 | F3 | — | — | G4 |
| 2 | B5 | A1 | C4 | D6 | E3 | F5 | — | — | G5 |
| 3 | B6 | A5 | C6 | D10 | E5 | F4 | — | — | G6 |
| 4 | B7 | A7 | — | — | E6 | F1 | H2 | I5 | — |
| 5 | B9 | A13 | — | — | E4 | F6 | H3 | I6 | — |
| 6 | B10 | A3 | — | — | E2 | F2 | H2 | I7 | |
| Comp. Ex. | | | | | | | | | |
| 1 | B4 | D1 | — | — | — | — | — | — | — |
| 2 | B5 | D2 | — | — | — | — | — | — | — |
| 3 | B6 | D3 | — | — | — | — | — | — | — |
| 4 | B7 | D4 | — | — | — | — | — | — | — |
| 5 | B9 | D5 | — | — | — | — | — | — | — |
| 6 | B10 | D11 | — | — | — | — | — | — | — |

Examples 7 to 13 (Multilayer-Type Photosensitive Materials)

Multilayer-type electrophotosensitive materials were obtained in the same manner as for Examples 1 to 3, except that the compounds shown in Table 10 were used.

Examples 14 to to 16 (Multilayer-Type Photosensitive Materials)

Multilayer-type electrophotosensitive materials were obtained in the same manner as for Examples 4 to 6, except that the compounds shown in Table 10 were used.

Examples 17 to 18 (Multilayer-Type Photosensitive Materials)

Multilayer-type electrophotosensitive materials being negative charge type and having a thickness of 25 μm were obtained in the same manner as for Examples 1 to 3, except that after forming charge generating layers on the aluminum cylinders in the same manner as for Example 1, solutions of compositions for charge transferring layers which consist of the following ingredients were applied onto the charge transferring layers to prepare charge transferring layers. The practical compound of each ingredient used is shown in Table 10 with the compound-number in the same method as for Examples 1 to 3.

| (Ingredients) | (parts by weight) |
|---|---|
| Diamine compound (charge transferring material) | 70 |
| Hydrazone compound | 30 |
| Bisphenol A type polycarbonate | 150 |
| Diphenoquinoe derivative | 10 |
| Oligomer-type amine antioxidant | 10 |
| UV absorber | 20 |
| Piperidine antioxidant | 5 |
| Dichloromethane | 800 |

method using wire bar, and allowed to dry at 110° C. for 30 minutes, thereby to prepare single layer-type photosensitive layers having a thickness of 23 μm. Thus, single layer-type electrophotosensitive materials being positive charge type were obtained. The practical compound of each ingredient used is shown in Table 11 with the corresponding compound-number in the same method as for Examples 1 to 3.

| (Ingredients) | (parts by weight) |
|---|---|
| Bis-azo pigment (charge generating material) | 6 |
| Diamine compound (charge transferring material) | 60 |
| Hydrazone compound | 40 |
| Fluorene compound | 25 |
| Diphenoquinone derivative | 10 |
| Bisphenol A type polycarbonate | 150 |
| Oligomer-type amine antioxidant | 10 |
| Phenol antioxidant | 20 |
| Dichloromethane | 800 |

Examples 22 to 24 (Single Layer-Type Photosensitive Materials)

Single layer-type photosensitive layers having a thickness of 23 μm were prepared in the same manner as for Examples 19 to 21, except that coating solutions were prepared by dispersing compositions for photosensitive layers which consist of the following ingredients for 2 hours with a paint-shaker. Thus, single layer-type photosensitive materials being positive charge type were obtained. The practical compound of each ingredient used is shown in Table 11 with the corresponding compound-number in the same method as for Examples 1 to 3.

TABLE 10

| | Multilayer-type photosensitive Materials | | | | | | | | | |
|---|---|---|---|---|---|---|---|---|---|---|
| Example No. | Bis-azo pigment | Diamine compound | Hydrazone compound | Fluorene compound | Dipheno-quinone derivative | Oligomer-type amine antioxidant | Amine antioxidant | UV absorber | Phenol anti-oxidant | Piperidine anti-oxidant |
| Ex. | | | | | | | | | | |
| 7 | B1 | A14 | C1 | D2 | E2 | F3 | — | — | G1 | — |
| 8 | B3 | A2 | C7 | D4 | E5 | F2 | — | — | G2 | — |
| 9 | B1 | A1 | C1 | D1 | E1 | F1 | — | — | G8 | — |
| 10 | B2 | A2 | C2 | D2 | E2 | F2 | — | — | G12 | — |
| 11 | B3 | A3 | C3 | D3 | E3 | F3 | — | — | G17 | — |
| 12 | B4 | A4 | C4 | D4 | E4 | F4 | — | — | G21 | — |
| 13 | B5 | A5 | C5 | D5 | E5 | F5 | — | — | G27 | — |
| 14 | B6 | A6 | C6 | — | E6 | F6 | H7 | I1 | — | — |
| 15 | B7 | A7 | C7 | — | E1 | F1 | H10 | I2 | — | — |
| 16 | B8 | A8 | C8 | — | E2 | F2 | H13 | I3 | — | — |
| 17 | B9 | A9 | C9 | — | E3 | F3 | — | I4 | — | J1 |
| 18 | B10 | A10 | C1 | — | E4 | F4 | — | I5 | — | J5 |

Examples 19 to 21 (Single Layer-Type Photosensitive Materials)

Compositions for photosensitive layers which consist of the following ingredients were dispersed for 2 hours by a paint-shaker to prepare coating solutions for single layer-type photosensitive layers. These coating solutions were applied to surfaces of aluminum cylinders by a bar-coat

| (Ingredients) | (parts by weight) |
|---|---|
| Bis-azo pigment (charge generating material) | 10 |
| Diamine compound (charge transferring material) | 100 |
| Diphenoquinoe derivative | 50 |
| Bisphenol A type polycarbonate | 150 |
| Oligomer-type amine antioxidant | 10 |
| Sprio-type amine antioxidant | 20 |
| UV absorber | 20 |
| Dichloromethane | 800 |

Comparative Examples 7 to 9 (Single Layer-Type Photosensitive Materials)

Single layer-type photosensitive layers having a thickness of 23 μm were prepared in the same manner as for Examples 19 to 21, except that the compounds expressed by the following formulas (K6) to (K8) were used as charge-transferring materials respectively instead of the diamine compounds used in Examples 19 to 21 at the same amounts, and that the hydrazone compound, the fluorene compound, the diphenoquinone derivative, the antioxidant and the UV absorber mentioned above were not added. Thus single layer-type photosensitive materials being positive charge type were obtained.

Comparative Examples 10 to 12 (Single Layer-Type Photosensitive Materials)

Single layer-type photosensitive materials being positive charge type were prepared in the same manner as for Examples 7 to 9, except that the compounds expressed by the following formulas (K9), (K10) and (K11) were used as charge-transferring materials respectively instead of the diamine compounds used in Examples 22 to 24 at the same amounts as in Examples 22 to 24.

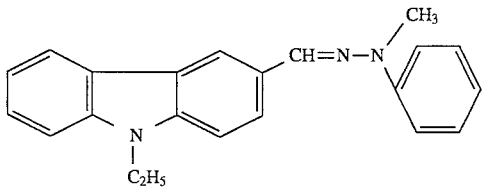

(K6)

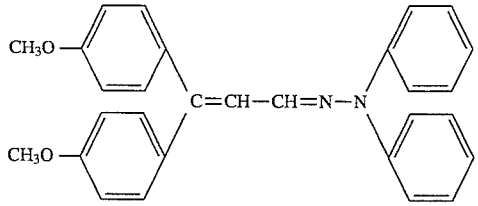

(K7)

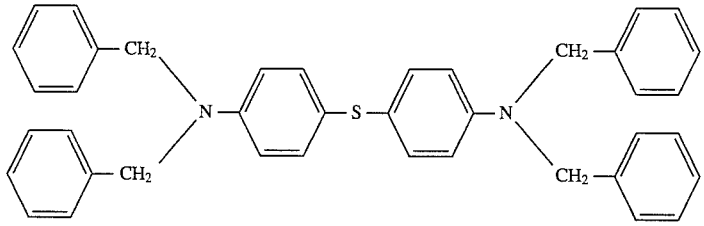

(K8)

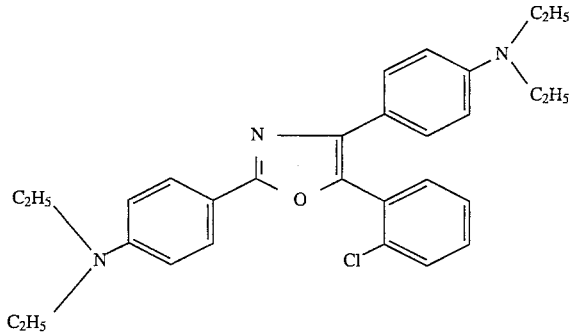

(K9)

-continued

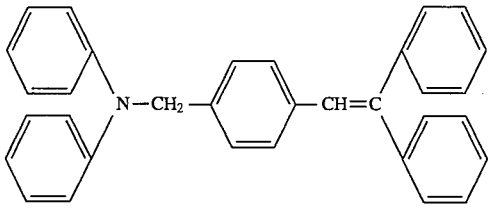

(K10)

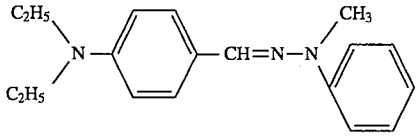

(K11)

TABLE 11

| Example No. | Bis-azo pigment | Diamine compound | Hydrazone compound | Fluorene compound | Dipheno-quinone derivative | Oligomer-type amine antioxidant | Amine antioxidant | UV absorber | Phenol anti-oxidant |
|---|---|---|---|---|---|---|---|---|---|
| | Single layer-type photosensitive Materials | | | | | | | | |
| Ex. | | | | | | | | | |
| 19 | B4 | A3 | C1 | D1 | E2 | F2 | — | — | G3 |
| 20 | B5 | A13 | C3 | D6 | E4 | F6 | — | — | G2 |
| 21 | B6 | A7 | C5 | D10 | E6 | F1 | — | — | G1 |
| 22 | B7 | A5 | — | — | E5 | F4 | H6 | I1 | — |
| 23 | B9 | A1 | — | — | E3 | F5 | H5 | I2 | — |
| 24 | B10 | A9 | — | — | E1 | F3 | H4 | I3 | — |
| 25 | B2 | A15 | C1 | D3 | E3 | F1 | — | — | G4 |
| 26 | B4 | A4 | C9 | D5 | E4 | F3 | — | — | G3 |
| Comp. Ex. | | | | | | | | | |
| 7 | B4 | D6 | — | — | — | — | — | — | — |
| 8 | B5 | D7 | — | — | — | — | — | — | — |
| 9 | B6 | D8 | — | — | — | — | — | — | — |
| 10 | B7 | D9 | — | — | — | — | — | — | — |
| 11 | B9 | D10 | — | — | — | — | — | — | — |
| 12 | B10 | D11 | — | — | — | — | — | — | — |

Examples 27 to 31 (Single Layer-Type Photosensitive Materials)

Single layer-type photosensitive materials were prepared in the same manner as for Examples 19 to 21, except that the compounds shown in Table 12 were used.

Examples 32 to 34 (Single Layer-Type Photosensitive Materials)

Single layer-type photosensitive materials were prepared in the same manner as for Examples 22 to 24, except that the compounds shown in Table 12 were used.

Examples 35 to 36 (Single Layer-Type Photosensitive Materials)

Single layer-type photosensitive layers having a thickness of 23 μm were prepared in the same manner as for Examples 19 to 21, except that coating solutions were prepared by dispersing compositions for photosensitive layers which consist of the following ingredients for 2 hours with a paint-shaker. Thus single layer-type photosensitive materials being positive charge type were obtained. The practical compound of each ingredient used is shown in Table 12 with the corresponding compound-number in the same method as for Examples 1 to 3.

| (Ingredients) | (parts by weight) |
|---|---|
| Bis-azo pigment (charge generating material) | 6 |
| Diamine compound (charge transferring material) | 60 |
| Hydrazone compound | 40 |
| Bisphenol A type polycarbonate | 150 |
| Diphenoquinone derivative | 10 |
| Oligomer-type amine antioxidant | 10 |
| UV absorber | 20 |
| Piperidine antioxidant | 10 |
| Dichloromethane | 800 |

TABLE 12

| Example No. | Bis-azo pigment | Diamine compound | Hydrazone compound | Fluorene compound | Dipheno-quinone derivative | Oligomer-type amine antioxidant | Amine antioxidant | UV absorber | Phenol anti-oxidant | Piperidine anti-oxidant |
|---|---|---|---|---|---|---|---|---|---|---|
| | Single layer-type photosensitive Materials | | | | | | | | | |
| Ex. | | | | | | | | | | |
| 27 | B10 | A15 | C1 | D6 | E1 | F1 | — | — | G7 | — |
| 28 | B9 | A14 | C2 | D7 | E2 | F2 | — | — | G10 | — |
| 29 | B8 | A13 | C3 | D8 | E3 | F3 | — | — | G16 | — |
| 30 | B7 | A12 | C4 | D9 | E4 | F4 | — | — | G25 | — |
| 31 | B6 | A11 | C5 | D10 | E5 | F5 | — | — | G26 | — |
| 32 | B5 | A10 | C6 | — | E6 | F6 | H8 | I1 | — | — |
| 33 | B4 | A9 | C7 | — | E1 | F1 | H10 | I2 | — | — |
| 34 | B3 | A8 | C8 | — | E2 | F2 | H12 | I3 | — | — |
| 35 | B2 | A7 | C9 | — | E3 | F3 | — | I4 | — | J4 |
| 36 | B1 | A6 | C10 | — | E4 | F4 | — | I5 | — | J8 |

The following tests were conducted on the electrophotosensitive material of each Example and Comparative Example.

Electrical Properties

The surface of each electrophotosensitive material prepared in each Example and Comparative Example was charged at about ±800 V. Under this condition, after the surface potential (V) was measured, the half-life light exposure was measured by using light having a wave length of 550 nm which is the most necessary in electrophotosensitive material for PPC. Specifically, light having a wave length of 550 nm which was isolated from a xenon lamp with use of a spectroscope was exposed at an intensity of 0.1 mW/cm$^2$ and an exposure time of 1 second, thereby to measure the half-life light exposure (μ J/cm$^2$). On the other hand, the surface potential at a time just 0.5 seconds from the exposure was measured as a potential after light exposure (V). These test results are shown in Tables 13 and 14.

Repeat Properties

After repeating a copy 50,000 times with an electrostatic copying machine (DC-1670M manufactured by Mita Kogyo Co., Ltd.), the surface potential, the half-life light exposure and the potential after light exposure were measured. These test results are shown in Table 15.

TABLE 13

| Example No. | CGM | CTM | Vs.p. (V) | Potential after light Exposure (V) | $E_{1/2}$ (μJ/cm$^2$) |
|---|---|---|---|---|---|
| Multilayer | | | | | |
| Ex. | | | | | |
| 1 | B4 | A9 | −823 | −60 | 1.10 |
| 2 | B5 | A1 | −816 | −78 | 1.06 |
| 3 | B6 | A5 | −819 | −62 | 1.08 |
| 4 | B7 | A7 | −820 | −70 | 0.96 |
| 5 | B9 | A13 | −816 | −66 | 1.21 |
| 6 | B10 | A3 | −821 | −58 | 0.92 |
| Comp. Ex. | | | | | |
| 1 | B4 | D1 | −831 | −174 | 5.32 |
| 2 | B5 | D2 | −816 | −356 | 5.46 |
| 3 | B6 | D3 | −808 | −323 | 4.82 |
| 4 | B7 | D4 | −812 | −260 | 4.76 |
| 5 | B9 | D5 | −821 | −276 | 5.84 |
| 6 | B10 | D11 | −815 | −234 | 5.08 |

TABLE 13-continued

| Example No. | CGM | CTM | Vs.p. (V) | Potential after light Exposure (V) | $E_{1/2}$ (μJ/cm$^2$) |
|---|---|---|---|---|---|
| Single-layer | | | | | |
| Ex. | | | | | |
| 19 | B4 | A3 | 816 | 56 | 0.72 |
| 20 | B5 | A13 | 807 | 63 | 0.53 |
| 21 | B6 | A7 | 812 | 52 | 0.61 |
| 22 | B7 | A5 | 823 | 69 | 0.52 |
| 23 | B9 | A1 | 820 | 61 | 0.46 |
| 24 | B10 | A9 | 814 | 57 | 0.48 |
| Comp. Ex. | | | | | |
| 7 | B4 | D6 | 806 | 176 | 2.73 |
| 8 | B5 | D7 | 812 | 208 | 3.96 |
| 9 | B6 | D8 | 816 | 236 | 4.32 |
| 10 | B7 | D9 | 814 | 169 | 3.82 |
| 11 | B9 | D10 | 817 | 328 | 6.61 |
| 12 | B10 | D11 | 820 | 248 | 2.94 |

Note: Throughout Tables, CGM and CTM denote charge generating material and charge transferring material respectively. Vs.p. denotes surface potential. $E_{1/2}$ denotes half-life light exposure.

TABLE 14

| Example No. | CGM | CTM | Vs.p. (V) | Potential after light Exposure (V) | $E_{1/2}$ (μJ/cm$^2$) |
|---|---|---|---|---|---|
| Multilayer | | | | | |
| Ex. | | | | | |
| 7 | B1 | A14 | −818 | −76 | 1.01 |
| 8 | B3 | A2 | −820 | −71 | 1.21 |
| 9 | B1 | A1 | −815 | −78 | 1.11 |
| 10 | B2 | A2 | −810 | −67 | 1.06 |
| 11 | B3 | A3 | −808 | −81 | 1.21 |
| 12 | B4 | A4 | −812 | −69 | 0.99 |
| 13 | B5 | A5 | −821 | −72 | 1.02 |
| 14 | B6 | A6 | −816 | −76 | 1.24 |
| 15 | B7 | A7 | −809 | −82 | 1.19 |
| 16 | B8 | A8 | −810 | −85 | 1.32 |
| 17 | B9 | A9 | −814 | −79 | 1.18 |
| 18 | B10 | A10 | −816 | −67 | 1.17 |
| Single layer | | | | | |
| Ex. | | | | | |
| 25 | B2 | A15 | 816 | 72 | 0.58 |
| 26 | B4 | A4 | 811 | 68 | 0.69 |

TABLE 14-continued

| Example No. | CGM | CTM | Vs.p. (V) | Potential after light Exposure (V) | $E_{1/2}$ (μJ/cm²) |
|---|---|---|---|---|---|
| 27 | B10 | A15 | 820 | 53 | 1.17 |
| 28 | B9 | A14 | 810 | 62 | 1.19 |
| 29 | B8 | A13 | 805 | 70 | 1.21 |
| 30 | B7 | A12 | 808 | 68 | 1.08 |
| 31 | B6 | A11 | 815 | 67 | 1.20 |
| 32 | B5 | A10 | 817 | 73 | 1.20 |
| 33 | B4 | A9 | 819 | 66 | 1.00 |
| 34 | B3 | A8 | 816 | 82 | 1.03 |
| 35 | B2 | A7 | 820 | 78 | 1.03 |
| 36 | B1 | A6 | 822 | 81 | 1.15 |

TABLE 15

| Results after 50,000 copies | | | | | |
|---|---|---|---|---|---|
| Example No. | CGM | CTM | Vs.p. (V) | Potential after light Exposure (V) | $E_{1/2}$ (μJ/cm²) |
| Multilayer | | | | | |
| Ex. 2 | B5 | A1 | −713 | −52 | 1.21 |
| Ex. 3 | B6 | A5 | −725 | −60 | 1.33 |
| Ex. 4 | B7 | A7 | −734 | −50 | 1.06 |
| Comp. Ex. 1 | B4 | D1 | −425 | −63 | 6.66 |
| Comp. Ex. 4 | B7 | D4 | −362 | −125 | 8.24 |
| Comp. Ex. 5 | B9 | D5 | −413 | −108 | 6.57 |
| Single-layer | | | | | |
| Ex. 21 | B6 | A7 | +718 | 43 | 0.72 |
| Ex. 22 | B7 | A5 | +733 | 60 | 0.61 |
| Ex. 23 | B9 | A1 | +735 | 57 | 0.63 |
| Comp. Ex. 7 | B4 | D6 | +325 | 83 | 3.69 |
| Comp. Ex. 8 | B5 | D7 | +402 | 126 | 5.16 |
| Comp. Ex. 9 | B6 | D8 | +393 | 120 | 6.29 |
| Multilayer | | | | | |
| Ex. 12 | B4 | A4 | −719 | −60 | 1.12 |
| Ex. 16 | B8 | A8 | −720 | −72 | 1.41 |
| Ex. 17 | B9 | A9 | −725 | −70 | 1.31 |
| Single-layer | | | | | |
| Ex. 27 | B10 | A15 | 708 | 57 | 1.30 |
| Ex. 31 | B6 | A11 | 722 | 60 | 1.31 |
| Ex. 33 | B4 | A9 | 730 | 72 | 1.25 |

As apparent from Tables 13 to 15, the photosensitive material obtained in each Comparative Example was inferior in sensitivity, and therefore generated fogs from initiation of copies. Even if output of the exposure lamp which is normally set in an electrostatic copying machine was maximized, the potential corresponding to a white ground was high, and fogs were generated. According to image confirmation after repeating copy, contrast potential was lowered due to fall of the surface potential, and image density was lowered.

Whilst, the photosensitive material obtained in each Example had an excellent sensitivity, and clear images were obtained under normal exposure intensity. Further, excellent images were obtained by repeated copies.

Example 37 (Single Layer-Type Photosensitive Material)

Together with the predetermined amounts of tetrahydrofuran, 3 parts by weight of the bis-azo pigment expressed by formula (B10) mentioned above, 5 parts by weight of the perylene pigment expressed by formula (P1) mentioned above, both which are charge generating materials, 50 parts by weight of the diamine compound expressed by formula (A9) mentioned above, 50 parts by weight of the hydrazone compound expressed by formula (C2) mentioned above, both which are charge transferring materials and 100 parts by weight of polycarbonate resin which is a binding resin are mixed and dispersed for 2 minutes by an ultrasonic dispersing device to prepare a coating solution for single-layer type photosensitive layer. The bis-azo pigment and the perylene pigment used were previously pulverized by a ball-mill.

The coating solution was applied to the surface of an aluminum sheet served as a conductive substrate by use of a bar-coat method using a wire bar, so that a layer having a thickness of 25 to 30 μm was prepared, and allowed to dry at 110° C. for 30 minutes. Thus, a sheet-type electrophotosensitive material having a single layer-type photosensitive layer was prepared.

Also, the coating solution was applied to the surface of an aluminum roll (outer diameter: 78 mm, length: 350 mm) served as a conductive substrate by use of a bar-coat method, so that a layer having a thickness of 25 to 30 μm was prepared, and allowed to dry at 110° C. for 30 minutes. Thus, a drum-type electrophotosensitive material having a single layer-type photosensitive layer was prepared.

Examples 38 to 20 and Comparative Examples 13 to 14

A sheet-type electrophotosensitive material and a drum-type electrophotosensitive material, both of which have single layer-type photosensitive layers were prepared in the same manner as for Example 37, except that the bis-azo pigment expressed by formula (B10) and the perylene pigment expressed by formula (P1) were mixed at a ratio shown in Table 16.

TABLE 16

| | Amounts (parts by weight) | |
|---|---|---|
| | Bis-azo pigment | Perylene pigment |
| Example No. | | |
| 37 | 3 | 5 |
| 38 | 4 | 4 |
| 39 | 5 | 3 |
| 40 | 6 | 2 |
| Comp. Ex. 13 | 8 | 0 |
| Comp. Ex. 14 | 6 | 0 |

The following tests were conducted on the electrophotosensitive material, of Examples 37 to 40 and Comparative Examples 13 to 14, and these properties were evaluated.

Measurement of Initial Surface Potential

With the surface of each sheet-type electrophotosensitive material charged at about +800 V by adjusting a pouring current value with an electrostatic test copier (EPA-8100 manufactured by Kawaguchi Electric Ltd.), the initial surface potential V s.p.(V) was measured.

Measurement of Residual Potential I

The sheet-type electrophotosensitive material maintaining a charged condition in measurement of the above initial surface potential was exposed at the condition that exposure intensity is 10 lux with the use of a white color-halogen lamp which is the light source for exposure, and the surface potential at a time 0.3 seconds from initiation of exposure was measured as residual potential V 1 r.p. (V).

Measurement of Residual potential II

After removing charge from the sheet-type electrophotosensitive material, which maintained a charged condition in measurement of the above initial surface potential, with the use of a white color-fluorescent lamp at exposure intensity of 100 lux and charge removing time of 1.0 second, the surface potential was measured as residual potential V 2 r.p. (V).

Durability Test

After measuring an initial surface potential V 1 s.p. (V) of the drum-type electrophotosensitive material prepared in each Example and Comparative Example in the same manner as for mentioned above, each photosensitive material was set in an electrostatic copying machine (DC-1657 manufactured by Mita Kogyo Co., Ltd.). After a process of charge-exposure-removal of charge was repeated 1,000 times, surface potential V 2 s.p. (V) was measured again. Thus, change amounts ΔV s.p. (v) of the surface potential were caluculated by the following formula to evaluate the durability of each electrophotosensitive material.

$$\Delta Vs.p.=V2s.p.-V1\ s.p.$$

These results are shown in Table 17.

TABLE 17

| Example No. | V s.p. (V) | V1 r.p. (V) | V2 r.p. (V) | ΔV s.p. (V) |
|---|---|---|---|---|
| Ex. 37 | 795 | 215 | 35 | −55 |
| 38 | 805 | 211 | 40 | −55 |

TABLE 17-continued

| Example No. | V s.p. (V) | V1 r.p. (V) | V2 r.p. (V) | ΔV s.p. (V) |
|---|---|---|---|---|
| 39 | 800 | 213 | 45 | −55 |
| 40 | 795 | 210 | 55 | −60 |
| Comparative | | | | |
| Ex. 13 | 805 | 205 | 80 | −70 |
| 14 | 800 | 215 | 90 | −70 |

From the results shown in Table 17, it was found that the electrophotosensitive material, of Examples 37 to 40 had higher sensitivity than those of Comparative Examples 13 and 14 wherein the bis-azo pigment was solely used, since when adjusted in almost the same surface potential (about 800 V), the electrophotosensitive materials of the Examples had nearly the same residual potential after exposure as those of the Comparative Examples, but showed the remarkably low residual potential after removing charge. Further, it was found that the electrophotosensitive materials of the Examples were excellent in durability in view of the low change amounts of the surface potential after repeating exposure.

Example 41

A sheet-type electrophotosensitive material and a drum-type electrophotosensitive material, each of which has a single layer type photosensitive layer, were prepared in the same manner as for Examples 37 to 40, except that 4 parts by weight of a bis-azo pigment expressed in the following formula (B11) were used instead of the bis-azo pigment expressed in (B10).

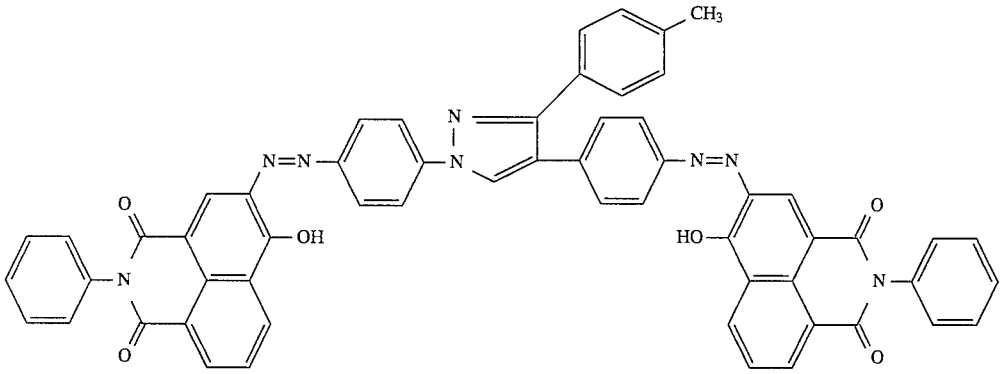

(B11)

Example 42

A sheet-type electrophotosensitive material and a drum-type electrophotosensitive material, each of which has a single layer type photosensitive layer, were prepared in the same manner as for Examples 38 to 20, except that 4 parts by weight of a bis-azo pigment expressed in the following formula (B12) were used instead of the bis-azo pigment expressed in (B10).

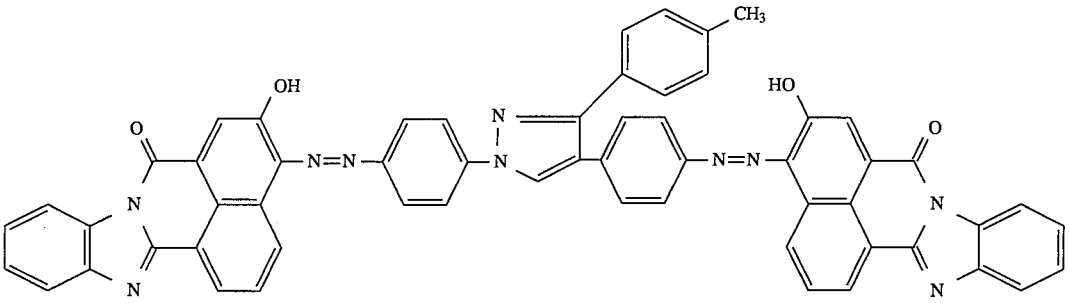

(B12)

Example 43

A sheet-type electrophotosensitive material and a drum-type electrophotosensitive material, each of which has a single layer type photosensitive layer, were prepared in the same manner as for Examples 37, except that 3 parts by weight of a bis-azo pigment expressed in the following formula (B13) were used instead of the bis-azo pigment expressed in (B10).

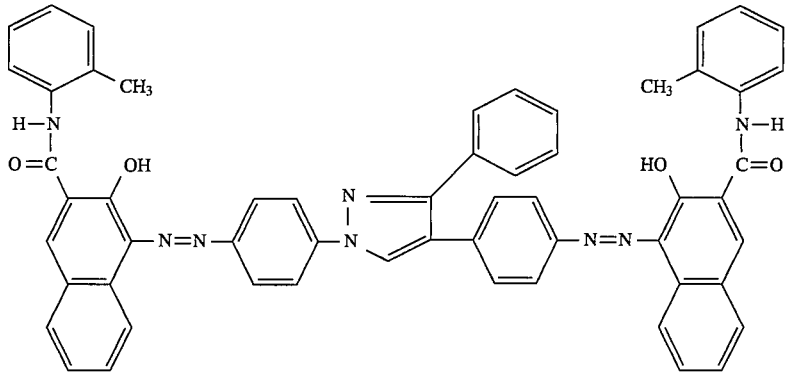

(B13)

Example 44

A sheet-type electrophotosensitive material and a drum-type electrophotosensitive material, each of which has a single layer type photosensitive layer, were prepared in the same manner as for Examples 37, except that among the charge generating materials, the amount, of the bis-azo pigment expressed in (B10) to be mixed were set in 6 parts by weight, and 1 part by weight of the perylene pigment expressed in the formula (P2) mentioned above was used instead of 5 parts by weight of the perylene pigment expressed in the formula (P1).

Example 45

A sheet-type electrophotosensitive material and a drum-type electrophotosensitive material, each of which has a single layer type photosensitive layer, were prepared in the same manner as for Examples 44, except that 1 part by weight of the perylene pigment expressed in the formula (P3) mentioned above was used instead of the perylene pigment expressed in the formula (P2).

Concerning the electrophotosensitive material of each Example, measurement, of both initial surface potential and residual potential II and the durability test were conducted in the same manner as mentioned above to evaluate the properties. Results are shown in Table 18.

TABLE 18

| Example No. | V s.p. (V) | V1 r.p. (V) | V2 r.p. (V) | ΔV s.p. (V) |
|---|---|---|---|---|
| Ex. 41 | 795 | 210 | 45 | −55 |
| 42 | 795 | 215 | 45 | −50 |
| 43 | 810 | 220 | 50 | −45 |
| 44 | 800 | 175 | 70 | −50 |
| 45 | 810 | 195 | 80 | −55 |

From the results shown in Table 18, it was found that the electrophotosensitive materials of Examples 41 to 45 had higher sensitivity than those of Comparative Examples 13 and 14 wherein the bis-azo pigment was solely used since when adjusted in almost the same surface potential (about 800 V), the electrophotosensitive materials of the Examples had nearly the same residual potential after exposure as those of the Comparative Examples, but showed the remarkably low residual potential after removing charge. Further, it was found that the electrophotosensitive materials of the Examples were excellent in durability in view of the low change amounts of the surface potential after repeating exposure.

Especially, it was found that Examples 44 and 45 were excellent in durability since the change amounts of the surface potential after repeating exposure was low. Further, it was expected that the sensitivity of each of Examples 44 and 45 was increased, if increasing the amounts of the perylene pigment to be contained to the same amounts as in Examples 41 to 43, since Examples 44 and 45 had low residual potential after removing charge and high sensitivity in spite of lower amount, of perylene than Examples 41 to 43.

Example 46

A sheet-type electrophotosensitive material and a drum-type electrophotosensitive material, each of which has a single layer type photosensitive layer, were prepared in the same manner as for Examples 37, except that among the charge generating materials, the amounts of the bis-azo pigment expressed in (B10) to be mixed were set in 6 parts by weight, and 1 part by weight of a dibromoanthanthrone having bromine atom as X in the above general formula (52) was used instead of 5 parts by weight of the perylene pigment expressed in the formula (P1).

Example 47

A sheet-type electrophotosensitive material and a drum-type electrophotosensitive material, each of which has a single layer type photosensitive layer, were prepared in the same manner as for Examples 46, except that 1 part by weight of a X-type metal-free phthalocyanine was used instead of the dibromoanthanthrone.

Example 48

A sheet-type electrophotosensitive material and a drum-type electrophotosensitive material, each of which has a single layer type photosensitive layer, were prepared in the same manner as for Examples 46, except that 1 part by weight of an imidazoleperylene having hydrogen atoms as $R^6$ and $R^7$ in the general formula (4) was used instead of the dibromoanthanthrone.

Example 49

A sheet-type electrophotosensitive material and a drum-type electrophotosensitive material, each of which has a single layer type photosensitive layer, were prepared in the same manner as for Examples 46, except that 1 part by weight of a perylene bis-azo pigment expressed in the following formula was used instead of the di-bromoanthanthrone.

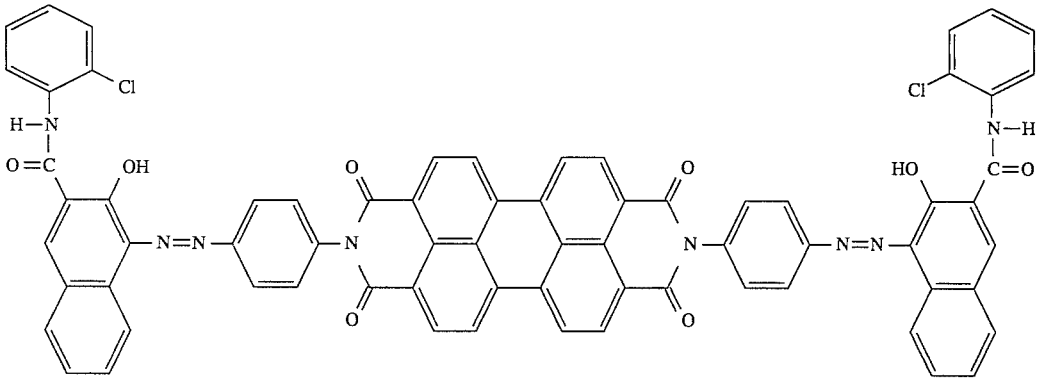

Concerning the electrophotosensitive material of each Example, measurements of both initial surface potential and residual potential II and the durability test were conducted in the same manner as mentioned above. Results are shown in Table 19 together with results of Comparative Example 14.

TABLE 19

| Example No. | V s.p. (V) | V2 r.p. (V) | ΔV s.p. (V) |
|---|---|---|---|
| Ex. 46 | 795 | 80 | −50 |
| 47 | 805 | 75 | −50 |
| 48 | 795 | 80 | −55 |
| 49 | 810 | 80 | −50 |
| Comparative | | | |
| Ex. 14 | 800 | 90 | −70 |

From the results shown in Table 19, it was found that the electrophotosensitive materials of Examples 46 to 49 had higher sensitivity than those of Comparative Example 14 wherein the bis-azo pigment was solely used, since when adjusted in almost the same surface potential (about 800 V), the electrophotosensitive materials of the Examples had the remarkably low residual potential after removing charge. Further, it was found that the electrophotosensitive materials of the Examples were excellent in durability, since the change amounts of the surface potential after repeating exposure was low.

Examples 50 to 60 and Comparative Examples 15 to 20 (Single Layer-Type Photosensitive Materials)

With a paint-shaker, each ingredient was dispersed for 2 hours. Then, solution, so obtained by dissolving a total of 10 parts by weight of polycarbonate and polyester as binding resins into 40 parts by weight of dichloromethane were added, and further dispersed for 1 hour, thereby to prepare coating solutions for single layer-type photosensitive layers. The solutions thus obtained were applied onto aluminum cylinders, respectively, by a dipping method, and dried at 100° C. for 30 minutes to obtain charge generating layers, each having a thickness of 25 μm. Thus, single layer-type electrophotosensitive materials being positive charge type were obtained. The bis-azo pigment, the diamine compound, the polycarbonate and the polyester used in each Example are shown in Table 20 by the compound-numbers given to the practical compound exemplified above, together with a ratio of polycarbonate/polyester.

| (Ingredients) | (parts by weight) |
|---|---|
| Bis-azo pigment (charge generating material) | 2 |
| Diamine compound (charge transferring material) | 8 |
| Diphenoquinone derivative | 2 |
| Dichloromethane | 70 |

As the Diphenoquinone derivative, TPDQ expressed in the above formula (E2) was used.

TABLE 20

| Example No. | Bis-azo pigment | Diamine compound | Poly-carbonate | Polyester | Ratio of Polycarbonate/ Polyester |
|---|---|---|---|---|---|
| Ex. | | | | | |
| 50 | B10 | A2 | L1 | M1 | 97/3 |
| 51 | B10 | A2 | L2 | M1 | 90/10 |
| 52 | B10 | A2 | L3 | M1 | 85/15 |
| 53 | B10 | A2 | L4 | M1 | 80/20 |
| 54 | B10 | A2 | L5 | M1 | 70/30 |
| 55 | B10 | A2 | L6 | M1 | 60/40 |
| 56 | B10 | A2 | L7 | M1 | 50/50 |
| 57 | B11 | A4 | L1 | M2 | 96/4 |
| 58 | B11 | A4 | L2 | M3 | 96/4 |
| 59 | B11 | A4 | L3 | M4 | 96/4 |
| 60 | B11 | A4 | L4 | M5 | 96/4 |
| Comparative Ex. | | | | | |
| 15 | B11 | A4 | L3 | — | 100/0 |
| 16 | B11 | A4 | L3 | M1 | 20/80 |
| 17 | B11 | A4 | L1 | M6 | 70/30 |
| 18 | B11 | A4 | L1 | M7 | non-compatible |
| 19 | B11 | A4 | L1 | M8 | non-compatible |
| 20 | B11 | A4 | L1 | M9 | 96/4 |

In Table 20, polyesters shown by marks (M6) to (M9) which were used in Comparative Examples 17 to 20 are compounds shown in Table 21. The marks of acid component and diol component in Table 21 shows the same compounds as mentioned above.

TABLE 21

| Poly-ester | Acid component | Diol component | Number-average molecular weight Mn | Acid value (KOH mg/g) |
|---|---|---|---|---|
| M 6 | (55) | (64) | 29000 | 1 |
| M 7 | (58) u = 4<br>(58) u = 7 | (60) v = 2<br>(62) | 25000 | 2 |
| M 8 | (55)<br>(58) u = 4 | (60) v = 2 | 36000 | 1 |
| M 9 | (55)<br>(56) | (60) v = 2<br>(62) | 15000 | 7 |

Examples 61 to 65 and Comparative Examples 21 to 22 (Multilayer-Type Photosensitive Materials)

With a paint-shaker, 1 part of weight of bis-azo pigment and 40 parts of weight of cyclohexanone were dispersed for 2 hours. Then, 20 parts of weight of 10% cyclohexanone solutions of vinyl chloride-vinyl acetate copolymer were added, and further dispersed for 2 hours. The dispersed liquids thus obtained were applied onto aluminum cylinders, respectively, and dried to obtain charge generating layers, each having a thickness of 0.5 μm.

To the obtained charge generating layers, the solution, of compositions for preparing charge transferring layers, which consist of ingredients mentioned below, were applied with a dipping method, and allowed to dry at 100° C. for 1 hour, thereby to prepare charge transferring layers, each having a thickness of 23 μm. Thus, multilayer-type electrophotosensitive materials being negative charge type were obtained. The bis-azo pigment, the diamine compound, the polycarbonate and the polyester used in each Example are shown in Table 22 by the compound-numbers given to the practical compound exemplified above, together with a ratio of polycarbonate/polyester.

| (Ingredients) | (parts by weight) |
|---|---|
| Diamine compound (charge-transferring material) | 80 |
| Diphenoquinone derivative (TPDQ mentioned above) | 20 |
| Binding resin | 100 |
| Dichloromethane | 400 |

TABLE 22

| Example No. | Bis-azo pigment | Diamine compound | Poly-carbonate | Polyester | Ratio of Polycarbonate/ Polyester |
|---|---|---|---|---|---|
| Ex. 61 | B9 | A13 | L1 | M1 | 96/4 |
| 62 | B9 | A13 | L2 | M2 | 90/10 |
| 63 | B9 | A13 | L3 | M3 | 80/20 |
| 64 | B9 | A13 | L4 | M4 | 70/30 |
| 65 | B9 | A13 | L5 | M5 | 60/40 |
| Comparative | | | | | |
| Ex. 21 | B9 | A13 | L1 | M6 | 50/50 |
| 22 | B9 | A13 | L2 | M9 | 95/5 |

The electrical and repetitive property tests were conducted on Examples 50 to 65 and Comparative Examples 15 to 22 in the same manner as for Example 1. Furthermore, the property was tested by a method mentioned below to evaluate its property.

Adhesive Property

In accordance with the checkboard-square test described in JIB K 5400, adhesive properties of photosensitive layers were evaluated.

These test results are shown in Tables 23 to 24.

TABLE 23

| | | Initiation | | | After 50,000 continuous copies | | |
|---|---|---|---|---|---|---|---|
| Example No. | Adhesive property (%) | V s.p. (V) | Potential after light exposure (V) | $E_{1/2}$ ($\mu J/cm^2$) | V s.p. (V) | Potential after light exposure (V) | $E_{1/2}$ ($\mu J/cm^2$) |
| Ex. 50 | 86 | 800 | 50 | 5.3 | 680 | 70 | 5.6 |
| 51 | 85 | 810 | 30 | 4.7 | 670 | 50 | 5.0 |
| 52 | 90 | 800 | 50 | 5.6 | 655 | 50 | 5.9 |
| 53 | 83 | 805 | 40 | 5.8 | 720 | 55 | 5.8 |
| 54 | 87 | 800 | 55 | 5.2 | 730 | 60 | 5.0 |
| 55 | 90 | 810 | 50 | 4.9 | 710 | 55 | 4.9 |
| 56 | 98 | 800 | 40 | 5.3 | 700 | 60 | 5.5 |
| 57 | 90 | 800 | 30 | 5.2 | 715 | 45 | 5.3 |
| 58 | 85 | 805 | 50 | 5.6 | 710 | 55 | 5.9 |
| 59 | 88 | 805 | 45 | 5.2 | 690 | 60 | 5.4 |
| 60 | 90 | 810 | 35 | 4.9 | 675 | 50 | 5.2 |
| Comparative Ex. | | | | | | | |
| 15 | 5 | 800 | 35 | 5.0 | 690 | 50 | 5.1 |
| 16 | 100 | 805 | 40 | 4.6 | — | — | — |
| 17 | 15 | 800 | 40 | 5.8 | — | — | — |
| 18 | — | — | — | — | — | — | — |
| 19 | — | — | — | — | — | — | — |
| 20 | 100 | 810 | 45 | 4.9 | 350 | 55 | 7.3 |

TABLE 24

| | | Initiation | | | After 50,000 continuous copies | | |
|---|---|---|---|---|---|---|---|
| Example No. | Adhesive property (%) | V s.p. (V) | Potential after light exposure (V) | $E_{1/2}$ ($\mu J/cm^2$) | V s.p. (V) | Potential after light exposure (V) | $E_{1/2}$ ($\mu J/cm^2$) |
| Ex. 61 | 90 | −800 | −40 | 5.6 | −710 | 45 | 5.9 |
| 62 | 85 | −805 | −50 | 5.2 | −670 | −55 | 6.0 |
| 63 | 90 | −800 | −45 | 5.3 | −655 | −60 | 5.8 |
| 64 | 83 | −810 | −55 | 5.6 | −690 | −55 | 6.2 |

TABLE 24-continued

| Example No. | Adhesive property (%) | Initiation V s.p. (V) | Initiation Potential after light exposure (V) | Initiation $E_{1/2}$ (μJ/cm²) | After 50,000 continuous copies V s.p. (V) | After 50,000 continuous copies Potential after light exposure (V) | After 50,000 continuous copies $E_{1/2}$ (μJ/cm²) |
|---|---|---|---|---|---|---|---|
| 54 | 90 | −810 | −40 | 5.4 | −680 | −60 | 6.1 |
| Comparative Ex. | | | | | | | |
| 21 | 5 | −800 | −55 | 4.9 | — | — | — |
| 22 | 100 | −805 | −40 | 5.1 | −260 | −40 | 8.7 |

As apparent from these Tables, Comparative Example 15 not having polyester was remarkably low in adhesive property. Comparative Example 16 wherein the amounts of polyester to be contained were sharply in excess of 50% by weight was insufficient in intensity of the photosensitive layer, so that portions pressed by a cleaning blade were depressed, thereby to generate inferior images from about 5000 copies, and measurements after 50,000 continuous copies cannot be conducted.

Comparative Example 17 using the polyester of (M6) wherein groups $A^3$ and $A^4$ in Formula (50) include aromatic rings was inferior in adhesive property. Hence, release of photosensitive layer from developing seal portion was generated at about 18,000 copies, and measurements after 50,000 continuous copies cannot be conducted.

Comparative Example 21 similarly using the polyester of (M6) was inferior in adhesive property. Hence, release in the interface between the charge generating layer and the charge transferring layer is generated in about 30,000 copies, and measurements after 50,000 continuous copies cannot be conducted.

In Comparative Examples 18 and 19 using the polyesters wherein groups $A^3$ and $A^4$ do not include aromatic rings, polyester and polycarbonate were not compatible to each other. Hence, uniform photosensitive layers cannot be obtained, and the above tests cannot be conducted.

Comparative Examples 20 and 22 using the polyester, of (M9) wherein acid values were in excess of 2 were superior in the adhesive property, but the surface potentials after 50,000 continuous copies were remarkably lowered, and the half-life light exposures were remarkably increased.

On the other hand, the photosensitive material of each Example was excellent in the adhesive property, and has a high sensitivity. Further, clear images were obtained at a normal intensity of light exposure, and good images were obtained after repeating copy.

Examples 66 to 71 (Multilayer-Type Photosensitive Materials)

With a paint-shaker using glass beads (diameter: 2 mm), 0.7 parts by weight of bis-azo pigment as the charge generating material and 1 parts by weight of polyvinyl butylal and a certain amount of tetrahydrofuran were dispersed for 2 hours. Dispersed liquids thus obtained were applied onto aluminum rolls by use of a dipping method, respectively, and dried at 100° C. for 1 hour to obtain a charge generating layers, each having a thickness of 0.5 μm.

Solutions obtained by dissolving 1 parts by weight of diamine compound as the charge-transferring material and 1 parts by weight of bisphenol A type polycarbonate resins into a certain of dichloromethane, and adding an oligomer-type amine antioxidants and phenol antioxidants as a stabilzer at the ratios shown in Table 25, were applied to the charge generating layers by use of a dipping method, and allowed to dry at 100° C. for 1 hour, thereby to prepare charge transferring layers, each having a thickness of 22 μm.

Thus, multilayer-type electrophotosensitive materials being negative charge type were obtained. The charge generating material and the charge-transferring material used in each Example are shown in Table 25 by the compound-numbers given to the practical compound exemplified above.

Comparative Examples 23 to 28 (Multilayer-Type Photosensitive Materials)

Multilayer-type electrophotosensitive materials being negative charge type were obtained in the same manner as for Examples 66 to 71, except that compounds expressed in formulas (K1) to (K5) and (K11), which were the same as used in Comparative Examples 1 to 3 and 4 to 6, instead of the diamine compounds used in Examples 66 to 71, and that the stabilizers were not added.

TABLE 25

| Example No. | Multilayer-type Photosensitive materials CGM | CTM | Amine antioxidant Kind | Amine antioxidant Amount (parts by weight) | Phenol antioxidant Kind | Phenol antioxidant Amount (parts by weight) |
|---|---|---|---|---|---|---|
| Ex. 66 | B1 | A1 | F1 | 20 | G2 | 20 |
| Ex. 67 | B2 | A2 | F1 | 10 | G4 | 10 |
| Ex. 68 | B3 | A3 | F1 | 5 | G6 | 20 |
| Ex. 69 | B4 | A4 | F3 | 20 | G3 | 10 |
| Ex. 70 | B5 | A5 | F3 | 10 | G5 | 20 |
| Ex. 71 | B6 | A6 | F3 | 5 | G1 | 10 |
| Comparative Ex. 23 | B1 | K1 | — | — | — | — |

TABLE 25-continued

| Multilayer-type Photosensitive materials | | | | | | |
|---|---|---|---|---|---|---|
| | | | Amine antioxidant | | Phenol antioxidant | |
| Example No. | CGM | CTM | Kind | Amount (parts by weight) | Kind | Amount (parts by weight) |
| Comparative Ex. 24 | B2 | K2 | — | — | — | — |
| Comparative Ex. 25 | B3 | K3 | — | — | — | — |
| Comparative Ex. 26 | B4 | K4 | — | — | — | — |
| Comparative Ex. 27 | B5 | K5 | — | — | — | — |
| Comparative Ex. 28 | B6 | K11 | — | — | — | — |

Examples 72 to 77 (Single Layer-Type Photosensitive Materials)

Together with dichloromethane, 3 parts by weight of bis-azo pigment as the charge generating material, 75 parts by weight of diamine compound as the charge transferring material, 100 parts by weight of bisphenol A type polycarbonate, and the oligomer-type amine antioxidant and phenol antioxidant as the stabilizer at the ratios shown in Table 26 were dispersed for 2 minutes by an ultrasonic dispersing device, thereby to prepare coating liquids for single-layer type photosensitive layers. The coating liquids were applied onto the surface of each aluminum roll by use of a dipping method, and allowed to dry at 80° C. for 120 minutes, thereby to prepare single-layer type photosensitive layer, each having a thickness of 30 μm. Thus, single layer-type electrophotosensitive materials being positive charge type were obtained. The charge generating material and the charge-transferring material used in each Example are shown in Table 26 by the compound-numbers given to the practical compound exemplified above.

Comparative Examples 29 to 34 (Single Layer-Type Photosensitive Materials)

Single layer-type electrophotosensitive materials being positive charge type were obtained in the same manner as for Examples 72 to 77, except that compounds expressed in formulas (K6) to (K11), which were the same as used in Comparative Examples 7 to 12, instead of the diamine compounds used in Examples 72 to 77, and that the stabilizers were not added.

TABLE 26

| Single layer-type Photosensitive materials | | | | | | |
|---|---|---|---|---|---|---|
| | | | Amine antioxidant | | Phenol antioxidant | |
| Example No. | CGM | CTM | Kind | Amount (parts by weight) | Kind | Amount (parts by weight) |
| Ex. 72 | B3 | A7 | F1 | 10 | G1 | 3 |
| Ex. 73 | B9 | A8 | F2 | 7 | G2 | 5 |
| Ex. 74 | B10 | A4 | F3 | 3 | G3 | 10 |
| Ex. 75 | B6 | A9 | F4 | 10 | G4 | 15 |
| Ex. 76 | B7 | A2 | F5 | 7 | G5 | 20 |
| Ex. 77 | B8 | A10 | F6 | 3 | G6 | 25 |
| Comparative Ex. 29 | B9 | K6 | — | — | — | — |
| Comparative Ex. 30 | B10 | K7 | — | — | — | — |
| Comparative Ex. 31 | B6 | K8 | — | — | — | — |
| Comparative Ex. 32 | B7 | K9 | — | — | — | — |
| Comparative Ex. 33 | B8 | K10 | — | — | — | — |
| Comparative Ex. 34 | B6 | K11 | — | — | — | — |

Tests of electrical and repetitive properties were conducted on the electrophotosensitive material of each Example and Comparative Example in the same method as in Examples 1 to 3 to evaluate these properties. In measurement of the half-life light exposure, however, the intensity of light to be exposed was set at 0.2 mW/cm$^2$, and the repetitive property was evaluated in 10,000 copies. Test results are shown in Tables 27 and 28.

TABLE 27

| Example No. | V s.p. (V) | Potential after light exposure (V) | Half-life light exposure (μJ/cm$^2$) |
|---|---|---|---|
| Multilayer | | | |
| Ex. 66 | −825 | −85 | 1.42 |
| Ex. 67 | −830 | −78 | 1.65 |
| Ex. 68 | −821 | −79 | 1.22 |
| Ex. 69 | −818 | −92 | 1.36 |
| Ex. 70 | −820 | −86 | 1.75 |
| Ex. 71 | −809 | −84 | 1.43 |
| Comparative Ex. 23 | −823 | −152 | 5.44 |
| Comparative Ex. 24 | −818 | −334 | 6.54 |
| Comparative Ex. 25 | −821 | −305 | 7.11 |
| Comparative Ex. 26 | −806 | −250 | 5.94 |
| Comparative Ex. 27 | −813 | −271 | 7.64 |
| Comparative Ex. 28 | −816 | −231 | 6.02 |
| Single layer | | | |
| Ex. 72 | 815 | 78 | 1.08 |
| Ex. 73 | 813 | 82 | 1.25 |
| Ex. 74 | 821 | 86 | 1.41 |

TABLE 27-continued

| Example No. | V s.p. (V) | Potential after light exposure (V) | Half-life light exposure (μJ/cm²) |
|---|---|---|---|
| Ex. 75 | 815 | 88 | 1.86 |
| Ex. 76 | 820 | 85 | 1.09 |
| Ex. 77 | 808 | 87 | 1.29 |
| Comparative Ex. 29 | 811 | 178 | 5.10 |
| Comparative Ex. 30 | 805 | 213 | 4.91 |
| Comparative Ex. 31 | 816 | 252 | 5.94 |
| Comparative Ex. 32 | 824 | 187 | 5.81 |
| Comparative Ex. 33 | 812 | 353 | 16.2 |
| Comparative Ex. 34 | 805 | 265 | 6.73 |

TABLE 28

| Results after repeating 10,000 copies | | | |
|---|---|---|---|
| Example No. | V s.p. (V) | Potential after light exposure (V) | Half-life light exposure μJ/cm²) |
| Multilayer | | | |
| Ex. 68 | −735 | −74 | 1.32 |
| Ex. 69 | −760 | −75 | 1.48 |
| Ex. 70 | −749 | −81 | 1.72 |
| Comparative Ex. 23 | −423 | −46 | 4.76 |
| Comparative Ex. 26 | −379 | −106 | 3.72 |
| Comparative Ex. 27 | −563 | −42 | 3.19 |
| Single layer | | | |
| Ex. 74 | +718 | 56 | 1.61 |
| Ex. 75 | +742 | 57 | 1.75 |
| Ex. 76 | +753 | 65 | 1.31 |
| Comparative Ex. 29 | +525 | 103 | 5.21 |
| Comparative Ex. 30 | +434 | 128 | 4.75 |
| Comparative Ex. 31 | +521 | 190 | 6.08 |

As apparent from Tables 27 and 28, photosensitive material, so obtained in Comparative Examples 23 to 28 and 29 to 34 were inferior in sensitivity, and as a result, fogs were generated from an early stage of copying. Specifically, even if output of a light exposure lamp normally set in an electrostatic copying machine was maximized, fogs were generated, since a potential corresponding to a white ground is high. Also, according to image confirmation conducted after repeating copies, contrast potentials became small due to lowering of surface potentials, and image densities were lowered.

On the contrary, photosensitive materials of each Example had a high sensitivity, and clear images were obtained under normal light-exposure intensity.

Examples 78 to 83 Multilayer-Type Photosensitive Materials) and Examples 84 to 89 (Single Layer-Type Photosensitive Materials)

Multilayer-type and single layer-type electrophotosensitive materials were obtained in the same manner as for Examples 66 to 71 and 72 to 77, except that compounds shown in Tables 29 and 30 were used as the charge generating material, charge transferring material and the stabilizers.

TABLE 29

| Multilayer-type photosensitive materials | | | | | | |
|---|---|---|---|---|---|---|
| | | | Amine antioxidant | | Benzotriazole | |
| Example No. | CGM | CTM | Kind | Amount (parts by weight) | Kind | Amount (parts by weight) |
| Ex. | | | | | | |
| 78 | B1 | A1 | F1 | 20 | I1 | 10 |
| 79 | B2 | A2 | F1 | 10 | I2 | 10 |
| 80 | B3 | A3 | F1 | 5 | I3 | 10 |
| 81 | B4 | A4 | F3 | 20 | I4 | 20 |
| 82 | B5 | A5 | F3 | 10 | I5 | 20 |
| 83 | B6 | A6 | F3 | 5 | I6 | 20 |

TABLE 30

| Single layer-type photosensitive materials | | | | | | |
|---|---|---|---|---|---|---|
| | | | Amine antioxidant | | Benzotriazole | |
| Example No. | CGM | CTM | Kind | Amount (parts by weight) | Kind | Amount (parts by weight) |
| Ex. | | | | | | |
| 84 | B3 | A7 | F1 | 10 | I2 | 10 |
| 85 | B9 | A8 | F2 | 7 | I3 | 10 |
| 86 | B10 | A4 | F3 | 3 | I4 | 10 |
| 87 | B6 | A9 | F4 | 10 | I5 | 20 |
| 88 | B7 | A2 | F5 | 7 | I6 | 20 |
| 89 | B8 | A10 | F6 | 3 | I7 | 20 |

Examples 90 to 95 (Multilayer-Type Photosensitive Materials) and Examples 96 to 101 (Single Layer-Type Photosensitive Materials)

Multilayer-type and single layer-type electrophotosensitive materials were obtained in the same manner as for Examples 66 to 71 and 72 to 77, except that compounds shown in Tables 31 and 32 were used as the charge generating material, charge-transferring material and the stabilizers.

TABLE 31

| Multilayer-type photosensitive materials | | | | | | |
|---|---|---|---|---|---|---|
| | | | Amine antioxidant | | Amine compound | |
| Example No. | CGM | CTM | Kind | Amount (parts by weight) | Kind | Amount (parts by weight) |
| Ex. | | | | | | |
| 90 | B1 | A1 | F1 | 20 | H1 | 2 |
| 91 | B2 | A2 | F1 | 10 | H2 | 2 |
| 92 | B3 | A3 | F1 | 5 | H3 | 2 |
| 93 | B4 | A4 | F3 | 20 | H4 | 5 |

TABLE 31-continued

| Multilayer-type photosensitive materials | | | | | | |
|---|---|---|---|---|---|---|
| | | | Amine antioxidant | | Amine compound | |
| Example No. | CGM | CTM | Kind | Amount (parts by weight) | Kind | Amount (parts by weight) |
| 94 | B5 | A5 | F3 | 10 | H5 | 5 |
| 95 | B6 | A6 | F3 | 5 | H6 | 5 |

TABLE 32

| Single-layer-type photosensitive materials | | | | | | |
|---|---|---|---|---|---|---|
| | | | Amine antioxidant | | Amine compound | |
| Example No. | CGM | CTM | Kind | Amount (parts by weight) | Kind | Amount (parts by weight) |
| Ex. | | | | | | |
| 96 | B3 | A7 | F1 | 10 | H7 | 5 |
| 97 | B9 | A8 | F2 | 7 | H1 | 5 |
| 98 | B10 | A4 | F3 | 3 | H2 | 5 |
| 99 | B6 | A9 | F4 | 10 | H3 | 10 |
| 100 | B7 | A2 | F5 | 7 | H4 | 10 |
| 101 | B8 | A10 | F6 | 3 | H5 | 10 |

Tests of electrical and repetitive properties were conducted on Examples 78 to 83, 90 to 95 and Examples 84 to 89, 96 to 101 in the same manners as mentioned above, and these test results are shown in Tables 33 and 34, respectively.

TABLE 33

| Example No. | Vs. p. (V) | Potential after light exposure (V) | Half-life light exposure (μJ/cm²) |
|---|---|---|---|
| Multilayer Ex. | | | |
| 78 | −815 | −92 | 1.45 |
| 79 | −821 | −86 | 1.72 |
| 80 | −806 | −88 | 1.32 |
| 81 | −813 | −80 | 1.56 |
| 82 | −820 | −96 | 1.73 |
| 83 | −808 | −80 | 1.61 |
| 90 | −815 | −82 | 1.29 |
| 91 | −815 | −85 | 1.55 |
| 92 | −817 | −73 | 1.62 |
| 93 | −809 | −88 | 1.49 |
| 94 | −810 | −80 | 1.75 |
| 95 | −820 | −93 | 1.88 |
| Single layer Ex. | | | |
| 84 | 805 | 90 | 1.16 |
| 85 | 815 | 95 | 1.29 |
| 86 | 820 | 97 | 1.31 |
| 87 | 816 | 92 | 1.29 |
| 88 | 812 | 94 | 1.22 |
| 89 | 809 | 103 | 1.18 |
| 96 | 815 | 92 | 1.21 |
| 97 | 816 | 86 | 1.33 |
| 98 | 802 | 87 | 1.26 |
| 99 | 818 | 98 | 1.19 |

TABLE 33-continued

| Example No. | Vs. p. (V) | Potential after light exposure (V) | Half-life light exposure (μJ/cm²) |
|---|---|---|---|
| 100 | 820 | 102 | 1.32 |
| 101 | 825 | 90 | 1.28 |

TABLE 34

| Results after repeating 10,000 copies | | | |
|---|---|---|---|
| Example No. | Vs. p. (V) | Potential after light exposure (V) | Half-life light exposure (μJ/cm²) |
| Multilayer Ex. | | | |
| 80 | −713 | −62 | 1.45 |
| 81 | −721 | −57 | 1.62 |
| 82 | −734 | −71 | 1.84 |
| 92 | −725 | −65 | 1.76 |
| 93 | −735 | −62 | 1.53 |
| 94 | −715 | −47 | 1.82 |
| Single layer Ex. | | | |
| 86 | 733 | 90 | 1.42 |
| 87 | 750 | 88 | 1.36 |
| 88 | 715 | 80 | 1.40 |
| 98 | 720 | 90 | 1.32 |
| 99 | 719 | 82 | 1.33 |
| 100 | 709 | 95 | 1.50 |

From these test results, it was found that photosensitive material of each Example had a high sensitivity, clear images were obtained under normal light-exposure intensity, and excellent images were obtained after repeated copying.

Examples 102 to 131 (Multilayer-Type Photosensitive Materials)

With a paint-shaker using glass beads (diameter: 2 mm), 0.7 parts by weight of bis-azo pigment as the charge generating material and 1 part by weight of polyvinyl butylal and a certain amount of tetrahydrofuran were dispersed for 2 hours. Dispersed liquids thus obtained were applied onto aluminum rolls by use of a dipping method, and dried at 100° C. for 1 hour to obtain a charge generating layers, each having a thickness of 0.5 μm.

Solutions obtained by dissolving 1 part by weight of diamine compound as the charge-transferring material and 1 part by weight of bisphenol A type polycarbonate resins into a certain amount of dichloromethane, and adding stabilzers of combination shown in Tables 35 to 40 at the ratios shown in these Tables, were applied onto the charge generating layers by use of a dipping method, and allowed to dry at 100 ° C. for 1 hour, thereby to prepare charge transferring layers, each having a thickness of 22 μm. Thus, multilayer-type electrophotosensitive materials being negative charge type were obtained. The charge generating material and the charge-transferring material used in each Example are shown in Tables 35 to 40 by the compound-numbers given to the practical compound exemplified above.

TABLE 35

| Multilayer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Benzotriazole UV absorber | |
| Example No. | Charge-generating material | Charge transfer-ring material | Kind | Amount (parts by weight) | Kind | Amount (parts by weight) | Kind | Amount (parts by weight) |
| 102 | B1 | A3 | F3 | 2 | H4 | 10 | I7 | 20 |
| 103 | B2 | A3 | F3 | 2 | H4 | 10 | I6 | 20 |
| 104 | B3 | A3 | F3 | 2 | H4 | 10 | I5 | 20 |
| 105 | B4 | A3 | F3 | 2 | H4 | 10 | I4 | 20 |
| 106 | B5 | A3 | F3 | 2 | H4 | 10 | I3 | 20 |

TABLE 36

| Multilayer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transfer-ring material | Kind | Amount (parts by weight) | Kind | Amount (parts by weight) | Kind | Amount (parts by weight) |
| 107 | B1 | A1 | F1 | 2 | H3 | 10 | G25 | 5 |
| 108 | B2 | A1 | F1 | 2 | H3 | 10 | G26 | 5 |
| 109 | B3 | A1 | F1 | 2 | H3 | 10 | G27 | 5 |
| 110 | B4 | A1 | F1 | 2 | H3 | 10 | G28 | 5 |
| 111 | B5 | A1 | F1 | 2 | H3 | 10 | G29 | 5 |

TABLE 37

| Multilayer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transfer-ring material | Kind | Amount (parts by weight) | Kind | Amount (parts by weight) | Kind | Amount (parts by weight) |
| 112 | B1 | A5 | F2 | 2 | H2 | 10 | G17 | 10 |
| 113 | B2 | A5 | F2 | 2 | H2 | 10 | G18 | 10 |
| 114 | B3 | A5 | F2 | 2 | H2 | 10 | G19 | 10 |
| 115 | B4 | A5 | F2 | 2 | H2 | 10 | G20 | 10 |
| 116 | B5 | A5 | F2 | 2 | H2 | 10 | G21 | 10 |

TABLE 38

| Multilayer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transferring material | Kind | Amount (parts by weight) | Kind | Amount (parts by weight) | Kind | Amount (parts by weight) |
| 117 | B1 | A7 | F5 | 2 | H1 | 10 | G7 | 3 |
| 118 | B2 | A7 | F5 | 2 | H1 | 10 | G8 | 3 |
| 119 | B3 | A7 | F5 | 2 | H1 | 10 | G9 | 3 |
| 120 | B4 | A7 | F5 | 2 | H1 | 10 | G10 | 3 |
| 121 | B5 | A7 | F5 | 2 | H1 | 10 | G11 | 3 |

TABLE 39

| Multilayer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Piperidine antioxidant | |
| Example No. | Charge-generating material | Charge-transferring material | Kind | Amount (parts by weight) | Kind | Amount (parts by weight) | Kind | Amount (parts by weight) |
| 122 | B1 | A11 | F4 | 2 | H6 | 10 | J1 | 7 |
| 123 | B2 | A11 | F4 | 2 | H6 | 10 | J2 | 7 |
| 124 | B3 | A11 | F4 | 2 | H6 | 10 | J3 | 7 |
| 125 | B4 | A11 | F4 | 2 | H6 | 10 | J4 | 7 |
| 126 | B5 | A11 | F4 | 2 | H6 | 10 | J5 | 7 |

TABLE 40

| Multilayer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transferring material | Kind | Amount (parts by weight) | Kind | Amount (parts by weight) | Kind | Amount (parts by weight) |
| 127 | B1 | A2 | F6 | 2 | H5 | 10 | G1 | 15 |
| 128 | B2 | A2 | F6 | 2 | H5 | 10 | G2 | 15 |
| 129 | B3 | A2 | F6 | 2 | H5 | 10 | G3 | 15 |
| 130 | B4 | A2 | F6 | 2 | H5 | 10 | G4 | 15 |
| 131 | B5 | A2 | F6 | 2 | H5 | 10 | G5 | 15 |

Examples 132 to 161 (Single Layer-Type Photosensitive Materials)

Together with dichloromethane, 3 parts by weight of bis-azo pigment as the charge generating material, 75 parts by weight of diamine compound as the charge transferring material, 100 parts by weight of bisphenol A type polycarbonate, and a certain amount of stabilizer shown in Tables 41 to 46 were dispersed for 2 minutes by an ultrasonic dispersing device, thereby to prepare coating liquids for single-layer type photosensitive layers. The coating liquids were applied onto the surface of each aluminum roll by use of a dipping method, and allowed to dry at 80° C. for 120 minutes, thereby to prepare single-layer type photosensitive layer, each having a thickness of 30 μm.

Thus, single layer-type electrophotosensitive materials being positive charge type were obtained. The charge generating material, the charge-transferring material and the stabilizer used in each Example are shown in Tables 41 to 46 by the compound-numbers given to the practical compound exemplified above.

TABLE 41

| Single layer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Benzotriazole UV absorber | |
| Example No. | Charge-generating material | Charge transfer-ring material | Kind | Amount (parts by weight) | Kind | Amount (parts by weight) | Kind | Amount (parts by weight) |
| 132 | B6 | A9 | F3 | 5 | H4 | 3 | I1 | 10 |
| 133 | B7 | A9 | F3 | 5 | H4 | 3 | I6 | 10 |
| 134 | B8 | A9 | F3 | 5 | H4 | 3 | I5 | 10 |
| 135 | B9 | A9 | F3 | 5 | H4 | 3 | I4 | 10 |
| 136 | B10 | A9 | F3 | 5 | H4 | 3 | I3 | 10 |

TABLE 42

| Single layer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transfer-ring material | Kind | Amount (parts by weight) | Kind | Amount (parts by weight) | Kind | Amount (parts by weight) |
| 137 | B6 | A13 | F1 | 5 | H3 | 3 | G25 | 10 |
| 138 | B7 | A13 | F1 | 5 | H3 | 3 | G26 | 10 |
| 139 | B8 | A13 | F1 | 5 | H3 | 3 | G27 | 10 |
| 140 | B9 | A13 | F1 | 5 | H3 | 3 | G28 | 10 |
| 141 | B10 | A13 | F1 | 5 | H3 | 3 | G29 | 10 |

TABLE 43

| Single layer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transfer-ring material | Kind | Amount (parts by weight) | Kind | Amount (parts by weight) | Kind | Amount (parts by weight) |
| 142 | B6 | A4 | F2 | 5 | H2 | 3 | G17 | 5 |
| 143 | B7 | A4 | F2 | 5 | H2 | 3 | G18 | 5 |
| 144 | B8 | A4 | F2 | 5 | H2 | 3 | G19 | 5 |
| 145 | B9 | A4 | F2 | 5 | H2 | 3 | G20 | 5 |
| 146 | B10 | A4 | F2 | 5 | H2 | 3 | G21 | 5 |

TABLE 44

| Single layer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transfer-ring material | Kind | Amount (parts by weight) | Kind | Amount (parts by weight) | Kind | Amount (parts by weight) |
| 147 | B6 | A5 | F5 | 5 | H1 | 3 | G7 | 5 |
| 148 | B7 | A5 | F5 | 5 | H1 | 3 | G8 | 5 |
| 149 | B8 | A5 | F5 | 5 | H1 | 3 | G9 | 5 |
| 150 | B9 | A5 | F5 | 5 | H1 | 3 | G10 | 5 |
| 151 | B10 | A5 | F5 | 5 | H1 | 3 | G11 | 5 |

TABLE 45

| Single layer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Piperidine antioxidant | |
| Example No. | Charge-generating material | Charge-transfer-ring material | Kind | Amount (parts by weight) | Kind | Amount (parts by weight) | Kind | Amount (parts by weight) |
| 152 | B6 | A14 | F4 | 5 | H6 | 3 | J1 | 3 |
| 153 | B7 | A14 | F4 | 5 | H6 | 3 | J2 | 3 |
| 154 | B8 | A14 | F4 | 5 | H6 | 3 | J3 | 3 |
| 155 | B9 | A14 | F4 | 5 | H6 | 3 | J4 | 3 |
| 156 | B10 | A14 | F4 | 5 | H6 | 3 | J5 | 3 |

TABLE 46

| Single layer-type photosensitive materials | | | | | | | | |
|---|---|---|---|---|---|---|---|---|
| | | | Stabilizer | | | | | |
| | | | Polyester-type amine antioxidant | | Spiro-type amine antioxidant | | Phenol antioxidant | |
| Example No. | Charge-generating material | Charge-transfer-ring material | Kind | Amount (parts by weight) | Kind | Amount (parts by weight) | Kind | Amount (parts by weight) |
| 157 | B6 | A6 | F6 | 5 | H5 | 3 | G1 | 20 |
| 158 | B7 | A6 | F6 | 5 | H5 | 3 | G2 | 20 |
| 159 | B8 | A6 | F6 | 5 | H5 | 3 | G3 | 20 |
| 160 | B9 | A6 | F6 | 5 | H5 | 3 | G4 | 20 |
| 161 | B10 | A6 | F6 | 5 | H5 | 3 | G5 | 20 |

Tests of electrical and repetitive properties were conducted on the electrophotosensitive material of each Example and Comparative Example in the same method as in Examples 1 to 3. In measurment of the half-life light exposure, however, the light intensity to be exposed was set in 0.2 mW/cm$^2$, and the repetitive property was evaluated at 10,000 copies. Test results are shown in Tables 17 to 51.

TABLE 47

| Multilayer-type photosensitive materials | | | |
|---|---|---|---|
| Example No. | Vs. p. (V) | Potential after light exposure (V) | Half-life light exposure (μJ/cm²) |
| Ex. | | | |
| 102 | −818 | −80 | 1.36 |
| 103 | −807 | −82 | 1.29 |
| 104 | −815 | −68 | 1.41 |
| 105 | −820 | −73 | 1.46 |
| 106 | −816 | −76 | 1.28 |
| 107 | −820 | −92 | 1.19 |
| 108 | −813 | −86 | 1.27 |
| 109 | −808 | −88 | 1.31 |
| 110 | −811 | −98 | 1.44 |
| 111 | −815 | −101 | 1.26 |
| 112 | −816 | −82 | 1.21 |
| 113 | −809 | −73 | 1.35 |
| 114 | −819 | −75 | 1.46 |
| 115 | −817 | −86 | 1.27 |
| 116 | −803 | −92 | 1.45 |
| 117 | −821 | −88 | 1.35 |
| 118 | −809 | −103 | 1.26 |
| 119 | −825 | −92 | 1.55 |
| 120 | −800 | −86 | 1.28 |

TABLE 48

| Multilayer-type photosensitive materials | | | |
|---|---|---|---|
| Example No. | Vs. p. (V) | Potential after light exposure (V) | Half-life light exposure (μJ/cm²) |
| Ex. | | | |
| 121 | −808 | −79 | 1.21 |
| 122 | −820 | −92 | 1.18 |
| 123 | −801 | −98 | 1.45 |
| 124 | −813 | −69 | 1.52 |
| 125 | −816 | −83 | 1.61 |
| 126 | −817 | −92 | 1.35 |
| 127 | −823 | −96 | 1.26 |
| 128 | −827 | −78 | 1.61 |
| 129 | −808 | −86 | 1.25 |
| 130 | −805 | −92 | 1.36 |
| 131 | −815 | −95 | 1.27 |

TABLE 49

| Single layer-type photosensitive materials | | | |
|---|---|---|---|
| Example No. | Vs. p. (V) | Potential after light exposure (V) | Half-life light exposure (μJ/cm²) |
| Ex. | | | |
| 132 | 823 | 88 | 1.44 |
| 133 | 816 | 96 | 1.25 |
| 134 | 809 | 92 | 1.36 |
| 135 | 817 | 78 | 1.29 |
| 136 | 820 | 85 | 1.46 |
| 137 | 819 | 96 | 1.28 |
| 138 | 808 | 85 | 1.21 |
| 139 | 806 | 75 | 1.23 |
| 140 | 825 | 77 | 1.33 |
| 141 | 815 | 98 | 1.52 |
| 142 | 807 | 76 | 1.46 |
| 143 | 802 | 82 | 1.25 |
| 144 | 813 | 95 | 1.37 |
| 145 | 812 | 84 | 1.41 |
| 146 | 800 | 92 | 1.26 |

TABLE 49-continued

| Single layer-type photosensitive materials | | | |
|---|---|---|---|
| Example No. | Vs. p. (V) | Potential after light exposure (V) | Half-life light exposure (μJ/cm²) |
| 147 | 820 | 98 | 1.45 |
| 148 | 815 | 100 | 1.24 |

TABLE 50

| Single layer-type photosensitive materials | | | |
|---|---|---|---|
| Example No. | Vs. p. (V) | Potential after light exposure (V) | Half-life light exposure (μJ/cm²) |
| Ex. | | | |
| 149 | 825 | 88 | 1.27 |
| 150 | 811 | 87 | 1.44 |
| 151 | 801 | 98 | 1.51 |
| 152 | 825 | 92 | 1.26 |
| 153 | 818 | 69 | 1.22 |
| 154 | 823 | 82 | 1.33 |
| 155 | 818 | 88 | 1.29 |
| 156 | 809 | 96 | 1.33 |
| 157 | 812 | 102 | 1.25 |
| 158 | 808 | 93 | 1.19 |
| 159 | 800 | 90 | 1.32 |
| 160 | 820 | 86 | 1.18 |
| 161 | 815 | 87 | 1.20 |

TABLE 51

| Results after repeating 10,000 copies | | | |
|---|---|---|---|
| Example No. | Vs. p. (V) | Potential after light exposure (V) | Half-life light exposure (μJ/cm²) |
| Multilayer Ex. | | | |
| 102 | −726 | −42 | 1.43 |
| 108 | −715 | −63 | 1.33 |
| 113 | −740 | −57 | 1.51 |
| 120 | −705 | −62 | 1.36 |
| 125 | −680 | −45 | 1.82 |
| 131 | −732 | −65 | 1.31 |
| Single layer Ex. | | | |
| 136 | 705 | 91 | 1.51 |
| 141 | 733 | 103 | 1.77 |
| 146 | 680 | 98 | 1.36 |
| 147 | 720 | 90 | 1.43 |
| 152 | 715 | 108 | 1.44 |
| 157 | 730 | 107 | 1.56 |

As apparent from Tables 47 to 51, the photosensitive material of each Example had a high sensitivity, clear images were produced even in normal light-exposure to intensity and excellent images were produced after repeated copying.

Example 162 (Single-Layer Photosensitive Material)

Together with a predetermined tetrahydrofuran, as the charge generating materials, 5 parts by weight of bis-azo pigment expressed in the formula (B10) and 3 parts by weight of perylene pigment expressed in the formula (P1);

as the charge transferring materials, 90 parts by weight of diamine compound expressed in the formula (A9) and 18 parts by weight of diphenoquinone derivative expressed in the formula (E1); as the stabilizers, 1.5 parts by weight of oligomer-type amine antioxidant (molecular weight of not less than 3,000) expressed in the formula (F3), 2 parts by weight of amine antioxidant expressed in the formula (H4) and 10 parts by weight of benzotriazole UV absorber expressed in the formula (I3); and 100 parts by weight of polycarbonate resin as the binding resin were mixed, and a coating liquid for single layer-type photosensitive layer was prepared in the same manner as for Example 37.

By using the coating liquid thus obtained sheet-type and drum-type electrophotsensitive materials, each of which had a single layer-type photsensitive layer having a thickness of 25 to 30 μm were prepared in the same manner as for Example 37.

Example 163 (Single-layer Photosensitive Material)

Sheet-type and drum-type electrophotsensitive materials, each of which had a single layer-type photsensitive layer were respectively prepared in the same manner as for Example 162 except that N,N,N',N'-tetrakis(3-methylphenyl)-1,3-diaminobenzene was used as the charge transferring material instead of diamine compound expressed in the formula (A9) at the same amount as diamine compound.

Example 164 (Single-Layer Photosensitive Material)

Sheet-type and drum-type electrophotsensitive materials, each of which had a single layer-type photsensitive layer were respectively prepared in the same manner as for Example 162, except that 60 parts by weight of diamine compound expressed in the formula (A9) and 30 parts by weight of N,N,N',N'-tetrakis(3-methylphenyl)-1,3-diaminobenzene were used as the charge transferring materials instead of diamine compound expressed in the formula (A9).

Example 165 (Single-Layer Photosensitive Material)

Sheet-type and drum-type electrophotsensitive materials, each of which had a single layer-type photsensitive layer were respectively prepared in the same manner as for Example 162, except that 90 parts by weight of diamine compound expressed in the formula (A9), 10 parts by weight of hydrazone compound expressed in the formula (C2) and 2 parts by weight of fluorene compound expressed in the formula (D1) were used instead of diamine compound expressed in the formula (A9).

Example 166 (Single-Layer Photosensitive Material)

Sheet-type and drum-type electrophotsensitive materials, each of which had a single layer-type photsensitive layer were respectively prepared in the same manner as for Example 162, except that 12 parts by weight of diphenoquinone derivative expressed in the formula (E7) was used instead of 18 parts by weight of diphenoquinone derivative expressed in the formula (E1).

Example 167 (Single-Layer Photosensitive Material)

Sheet-type and drum-type electrophotsensitive materials, each of which had a single layer-type photsensitive layer were respectively prepared in the same manner as for Example 162, except that 10 parts by weight of diphenoquinone derivative expressed in the formula (E1) and 5 parts by weight of diphenoquinone derivative expressed in the formula (E7) were used instead of 18 parts by weight of diphenoquinone derivative expressed in the formula (E1).

Example 168 (Single-Layer Photosensitive Material)

Sheet-type and drum-type electrophotsensitive materials, each of which had a single layer-type photsensitive layer were respectively prepared in the same manner as for Example 162, except that a compound expressed in formula (Q1):

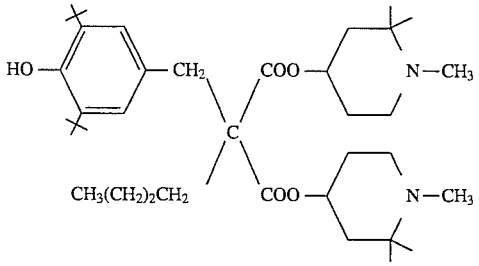

(Q1)

was used as the stabilizer instead of oligomer-type amine antioxidant expressed in the formula (F3) at the same amount as oligomer-type amine antioxidant.

Example 169 (Single-Layer Photosensitive Material)

Sheet-type and drum-type electrophotsensitive materials, each of which had a single layer-type photsensitive layer were respectively prepared in the same manner as for Example 162, except that 3 parts by weight of piperidine antioxidant expressed in formula (J4) was used instead of 1.5 parts by weight of oligomer-type amine antioxidant expressed in the formula (F3) at the same amount as oligomer-type amine antioxidant.

Example 170 (Single-Layer Photosensitive Material)

Sheet-type and drum-type electrophotsensitive materials, each of which had a single layer-type photsensitive layer were respectively prepared in the same manner as for Example 162, except that 1.5 parts by weight of oligomer-type amine antioxidant expressed in the formula (F3) and 1 parts by weight of piperidine antioxidant expressed in formula (J4) were used instead of 1.5 parts by weight of oligomer-type amine antioxidant expressed in the formula (F3).

Example 171 (Single-Layer Photosensitive Material)

Sheet-type and drum-type electrophotsensitive materials, each of which had a single layer-type photsensitive layer were respectively prepared in the same manner as for Example 162, except that 85 parts by weight of diamine compound expressed in the formula (A9), 5 parts by weight of N,N,N',N'-tetrakis(3-methylphenyl)-1,3-diaminobenzene and 10 parts by weight of diphenoquinone expressed in formula (E7) were used instead of 90 parts by weight of diamine compound expressed in the formula (A9) and 18 parts by weight of the diphenoquinone derivative of Formula (E1).

Example 172 (Single-Layer Photosensitive Material)

Sheet-type and drum-type electrophotsensitive materials, each of which had a single layer-type photsensitive layer were respectively prepared in the same manner as for Example 162, except that 1.5 parts by weight of oligomer-type amine antioxidant expressed in the formula (F3) and 10 parts by weight of a compound expressed in formula (Q2):

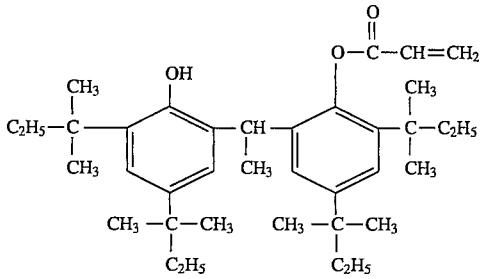

(Q2)

was used as the stabilizer instead of 1.5 parts by weight of oligomer-type amine antioxidant expressed in the formula (F3).

Example 173 (Single-Layer Photosensitive Material)

Sheet-type and drum-type electrophotsensitive materials, each of which had a single layer-type photsensitive layer were respectively prepared in the same manner as for Example 162, except that 1.5 parts by weight of oligomer-type amine antioxidant expressed in the formula (F3) and 0.5 parts by weight of a compound expressed in formula (Q1) were used instead of 1.5 parts by weight of oligomer-type amine antioxidant expressed in the formula (F3).

Example 172 (Single-Layer Photosensitive Material)

Sheet-type and drum-type electrophotsensitive materials, each of which had a single layer-type photsensitive layer were respectively prepared in the same manner as for Example 162, except that 1.5 parts by weight of oligomer-type amine antioxidant expressed in the formula (F3) and 5 parts by weight of tribenzylamine [$N(CH_2—C_6H_5)_3$] were used as the stabilizer instead of 1.5 parts by weight of oligomer-type amine antioxidant expressed in the formula (F3).

Example 175 (Single-Layer Photosensitive Material)

Sheet-type and drum-type electrophotsensitive materials, each of which had a single layer-type photsensitive layer were respectively prepared in the same manner as for Example 162, except that diamine compound expressed in the formula (A3) was used instead of diamine compound expressed in the formula (A9).

An initial surface potential, a potential after light exposure and a half-life light exposure were measured on the photsensitive material of each Example 162 to 175 in the same manner as for Examples 1 to 3, and a durability test was conducted in the same manner as for Example 37 to calculate a change amount Δ V s.p. of the surface potential.

These test results are shown in Table 52.

TABLE 52

| Example No. | Initial Vs. p. (V) | Potential after light exposure (V) | $E_{1/2}$ (μJ/cm²) | Δ Vs. p. after repeating 1,000 copies (V) |
|---|---|---|---|---|
| Ex. | | | | |
| 162 | +805 | +55 | 0.55 | −5 |
| 163 | +800 | +60 | 0.61 | +25 |
| 164 | +795 | +57 | 0.54 | ±0 |
| 165 | +805 | +52 | 0.51 | +5 |
| 166 | +810 | +54 | 0.50 | −5 |
| 167 | +795 | +54 | 0.56 | −10 |
| 168 | +805 | +60 | 0.57 | −5 |
| 169 | +805 | +62 | 0.56 | −10 |
| 170 | +810 | +67 | 0.62 | +5 |
| 171 | +795 | +58 | 0.54 | −5 |
| 172 | +815 | +68 | 0.69 | ±0 |
| 173 | +800 | +65 | 0.62 | +5 |
| 174 | +795 | +70 | 0.68 | −10 |
| 175 | +805 | +55 | 0.57 | −15 |

Example 176 to 185 (Single-Layer Photosensitive Material)

Together with dichloromethan, 6 parts by weight of the bis-azo pigment (when using 2 types, the mixture ratio of 1:1) which is a charge generating material, 60 parts by weight of the diamine compound (which is a charge transferring material), 40 parts by weight of the hydrazone compound, 25 parts by weight of the fluorene compound, 10 parts by weight of the diphenoquinone derivative, 150 parts by weight of the bisphenol Z type polycarbonate, as stabilizers, 10 parts by weight of the oligomer type amine antioxidant and 20 parts by weight of UV absorber were mixed and dispersed for 2 minutes by an ultrasonic dispersing device to prepare a coating liquids for single-layer type photosensitive layer.

The coating liquids were applied to the surfaces of an aluminum cylinders by dipping, and allowed to dry at 80° C. for 120 minutes to form single layer-type photosensitive layers having thickness, of 30 μm. Thus, single layer-type electrophotosensitive materials being positive type were prepared.

Each material used are shown in Table 53 with the compound number in practical examples mentioned above.

Stability of coating liquid

After preserving the coating liquid prepared in each of Examples 176 to 185 for 2 weeks single layer-type electrophotosensitive material being positive type was prepared by the same manner as mentioned above.

Concerning the electrophotosensitive material prepared in each Example, tests for the electrical property and the repetitive property were conducted by the same manner as Example 19 to evaluate the properties.

Test results are shown in Tables 54 and 55.

TABLE 53

| Example No. | Bis-azo pigment | Diamine compound | Hydrazone compound | Fluoroene compound | Dipheno-quinone derivative | Oligomer-type amine antioxidant | UV absorber |
|---|---|---|---|---|---|---|---|
| | Single layer-type photosensitive Materials | | | | | | |
| Ex. | | | | | | | |
| 176 | B1 + B3 | A9 | C1 | D1 | E1 | F2 | I3 |
| 177 | B1 + B4 | A9 | C1 | D1 | E1 | F2 | I3 |
| 178 | B4 + B7 | A9 | C1 | D1 | E1 | F2 | I3 |
| 179 | B1 + B9 | A9 | C1 | D1 | E1 | F2 | I3 |
| 180 | B4 + B9 | A9 | C1 | D1 | E1 | F2 | I3 |
| 181 | B4 + B10 | A9 | C1 | D1 | E1 | F2 | I3 |
| 182 | B7 + B10 | A9 | C1 | D1 | E1 | F2 | I3 |
| 183 | B1 | A9 | C1 | D1 | E1 | F2 | I3 |
| 184 | B4 | A9 | C1 | D1 | E1 | F2 | I3 |
| 185 | B10 | A9 | C1 | D1 | E1 | F2 | I3 |

TABLE 54

| | Coating liquid at Initiation | | | Coating liquid after preserved for two weeks | | |
|---|---|---|---|---|---|---|
| Example No. | Vs.p. (V) | Potential after light exposure (V) | $E_{1/2}$ (μJ/cm²) | Vs.p. (V) | Potential after light exposure (V) | $E_{1/2}$ (μJ/cm²) |
| 176 | 807 | 75 | 1.07 | 821 | 79 | 1.16 |
| 177 | 819 | 77 | 1.15 | 823 | 84 | 1.26 |
| 178 | 801 | 77 | 1.18 | 811 | 85 | 1.33 |
| 179 | 811 | 83 | 1.23 | 812 | 90 | 1.42 |
| 180 | 809 | 69 | 1.03 | 822 | 73 | 1.07 |
| 181 | 813 | 59 | 0.77 | 817 | 65 | 1.01 |
| 182 | 817 | 60 | 0.85 | 806 | 67 | 1.07 |
| 183 | 823 | 80 | 1.14 | 815 | 105 | 1.88 |
| 184 | 819 | 66 | 1.00 | 809 | 89 | 1.39 |
| 185 | 814 | 57 | 0,49 | 803 | 85 | 1.40 |

TABLE 55

| | After 50,000 continuous copies Coating liquid at Initiation | | |
|---|---|---|---|
| Example No. | Vs.p (V) | Potential after light exposure (V) | $E_{1/2}$ (μJ/cm²) |
| 176 | 757 | 72 | 1.08 |
| 177 | 772 | 75 | 1.16 |
| 178 | 753 | 75 | 1.13 |
| 179 | 763 | 80 | 1.20 |
| 180 | 769 | 73 | 1.01 |
| 181 | 772 | 64 | 0.82 |
| 182 | 759 | 62 | 0.79 |
| 183 | 703 | 87 | 1.29 |
| 184 | 700 | 75 | 1.11 |
| 185 | 703 | 63 | 0.83 |

What is claimed is:

1. An electrophotosensitive material comprising:

a conductive substrate; and a single layer photosensitive layer provided on said conductive substrates, said photosensitive layer containing a bis-azo pigment according to formula (1) as a charge generating material:

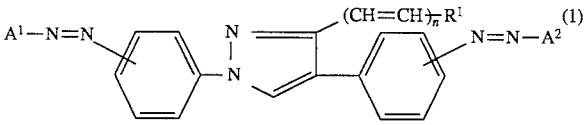

(1)

wherein $A^1$ and $A^2$ denote coupler residual groups which are the same or different from one another; n is 0 or 1; and $R^1$ denotes a member selected from the group consisting of: a hydrogen atom, an alkyl group, an aryl group and a heterocyclic group, wherein when $R^1$ is an alkyl group, the alkyl group may include a substituent selected from the group consisting of: a halogen atom, an amino group, a hydroxyl group, a carboxyl group which may be esterified, a cyano group, an alkoxy group with 1 to 6 carbon atoms, and an alkenyl group with 2 to 6 carbon atoms which may include an aryl group, and when $R^1$ is an aryl group or a heterocyclic group, the aryl group or the heterocyclic group may include a substituent selected from the group consisting of: a halogen atom, an amino group, a hydroxyl group, a carboxyl group which may be esterified, a cyano group, an alkyl group with 1 to 6 carbon atoms, an alkoxy group with 1 to 6 carbon atoms, and an alkenyl group with 2 to 6 carbon atoms which may include an aryl group;

said photosensitive layer further including a diamine compound according to formula (2) as a charge transferring material:

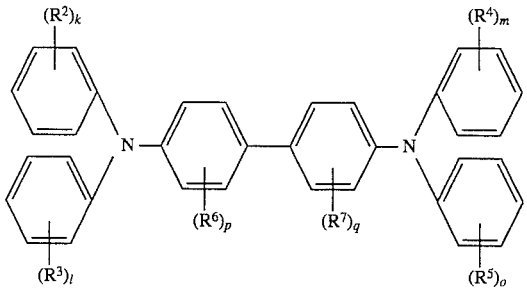

(2)

wherein $R^2$, $R^3$, $R^4$, $R^5$, $R^6$ and $R^7$ are the same or different, and are selected from the group consisting of: alkyl groups, alkoxyl groups, halogen atoms, aryl groups, nitro groups, cyano groups and alkylamino groups; p and q are the same or different, and are integers in the range of 0 to 3; and k, l, m and o are the same or different, and are integers in the range of 0 to 2;

said photosensitive layer further including a diphenoquinone derivative according to formula (5):

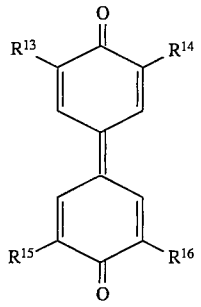

(5)

wherein $R^{13}$, $R^{14}$, $R^{15}$ and $R^{16}$ are the same or different, and are selected from the group consisting of: alkyl groups, alkoxyl groups, aryl groups and aralkyl groups, wherein said diphenoquinone derivative of formula (5) is present in an amount of 15 to 100 parts by weight for 100 parts by weight of the diamine compound of formula (2).

2. An electrophotosensitive material according to claim 1, wherein said photosensitive layer includes, as binding resin, a polycarbonate and a polyester having a repeat unit according to formula (50):

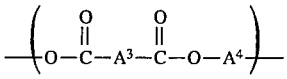

(50)

wherein one of $A^3$ and $A^4$ denotes a divalent group including at least an aromatic ring in the main chain, and the other denotes a divalent group not including an aromatic ring in the main chain, wherein said polyester is contained in an amount of 0.5 to 50% by weight based on a total amount of the polycarbonate and the polyester.

3. An electrophotosensitive material according to claim 2, wherein said polycarbonate is at least one member selected from the group consisting of compounds having repeat units according to formula (67) and compounds having repeat units according to formula (69) as follows:

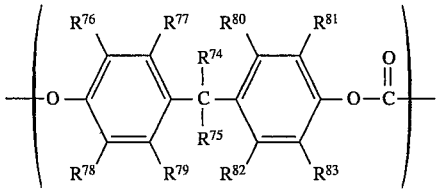

(67)

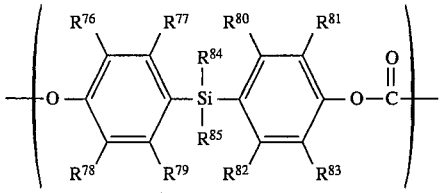

(69)

wherein $R^{74}$ and $R^{75}$ are the same or different, and are selected from the group consisting of: hydrogen atoms, aliphatic groups and aromatic groups, wherein said $R^{74}$ and $R^{75}$ may be bonded with each other to form a ring, wherein $R^{76}$, $R^{77}$, $R^{78}$, $R^{79}$, $R^{80}$, $R^{81}$, $R^{82}$ and $R^{83}$ are the same or different, and are selected from the group consisting of: hydrogen atoms, halogen atoms, aliphatic groups and aromatic groups, and wherein $R^{84}$ and $R^{85}$ denote a member selected from the group consisting of: hydrogen atoms, halogen atoms, alkyl groups and aryl groups.

4. An electrophotosensitive material according to claim 2, wherein said polyester having a repeat unit according to formula (50) has an acid value of not more than 2 (KOH mq/q).

5. An electrophotosensitive material according to claim 2, wherein the polyester having a repeat unit according to formula (50) is made from raw materials including an acid component according to formula (50a) and a diol component according to formula (50b) as follows:

$$HOOC—A^3—COOH \quad (50a)$$

$$HO—A^4—OH \quad (50b)$$

wherein $A^3$ and $A^4$ have the same meanings as in claim 2, wherein the component including the aromatic ring in the main chain thereof is included in an amount in the range of 40 to 80 mol % based on a total amount of said acid component and said diol component.

* * * * *